US009175542B2

(12) United States Patent
Bailey et al.

(10) Patent No.: US 9,175,542 B2
(45) Date of Patent: Nov. 3, 2015

(54) LUBRICATING SEAL FOR USE WITH A TUBULAR

(75) Inventors: Thomas F. Bailey, Houston, TX (US); Frederick Thomas Tilton, Spring, TX (US); Don M. Hannegan, Fort Smith, AR (US); Waybourn J. Anderson, Jr., Houston, TX (US); Simon J. Harrall, Houston, TX (US)

(73) Assignee: Weatherford/Lamb, Inc.

( * ) Notice: Subject to any disclaimer, the term of this patent is extended or adjusted under 35 U.S.C. 154(b) by 628 days.

(21) Appl. No.: 12/824,934

(22) Filed: Jun. 28, 2010

(65) Prior Publication Data

US 2011/0315404 A1 Dec. 29, 2011

(51) Int. Cl.
*E21B 33/06* (2006.01)
*E21B 33/02* (2006.01)
(Continued)

(52) U.S. Cl.
CPC ..... *E21B 33/085* (2013.01); *E21B 21/015* (2013.01); *E21B 33/02* (2013.01); *E21B 33/06* (2013.01)

(58) Field of Classification Search
CPC ... E21B 2033/005; E21B 33/02; E21B 33/03; E21B 33/06
USPC ..... 166/85.4, 88.1, 84.1, 84.2, 84.3; 277/324
See application file for complete search history.

(56) References Cited

U.S. PATENT DOCUMENTS 517,509 A 4/1894 Williams
1,157,644 A 10/1915 London
(Continued)

FOREIGN PATENT DOCUMENTS

AU 199927822 B2 9/1999
AU 200028183 A1 9/2000
(Continued)

OTHER PUBLICATIONS

PCT//GB2011/051219 Notification of Transmittal of International Search Report and the Written Opinion of the International Searching Authority mailed Aug. 30, 2012 corresponding to US2011/0315404 A1 (our matter 65)(13 pages).
(Continued)

*Primary Examiner* — Brad Harcourt
(74) *Attorney, Agent, or Firm* — Strasburger & Price, LLP

(57) ABSTRACT

Sealing elements have lubricating seal profiles for communicating fluid between the sealing elements and the sealed drill string tubular or other oilfield component while the sealed drill string tubular or other oilfield component rotates or moves vertically relative to the seal elements. The same fluid used for drilling may also be used for seal lubrication, such as water, drilling fluid or mud, well bore fluid or other liquid or gas. The sealing elements may be disposed with a seal housing, which may be positioned with a marine riser, or subsea without a marine riser. The seal housing may prevent rotation of the seal elements with the sealed drill string tubular or other oilfield component. Alternatively, the seal housing may be an RCD that allows the sealing elements to rotate. The lubricating seal profiles include a wave pattern, a saw-tooth high film pattern, a downwardly inclined passageway pattern, an upwardly inclined passageway pattern, and a combined upwardly and downwardly inclined passageway pattern. In one embodiment, a stripper rubber seal element may have a lubricating seal profile on the inwardly facing bore surfaces of both its nose and throat sections for sealing with drill string tubulars and other oilfield components having different diameters. Dual seals with two annular spaced apart sealing surfaces, with or without lubricating seal profiles, may seal with a drill string tubular or other oilfield component. In another embodiment, differential pressures across two seal elements may be managed by filling the cavity between the two sealing elements with cuttings-free drilling fluid, mud, water, coolant, lubricant or inert gas at desired amounts of pressure.

56 Claims, 12 Drawing Sheets

(51) Int. Cl.
*E21B 33/08* (2006.01)
*E21B 21/015* (2006.01)

(56) References Cited

U.S. PATENT DOCUMENTS

| | | | |
|---|---|---|---|
| 1,472,952 | A | 11/1923 | Anderson |
| 1,503,476 | A | 8/1924 | Childs et al. |
| 1,528,560 | A | 3/1925 | Myers et al. |
| 1,546,467 | A | 7/1925 | Bennett |
| 1,560,763 | A | 11/1925 | Collins |
| 1,700,894 | A | 2/1929 | Joyce et al. |
| 1,708,316 | A | 4/1929 | MacClatchie |
| 1,769,921 | A | 7/1930 | Hansen |
| 1,776,797 | A | 9/1930 | Sheldon |
| 1,813,402 | A | 7/1931 | Hewitt |
| 2,038,140 | A | 7/1931 | Stone |
| 1,831,956 | A | 11/1931 | Harrington |
| 1,836,470 | A | 12/1931 | Humason et al. |
| 1,902,906 | A | 3/1933 | Seamark |
| 1,942,366 | A | 1/1934 | Seamark |
| 2,036,537 | A | 4/1936 | Otis |
| 2,071,197 | A | 2/1937 | Burns et al. |
| 2,124,015 | A | 7/1938 | Stone et al. |
| 2,126,007 | A | 8/1938 | Gulberson et al. |
| 2,144,682 | A | 1/1939 | MacClatchie |
| 2,148,844 | A | 2/1939 | Stone et al. |
| 2,163,813 | A | 6/1939 | Stone et al. |
| 2,165,410 | A | 7/1939 | Penick et al. |
| 2,170,915 | A | 8/1939 | Schweitzer |
| 2,170,916 | A | 8/1939 | Schweitzer et al. |
| 2,175,648 | A | 10/1939 | Roach |
| 2,176,355 | A | 10/1939 | Otis |
| 2,185,822 | A | 1/1940 | Young |
| 2,199,735 | A | 5/1940 | Beckman |
| 2,211,122 | A | 8/1940 | Howard |
| 2,222,082 | A | 11/1940 | Leman et al. |
| 2,233,041 | A | 2/1941 | Alley |
| 2,243,340 | A | 5/1941 | Hild |
| 2,243,439 | A | 5/1941 | Pranger et al. |
| 2,287,205 | A | 6/1942 | Stone |
| 2,303,090 | A | 11/1942 | Pranger et al. |
| 2,313,169 | A | 3/1943 | Penick et al. |
| 2,325,556 | A | 7/1943 | Taylor, Jr. et al. |
| 2,338,093 | A | 1/1944 | Caldwell |
| 2,480,955 | A | 9/1949 | Penick |
| 2,506,538 | A | 5/1950 | Bennett |
| 2,529,744 | A | 11/1950 | Schweitzer, Jr. |
| 2,609,836 | A | 9/1952 | Knox |
| 2,628,852 | A | 2/1953 | Voytech |
| 2,646,999 | A | 7/1953 | Barske |
| 2,649,318 | A | 8/1953 | Skillman |
| 2,731,281 | A | 1/1956 | Knox |
| 2,746,781 | A | 5/1956 | Jones |
| 2,760,750 | A | 8/1956 | Schweitzer, Jr. et al. |
| 2,760,795 | A | 8/1956 | Vertson |
| 2,764,999 | A | 10/1956 | Stanbury |
| 2,808,229 | A | 10/1957 | Bauer et al. |
| 2,808,230 | A | 10/1957 | McNeil et al. |
| 2,846,178 | A | 8/1958 | Minor |
| 2,846,247 | A | 8/1958 | Davis |
| 2,853,274 | A | 9/1958 | Collins |
| 2,862,735 | A | 12/1958 | Knox |
| 2,886,350 | A | 5/1959 | Horne |
| 2,904,357 | A | 9/1959 | Knox |
| 2,927,774 | A | 3/1960 | Ormsby |
| 2,929,610 | A | 3/1960 | Stratton |
| 2,962,096 | A | 11/1960 | Knox |
| 2,995,196 | A | 8/1961 | Gibson et al. |
| 3,023,012 | A | 2/1962 | Wilde |
| 3,029,083 | A | 4/1962 | Wilde |
| 3,032,125 | A | 5/1962 | Hiser et al. |
| 3,033,011 | A | 5/1962 | Garrett |
| 3,052,300 | A | 9/1962 | Hampton |
| 3,096,999 | A | 7/1963 | Ahlstone et al. |
| 3,100,015 | A | 8/1963 | Regan |
| 3,128,614 | A | 4/1964 | Auer |
| 3,134,613 | A | 5/1964 | Regan |
| 3,176,996 | A | 4/1965 | Barnett |
| 3,203,358 | A | 8/1965 | Regan et al. |
| 3,209,829 | A | 10/1965 | Haeber |
| 3,216,731 | A | 11/1965 | Dollison |
| 3,225,831 | A | 12/1965 | Knox |
| 3,259,198 | A | 7/1966 | Montgomery et al. |
| 3,268,233 | A | 8/1966 | Brown |
| 3,285,352 | A | 11/1966 | Hunter |
| 3,288,472 | A | 11/1966 | Watkins |
| 3,289,761 | A | 12/1966 | Smith et al. |
| 3,294,112 | A | 12/1966 | Watkins |
| 3,302,048 | A | 1/1967 | Gray |
| 3,313,345 | A | 4/1967 | Fischer |
| 3,313,358 | A | 4/1967 | Postlewaite et al. |
| 3,323,773 | A | 6/1967 | Walker |
| 3,333,870 | A | 8/1967 | Watkins |
| 3,347,567 | A | 10/1967 | Watkins |
| 3,360,048 | A | 12/1967 | Watkins |
| 3,372,761 | A | 3/1968 | van Gils |
| 3,387,851 | A | 6/1968 | Cugini |
| 3,397,928 | A | 8/1968 | Galle |
| 3,400,938 | A | 9/1968 | Williams |
| 3,401,600 | A | 9/1968 | Wood |
| 3,405,763 | A | 10/1968 | Pitts et al. |
| 3,421,580 | A | 1/1969 | Fowler et al. |
| 3,424,197 | A | 1/1969 | Yanagisawa |
| 3,443,643 | A | 5/1969 | Jones |
| 3,445,126 | A | 5/1969 | Watkins |
| 3,452,815 | A | 7/1969 | Watkins |
| 3,472,518 | A | 10/1969 | Harlan |
| 3,476,195 | A | 11/1969 | Galle |
| 3,481,610 | A | 12/1969 | Slator et al. |
| 3,485,051 | A | 12/1969 | Watkins |
| 3,492,007 | A | 1/1970 | Jones |
| 3,493,043 | A | 2/1970 | Watkins |
| 3,503,460 | A | 3/1970 | Gadbois |
| 3,522,709 | A | 8/1970 | Vilain |
| 3,529,835 | A | 9/1970 | Lewis |
| 3,561,723 | A | 2/1971 | Cugini |
| 3,583,480 | A | 6/1971 | Regan |
| 3,587,734 | A | 6/1971 | Shaffer |
| 3,603,409 | A | 9/1971 | Watkins |
| 3,621,912 | A | 11/1971 | Wooddy, Jr. et al. |
| 3,631,834 | A | 1/1972 | Gardner et al. |
| 3,638,721 | A | 2/1972 | Harrison |
| 3,638,742 | A | 2/1972 | Wallace |
| 3,653,350 | A | 4/1972 | Koons et al. |
| 3,661,409 | A | 5/1972 | Brown et al. |
| 3,664,376 | A | 5/1972 | Watkins |
| 3,667,721 | A | 6/1972 | Vujasinovic |
| 3,677,353 | A | 7/1972 | Baker |
| 3,724,862 | A | 4/1973 | Biffle |
| 3,741,296 | A | 6/1973 | Murman et al. |
| 3,779,313 | A | 12/1973 | Regan |
| 3,815,673 | A | 6/1974 | Bruce et al. |
| 3,827,511 | A | 8/1974 | Jones |
| 3,847,215 | A | 11/1974 | Herd |
| 3,868,832 | A | 3/1975 | Biffle |
| 3,872,717 | A | 3/1975 | Fox |
| 3,901,517 | A | 8/1975 | Heathcott |
| 3,924,678 | A | 12/1975 | Ahlstone |
| 3,934,887 | A | 1/1976 | Biffle |
| 3,952,526 | A | 4/1976 | Watkins et al. |
| 3,955,622 | A | 5/1976 | Jones |
| 3,965,987 | A | 6/1976 | Biffle |
| 3,976,148 | A | 8/1976 | Maus et al. |
| 3,984,990 | A | 10/1976 | Jones |
| 3,992,889 | A | 11/1976 | Watkins et al. |
| 3,999,766 | A | 12/1976 | Barton |
| 4,037,890 | A | 7/1977 | Kurita et al. |
| 4,046,191 | A | 9/1977 | Neath |
| 4,052,703 | A | 10/1977 | Collins, Sr. et al. |
| 4,053,023 | A | 10/1977 | Herd et al. |
| 4,063,602 | A | 12/1977 | Howell et al. |
| 4,087,097 | A | 5/1978 | Bossens et al. |
| 4,091,881 | A | 5/1978 | Maus |
| 4,098,341 | A | 7/1978 | Lewis |

(56) References Cited

U.S. PATENT DOCUMENTS

| | | | |
|---|---|---|---|
| 4,099,583 | A | 7/1978 | Maus |
| 4,109,712 | A | 8/1978 | Regan |
| 4,143,880 | A | 3/1979 | Bunting et al. |
| 4,143,881 | A | 3/1979 | Bunting |
| 4,149,603 | A | 4/1979 | Arnold |
| 4,154,448 | A | 5/1979 | Biffle |
| 4,157,186 | A | 6/1979 | Murray et al. |
| 4,183,562 | A | 1/1980 | Watkins et al. |
| 4,200,312 | A | 4/1980 | Watkins |
| 4,208,056 | A | 6/1980 | Biffle |
| 4,216,835 | A | 8/1980 | Nelson |
| 4,222,590 | A | 9/1980 | Regan |
| 4,249,600 | A | 2/1981 | Bailey |
| 4,281,724 | A | 8/1981 | Garrett |
| 4,282,939 | A | 8/1981 | Maus et al. |
| 4,285,406 | A | 8/1981 | Garrett et al. |
| 4,291,772 | A | 9/1981 | Beynet |
| 4,293,047 | A | 10/1981 | Young |
| 4,304,310 | A | 12/1981 | Garrett |
| 4,310,058 | A | 1/1982 | Bourgoyne, Jr. |
| 4,312,404 | A | 1/1982 | Morrow |
| 4,313,054 | A | 1/1982 | Martini |
| 4,326,584 | A | 4/1982 | Watkins |
| 4,335,791 | A | 6/1982 | Evans |
| 4,336,840 | A | 6/1982 | Bailey |
| 4,337,653 | A | 7/1982 | Chauffe |
| 4,345,769 | A | 8/1982 | Johnston |
| 4,349,204 | A | 9/1982 | Malone |
| 4,353,420 | A | 10/1982 | Miller |
| 4,355,784 | A | 10/1982 | Cain |
| 4,361,185 | A | 11/1982 | Biffle |
| 4,363,357 | A | 12/1982 | Hunter |
| 4,367,795 | A | 1/1983 | Biffle |
| 4,378,849 | A | 4/1983 | Wilks |
| 4,383,577 | A | 5/1983 | Pruitt |
| 4,384,724 | A | 5/1983 | Derman |
| 4,386,667 | A | 6/1983 | Millsapps, Jr. |
| 4,387,771 | A | 6/1983 | Jones |
| 4,398,599 | A | 8/1983 | Murray |
| 4,406,333 | A | 9/1983 | Adams |
| 4,407,375 | A | 10/1983 | Nakamura |
| 4,413,653 | A | 11/1983 | Carter, Jr. |
| 4,416,340 | A | 11/1983 | Bailey |
| 4,423,776 | A | 1/1984 | Wagoner et al. |
| 4,424,861 | A | 1/1984 | Carter, Jr. et al. |
| 4,427,072 | A | 1/1984 | Lawson |
| 4,439,068 | A | 3/1984 | Pokladnik |
| 4,440,232 | A | 4/1984 | LeMoine |
| 4,440,239 | A | 4/1984 | Evans |
| 4,441,551 | A | 4/1984 | Biffle |
| 4,444,250 | A | 4/1984 | Keithahn et al. |
| 4,444,401 | A | 4/1984 | Roche et al. |
| 4,448,255 | A | 5/1984 | Shaffer et al. |
| 4,456,062 | A | 6/1984 | Roche et al. |
| 4,456,063 | A | 6/1984 | Roche |
| 4,457,489 | A | 7/1984 | Gilmore |
| 4,478,287 | A | 10/1984 | Hynes et al. |
| 4,480,703 | A | 11/1984 | Garrett |
| 4,484,753 | A | 11/1984 | Kalsi |
| 4,486,025 | A | 12/1984 | Johnston |
| 4,488,703 | A | 12/1984 | Jones |
| 4,497,592 | A | 2/1985 | Lawson |
| 4,500,094 | A | 2/1985 | Biffle |
| 4,502,534 | A | 3/1985 | Roche et al. |
| 4,508,313 | A | 4/1985 | Jones |
| 4,509,405 | A | 4/1985 | Bates |
| 4,519,577 | A | 5/1985 | Jones |
| 4,523,765 | A | 6/1985 | Heidemann |
| 4,524,832 | A | 6/1985 | Roche et al. |
| 4,526,243 | A | 7/1985 | Young |
| 4,527,632 | A | 7/1985 | Chaudot |
| 4,529,210 | A | 7/1985 | Biffle |
| 4,531,580 | A | 7/1985 | Jones |
| 4,531,591 | A | 7/1985 | Johnston |
| 4,531,593 | A | 7/1985 | Elliott et al. |
| 4,531,951 | A | 7/1985 | Burt et al. |
| 4,533,003 | A | 8/1985 | Bailey |
| 4,540,053 | A | 9/1985 | Baugh et al. |
| 4,546,828 | A | 10/1985 | Roche |
| 4,553,591 | A | 11/1985 | Mitchell |
| D282,073 | S | 1/1986 | Bearden et al. |
| 4,566,494 | A | 1/1986 | Roche |
| 4,575,426 | A | 3/1986 | Bailey |
| 4,595,343 | A | 6/1986 | Thompson et al. |
| 4,597,447 | A | 7/1986 | Roche et al. |
| 4,597,448 | A | 7/1986 | Baugh |
| 4,610,319 | A | 9/1986 | Kalsi |
| 4,611,661 | A | 9/1986 | Hed et al. |
| 4,615,544 | A | 10/1986 | Baugh |
| 4,618,314 | A | 10/1986 | Hailey |
| 4,621,655 | A | 11/1986 | Roche |
| 4,623,020 | A | 11/1986 | Nichols |
| 4,626,135 | A | 12/1986 | Roche |
| 4,630,680 | A | 12/1986 | Elkins |
| 4,632,188 | A | 12/1986 | Schuh et al. |
| 4,646,826 | A | 3/1987 | Bailey et al. |
| 4,646,844 | A | 3/1987 | Roche et al. |
| 4,651,830 | A | 3/1987 | Crotwell |
| 4,660,863 | A | 4/1987 | Bailey et al. |
| 4,688,633 | A | 8/1987 | Barkley |
| 4,690,220 | A | 9/1987 | Braddick |
| 4,697,484 | A | 10/1987 | Klee et al. |
| 4,709,900 | A | 12/1987 | Dyer |
| 4,712,620 | A | 12/1987 | Lim et al. |
| 4,719,937 | A | 1/1988 | Roche et al. |
| 4,722,615 | A | 2/1988 | Bailey et al. |
| 4,727,942 | A | 3/1988 | Galle et al. |
| 4,736,799 | A | 4/1988 | Ahlstone |
| 4,745,970 | A | 5/1988 | Bearden et al. |
| 4,749,035 | A | 6/1988 | Cassity |
| 4,754,820 | A | 7/1988 | Watts et al. |
| 4,757,584 | A | 7/1988 | Pav et al. |
| 4,759,413 | A | 7/1988 | Bailey et al. |
| 4,765,404 | A | 8/1988 | Bailey et al. |
| 4,783,084 | A | 11/1988 | Biffle |
| 4,807,705 | A | 2/1989 | Henderson et al. |
| 4,813,495 | A | 3/1989 | Leach |
| 4,817,724 | A | 4/1989 | Funderburg, Jr. et al. |
| 4,822,212 | A | 4/1989 | Hall et al. |
| 4,825,938 | A | 5/1989 | Davis |
| 4,828,024 | A | 5/1989 | Roche |
| 4,832,126 | A | 5/1989 | Roche |
| 4,836,289 | A | 6/1989 | Young |
| 4,844,406 | A | 7/1989 | Wilson |
| 4,865,137 | A | 9/1989 | Bailey |
| 4,882,830 | A | 11/1989 | Carstensen |
| 4,909,327 | A | 3/1990 | Roche |
| 4,949,796 | A | 8/1990 | Williams |
| 4,955,436 | A | 9/1990 | Johnston |
| 4,955,949 | A | 9/1990 | Bailey et al. |
| 4,962,819 | A | 10/1990 | Bailey et al. |
| 4,971,148 | A | 11/1990 | Roche et al. |
| 4,984,636 | A | 1/1991 | Bailey et al. |
| 4,995,464 | A | 2/1991 | Watkins et al. |
| 5,009,265 | A | 4/1991 | Bailey et al. |
| 5,022,472 | A | 6/1991 | Bailey et al. |
| 5,028,056 | A | 7/1991 | Bemis et al. |
| 5,035,292 | A | 7/1991 | Bailey |
| 5,040,600 | A | 8/1991 | Bailey et al. |
| 5,048,621 | A | 9/1991 | Bailey |
| 5,062,450 | A | 11/1991 | Bailey |
| 5,062,479 | A | 11/1991 | Bailey et al. |
| 5,072,795 | A | 12/1991 | Delgado et al. |
| 5,076,364 | A | 12/1991 | Hale et al. |
| 5,082,020 | A | 1/1992 | Bailey |
| 5,085,277 | A | 2/1992 | Hopper |
| 5,101,897 | A | 4/1992 | Leismer et al. |
| 5,137,084 | A | 8/1992 | Gonzales et al. |
| 5,147,559 | A | 9/1992 | Brophey et al. |
| 5,154,231 | A | 10/1992 | Bailey et al. |
| 5,163,514 | A | 11/1992 | Jennings |
| 5,165,480 | A | 11/1992 | Wagoner et al. |
| 5,178,215 | A | 1/1993 | Yenulis et al. |
| 5,182,979 | A | 2/1993 | Morgan |

(56) References Cited

U.S. PATENT DOCUMENTS

| | | | |
|---|---|---|---|
| 5,184,686 | A | 2/1993 | Gonzalez |
| 5,195,754 | A | 3/1993 | Dietle |
| 5,205,165 | A | 4/1993 | Jardine et al. |
| 5,213,158 | A | 5/1993 | Bailey et al. |
| 5,215,151 | A | 6/1993 | Smith et al. |
| 5,224,557 | A | 7/1993 | Yenulis et al. |
| 5,230,520 | A | 7/1993 | Dietle et al. |
| 5,243,187 | A | 9/1993 | Hettlage |
| 5,251,869 | A | 10/1993 | Mason |
| 5,255,745 | A | 10/1993 | Czyrek |
| 5,277,249 | A | 1/1994 | Yenulis et al. |
| 5,279,365 | A | 1/1994 | Yenulis et al. |
| 5,305,839 | A | 4/1994 | Kalsi et al. |
| 5,320,325 | A | 6/1994 | Young et al. |
| 5,322,137 | A | 6/1994 | Gonzales |
| 5,325,925 | A | 7/1994 | Smith et al. |
| 5,348,107 | A | 9/1994 | Bailey et al. |
| 5,375,476 | A | 12/1994 | Gray |
| 5,427,179 | A | 6/1995 | Bailey |
| 5,431,220 | A | 7/1995 | Bailey |
| 5,443,129 | A | 8/1995 | Bailey et al. |
| 5,495,872 | A | 3/1996 | Gallagher et al. |
| 5,529,093 | A | 6/1996 | Gallagher et al. |
| 5,588,491 | A | 12/1996 | Tasson et al. |
| 5,607,019 | A | 3/1997 | Kent |
| 5,647,444 | A | 7/1997 | Williams |
| 5,657,820 | A | 8/1997 | Bailey |
| 5,662,171 | A | 9/1997 | Brugman et al. |
| 5,662,181 | A | 9/1997 | Williams et al. |
| 5,671,812 | A | 9/1997 | Bridges |
| 5,678,829 | A | 10/1997 | Kalsi et al. |
| 5,735,502 | A | 4/1998 | Levett et al. |
| 5,738,358 | A | 4/1998 | Kalsi et al. |
| 5,755,372 | A | 5/1998 | Cimbura |
| 5,823,541 | A | 10/1998 | Dietle et al. |
| 5,829,531 | A | 11/1998 | Hebert et al. |
| 5,848,643 | A | 12/1998 | Carbaugh et al. |
| 5,873,576 | A | 2/1999 | Dietle et al. |
| 5,878,818 | A | 3/1999 | Hebert et al. |
| 5,901,964 | A | 5/1999 | Williams et al. |
| 5,944,111 | A | 8/1999 | Bridges |
| 5,952,569 | A | 9/1999 | Jervis |
| 5,960,881 | A | 10/1999 | Allamon et al. |
| 6,007,105 | A | 12/1999 | Dietle et al. |
| 6,016,880 | A | 1/2000 | Hall et al. |
| 6,017,168 | A | 1/2000 | Fraser, Jr. |
| 6,036,192 | A | 3/2000 | Dietle et al. |
| 6,039,118 | A | 3/2000 | Carter et al. |
| 6,050,348 | A | 4/2000 | Richarson et al. |
| 6,070,670 | A | 6/2000 | Carter et al. |
| 6,076,606 | A | 6/2000 | Bailey |
| 6,102,123 | A | 8/2000 | Bailey et al. |
| 6,102,673 | A | 8/2000 | Mott et al. |
| 6,109,348 | A | 8/2000 | Caraway |
| 6,109,618 | A | 8/2000 | Dietle |
| 6,112,810 | A | 9/2000 | Bailey et al. |
| 6,120,036 | A | 9/2000 | Kalsi et al. |
| 6,129,152 | A | 10/2000 | Hosie et al. |
| 6,138,774 | A | 10/2000 | Bourgoyne, Jr. et al. |
| 6,170,576 | B1 | 1/2001 | Bailey |
| 6,202,745 | B1 | 3/2001 | Reimert et al. |
| 6,209,663 | B1 | 4/2001 | Hosie |
| 6,213,228 | B1 | 4/2001 | Saxman |
| 6,227,547 | B1 | 5/2001 | Dietle et al. |
| 6,230,824 | B1 | 5/2001 | Peterman et al. |
| 6,244,359 | B1 | 6/2001 | Bridges et al. |
| 6,263,982 | B1 | 7/2001 | Hannegan et al. |
| 6,273,193 | B1 | 8/2001 | Hermann et al. |
| 6,315,302 | B1 | 11/2001 | Conroy et al. |
| 6,315,813 | B1 | 11/2001 | Morgan et al. |
| 6,325,159 | B1 | 12/2001 | Peterman et al. |
| 6,334,619 | B1 | 1/2002 | Dietle et al. |
| 6,352,129 | B1 | 3/2002 | Best |
| 6,354,385 | B1 | 3/2002 | Ford et al. |
| 6,361,830 | B1 | 3/2002 | Schenk |
| 6,375,895 | B1 | 4/2002 | Daemen |
| 6,382,634 | B1 | 5/2002 | Dietle et al. |
| 6,386,291 | B1 | 5/2002 | Short |
| 6,413,297 | B1 | 7/2002 | Morgan et al. |
| 6,450,262 | B1 | 9/2002 | Regan |
| 6,454,007 | B1 | 9/2002 | Bailey |
| 6,457,529 | B2 | 10/2002 | Calder et al. |
| 6,470,975 | B1 | 10/2002 | Bourgoyne et al. |
| 6,478,303 | B1 | 11/2002 | Radcliffe |
| 6,494,462 | B2 | 12/2002 | Dietle |
| 6,504,982 | B1 | 1/2003 | Greer, IV |
| 6,505,691 | B2 | 1/2003 | Judge et al. |
| 6,520,253 | B2 | 2/2003 | Calder |
| 6,536,520 | B1 | 3/2003 | Snider et al. |
| 6,536,525 | B1 | 3/2003 | Haugen et al. |
| 6,547,002 | B1 | 4/2003 | Bailey et al. |
| 6,554,016 | B2 | 4/2003 | Kinder |
| 6,561,520 | B2 | 5/2003 | Kalsi et al. |
| 6,581,681 | B1 | 6/2003 | Zimmerman et al. |
| 6,607,042 | B2 | 8/2003 | Hoyer et al. |
| RE38,249 | E | 9/2003 | Tasson et al. |
| 6,655,460 | B2 | 12/2003 | Bailey et al. |
| 6,685,194 | B2 | 2/2004 | Dietle et al. |
| 6,702,012 | B2 | 3/2004 | Bailey et al. |
| 6,708,762 | B2 | 3/2004 | Haugen et al. |
| 6,720,764 | B2 | 4/2004 | Relton et al. |
| 6,725,951 | B2 | 4/2004 | Looper |
| 6,732,804 | B2 | 5/2004 | Hosie et al. |
| 6,749,172 | B2 | 6/2004 | Kinder |
| 6,767,016 | B2 | 7/2004 | Gobeli et al. |
| 6,843,313 | B2 | 1/2005 | Hult |
| 6,851,476 | B2 | 2/2005 | Gray et al. |
| 6,877,565 | B2 | 4/2005 | Edvardsen |
| 6,886,631 | B2 | 5/2005 | Wilson et al. |
| 6,896,048 | B2 | 5/2005 | Mason et al. |
| 6,896,076 | B2 | 5/2005 | Nelson et al. |
| 6,904,981 | B2 | 6/2005 | van Riet |
| 6,913,092 | B2 | 7/2005 | Bourgoyne et al. |
| 6,945,330 | B2 | 9/2005 | Wilson et al. |
| 7,004,444 | B2 | 2/2006 | Kinder |
| 7,007,913 | B2 | 3/2006 | Kinder |
| 7,011,167 | B2 | 3/2006 | Ebner et al. |
| 7,025,130 | B2 | 4/2006 | Bailey et al. |
| 7,028,777 | B2 | 4/2006 | Wade et al. |
| 7,032,691 | B2 | 4/2006 | Humphreys |
| 7,040,394 | B2 | 5/2006 | Bailey et al. |
| 7,044,237 | B2 | 5/2006 | Leuchtenberg |
| 7,073,580 | B2 | 7/2006 | Wilson et al. |
| 7,077,212 | B2 | 7/2006 | Roesner et al. |
| 7,080,685 | B2 | 7/2006 | Bailey et al. |
| 7,086,481 | B2 | 8/2006 | Hosie et al. |
| 7,152,680 | B2 | 12/2006 | Wilson et al. |
| 7,159,669 | B2 | 1/2007 | Bourgoyne et al. |
| 7,165,610 | B2 | 1/2007 | Hopper |
| 7,174,956 | B2 | 2/2007 | Williams et al. |
| 7,178,600 | B2 | 2/2007 | Luke et al. |
| 7,191,840 | B2 | 3/2007 | Bailey |
| 7,198,098 | B2 | 4/2007 | Williams |
| 7,204,315 | B2 | 4/2007 | Pia |
| 7,219,729 | B2 | 5/2007 | Bostick et al. |
| 7,237,618 | B2 | 7/2007 | Williams |
| 7,237,623 | B2 | 7/2007 | Hannegan |
| 7,240,727 | B2 | 7/2007 | Williams |
| 7,243,958 | B2 | 7/2007 | Williams |
| 7,255,173 | B2 | 8/2007 | Hosie et al. |
| 7,258,171 | B2 | 8/2007 | Bailey |
| 7,278,494 | B2 | 10/2007 | Williams |
| 7,278,496 | B2 | 10/2007 | Leuchtenberg |
| 7,296,628 | B2 | 11/2007 | Robichaux |
| 7,308,954 | B2 | 12/2007 | Martin-Marshall |
| 7,325,610 | B2 | 2/2008 | Giroux et al. |
| 7,334,633 | B2 | 2/2008 | Williams et al. |
| 7,347,261 | B2 | 3/2008 | Markel et al. |
| 7,350,590 | B2 | 4/2008 | Hosie et al. |
| 7,363,860 | B2 | 4/2008 | Wilson et al. |
| 7,367,411 | B2 | 5/2008 | Leuchtenberg |
| 7,377,334 | B2 | 5/2008 | May |
| 7,380,590 | B2 | 6/2008 | Hughes |
| 7,380,591 | B2 | 6/2008 | Williams |

(56) References Cited

U.S. PATENT DOCUMENTS

| | | | | |
|---|---|---|---|---|
| 7,380,610 | B2 | 6/2008 | Williams | |
| 7,383,876 | B2 | 6/2008 | Gray et al. | |
| 7,389,183 | B2 | 6/2008 | Gray | |
| 7,392,860 | B2 | 7/2008 | Johnston | |
| 7,413,018 | B2 | 8/2008 | Hosie et al. | |
| 7,416,021 | B2 | 8/2008 | Williams | |
| 7,416,226 | B2 | 8/2008 | Williams | |
| 7,448,454 | B2 | 11/2008 | Bourgoyne et al. | |
| 7,451,809 | B2 | 11/2008 | Noske et al. | |
| 7,475,732 | B2 | 1/2009 | Hosie et al. | |
| 7,487,837 | B2 | 2/2009 | Bailey et al. | |
| 7,513,300 | B2 | 4/2009 | Pietras et al. | |
| 7,559,359 | B2 | 7/2009 | Williams | |
| 7,635,034 | B2 | 12/2009 | Williams | |
| 7,650,950 | B2 | 1/2010 | Leuchtenberg | |
| 7,654,325 | B2 | 2/2010 | Giroux et al. | |
| 7,669,649 | B2 | 3/2010 | Williams | |
| 7,699,109 | B2 | 4/2010 | May et al. | |
| 7,708,089 | B2 | 5/2010 | Williams | |
| 7,712,523 | B2 | 5/2010 | Snider et al. | |
| 7,717,169 | B2 | 5/2010 | Williams | |
| 7,717,170 | B2 | 5/2010 | Williams | |
| 7,726,416 | B2 | 6/2010 | Williams | |
| 7,743,823 | B2 | 6/2010 | Hughes et al. | |
| 7,762,320 | B2 | 7/2010 | Williams | |
| 7,766,100 | B2 | 8/2010 | Williams | |
| 7,779,903 | B2 | 8/2010 | Bailey et al. | |
| 7,789,132 | B2 | 9/2010 | Williams | |
| 7,789,172 | B2 | 9/2010 | Williams | |
| 7,793,719 | B2 | 9/2010 | Snider et al. | |
| 7,798,250 | B2 | 9/2010 | Williams | |
| 7,802,635 | B2 | 9/2010 | Leduc et al. | |
| 7,823,665 | B2 | 11/2010 | Sullivan | |
| 7,836,946 | B2 | 11/2010 | Bailey et al. | |
| 7,836,973 | B2 | 11/2010 | Belcher et al. | |
| 7,926,593 | B2 | 4/2011 | Bailey et al. | |
| 2001/0020770 | A1* | 9/2001 | dietle et al. | 277/400 |
| 2003/0089506 | A1 | 5/2003 | Ayler et al. | |
| 2003/0106712 | A1 | 6/2003 | Bourgoyne et al. | |
| 2003/0164276 | A1 | 9/2003 | Snider et al. | |
| 2004/0017190 | A1 | 1/2004 | McDearmon et al. | |
| 2005/0093246 | A1* | 5/2005 | Dietle et al. | 277/549 |
| 2005/0151107 | A1 | 7/2005 | Shu | |
| 2005/0161228 | A1 | 7/2005 | Cook et al. | |
| 2005/0241833 | A1 | 11/2005 | Bailey et al. | |
| 2006/0037782 | A1 | 2/2006 | Martin-Marshall | |
| 2006/0108119 | A1 | 5/2006 | Bailey et al. | |
| 2006/0144622 | A1 | 7/2006 | Bailey et al. | |
| 2006/0157282 | A1 | 7/2006 | Tilton et al. | |
| 2006/0191716 | A1 | 8/2006 | Humphreys | |
| 2007/0051512 | A1 | 3/2007 | Markel et al. | |
| 2007/0095540 | A1 | 5/2007 | Kozicz | |
| 2007/0163784 | A1 | 7/2007 | Bailey | |
| 2008/0169107 | A1 | 7/2008 | Redlinger et al. | |
| 2008/0210471 | A1 | 9/2008 | Bailey et al. | |
| 2008/0236819 | A1 | 10/2008 | Foster et al. | |
| 2008/0245531 | A1 | 10/2008 | Noske et al. | |
| 2009/0025930 | A1 | 1/2009 | Iblings et al. | |
| 2009/0101351 | A1 | 4/2009 | Hannegan et al. | |
| 2009/0101411 | A1 | 4/2009 | Hannegan et al. | |
| 2009/0139724 | A1 | 6/2009 | Gray et al. | |
| 2009/0152006 | A1 | 6/2009 | Leduc et al. | |
| 2009/0166046 | A1 | 7/2009 | Edvardson et al. | |
| 2009/0200747 | A1 | 8/2009 | Williams | |
| 2009/0211239 | A1 | 8/2009 | Askeland | |
| 2009/0236144 | A1 | 9/2009 | Todd et al. | |
| 2009/0301723 | A1 | 12/2009 | Gray | |
| 2010/0008190 | A1 | 1/2010 | Gray et al. | |
| 2010/0025047 | A1 | 2/2010 | Sokol | |
| 2010/0175882 | A1 | 7/2010 | Bailey et al. | |
| 2011/0024195 | A1 | 2/2011 | Hoyer | |
| 2011/0036629 | A1 | 2/2011 | Bailey et al. | |
| 2011/0036638 | A1 | 2/2011 | Sokol | |
| 2013/0168578 | A1 | 7/2013 | Leuchtenberg et al. | |

FOREIGN PATENT DOCUMENTS

| | | | |
|---|---|---|---|
| AU | 200028183 | B2 | 9/2000 |
| CA | 2363132 | A1 | 9/2000 |
| CA | 2447196 | A1 | 4/2004 |
| CA | 2795212 | A1 | 10/2011 |
| CN | 102892971 | A | 1/2013 |
| EP | 0290250 | A2 | 11/1988 |
| EP | 0290250 | A3 | 11/1988 |
| EP | 267140 | B1 | 3/1993 |
| EP | 1375817 | A1 | 1/2004 |
| EP | 1519003 | A1 | 3/2005 |
| EP | 1659260 | A2 | 5/2006 |
| EP | 2558676 | A1 | 2/2013 |
| GB | 1161299 | | 8/1969 |
| GB | 2019921 | A | 11/1979 |
| GB | 2067235 | A | 7/1981 |
| GB | 2394738 | A | 5/2004 |
| GB | 2394741 | A | 5/2004 |
| GB | 2449010 | A | 8/2007 |
| WO | 93/06335 | | 4/1993 |
| WO | WO 99/45228 | A1 | 9/1999 |
| WO | WO 99/50524 | A2 | 10/1999 |
| WO | WO 99/51852 | A1 | 10/1999 |
| WO | WO 99/50524 | A3 | 12/1999 |
| WO | WO 00/52299 | A1 | 9/2000 |
| WO | WO 00/52300 | A1 | 9/2000 |
| WO | WO 01/79654 | A1 | 10/2001 |
| WO | WO 02/36928 | A1 | 5/2002 |
| WO | WO 02/50398 | A1 | 6/2002 |
| WO | WO-03/042485 | A2 | 5/2003 |
| WO | WO 03/071091 | A1 | 8/2003 |
| WO | WO 2006/088379 | A1 | 8/2006 |
| WO | WO 2007/092956 | A2 | 8/2007 |
| WO | WO 2008/133523 | A1 | 11/2008 |
| WO | WO 2008/156376 | A1 | 12/2008 |
| WO | WO 2009/017418 | A1 | 2/2009 |
| WO | WO 2009/123476 | A1 | 10/2009 |
| WO | WO 2011/128690 | A1 | 10/2011 |
| WO | WO 2012/001402 | A2 | 1/2012 |

OTHER PUBLICATIONS

US 6,708,780, 11/2001, Bourgoyne, et al. (withdrawn).

U.S. Appl. No. 60/079,641, Abandoned, but Priority Claimed in above U.S. Pat. Nos. 6,230,824B1 and 6,102,673 and PCT WO 99/50524, Mar. 27, 1998.

U.S. Appl. No. 60/122,530, Abandoned, but Priority Claimed in U.S. Pat. No. 6,470,975B1, Mar. 2, 1999.

U.S. Appl. No. 61/205/209, Abandoned, but priority claimed in US2010/0175882A1, Jan. 15, 2009.

The Modular T BOP Stack System, Cameron Iron Works © 1985 (5 pages).

Cameron HC Collet Connector, © 1996 Cooper Cameron Corporation, Cameron Division (12 pages).

Riserless drilling: circumventing the size/cost cycle in deepwater—Conoco, Hydril project seek enabling technologies to drill in deepest water depths economically, May 1986 Offshore Drilling Technology (pp. 49, 50, 52, 53, 54 and 55).

Williams Tool Company—Home Page—Under Construction Williams Rotating Control Heads (2 pages); Seal-Ability for the pressures of drilling (2 pages); Williams Model 7000 Series Rotating Control Heads (1 page); Williams Model 7000 & 7100 Series Rotating Control Heads (2 pages); Williams Model IP1000 Rotating Control Head (2 pages); Williams Conventional Models 8000 & 9000 (2 pages); Applications Where Using a Williams rotating control head while drilling is a plus (1 page); Williams higher pressure rotating control head systems are Ideally Suited for New Technology Flow Drilling and Closed Loop Underbalanced Drilling (UBD) Vertical and Horizontal (2 pages); and How to Contact US (2 pages).

Offshore—World Trends and Technology for Offshore Oil and Gas Operations, Mar. 1998, Seismic: Article entitled, "Shallow Flow Diverter JIP Spurred by Deepwater Washouts" (3 pages including cover page, table of contents and p. 90).

Williams Tool Co., Inc. Rotating Control Heads and Strippers for Air, Gas, Mud, and Geothermal Drilling Worldwide—Sales Rental Service, © 1988 (19 pages).

(56) References Cited

OTHER PUBLICATIONS

Williams Tool Co., Inc. 19 page brochure © 1991 Williams Tool Co., Inc. (19 pages).
FIG. 19 Floating Piston Drilling Choke Design: May of 1997.
Blowout Preventer Testing for Underbalanced Drilling by Charles R. "Rick" Stone and Larry A. Cress, Signa Engineering Corp., Houston, Texas (24 pages) Sep. 1997.
Williams Tool Co., Inc. Instructions, Assemble & Disassemble Model 9000 Bearing Assembly (cover page and 27 numbered pages).
Williams Tool Co., Inc. Rotating Control Heads Making Drilling Safer While Reducing Costs Since 1968, © 1989 (4 pages).
Williams Tool Company, Inc. International Model 7000 Rotating Control Head, 1991 (4 pages).
Williams Rotating Control Heads, Reduce Costs Increase Safety Reduce Environmental Impact, 4 pages, ( © 1995).
Williams Rotating Control Heads, Reduce Costs Increase Safety Reduce Environmental Impact (4 pages).
Williams Tool Co., Inc. Sales-Rental-Service, Williams Rotating Control Heads and Strippers for Air, Gas, Mud, and Geothermal Drilling, © 1982 (7 pages).
Williams Tool Co., Inc., Rotating Control Heads and Strippers for Air, Gas, Mud, Geothermal and Pressure Drilling, © 1991 (19 pages).
An article—The Brief January '96, The Brief's Guest Columnists, Williams Tool Co., Inc., Communicating Dec. 13, 1995 (Fort Smith, Arkansas), The When? and Why? of Rotating Control Head Usage, Copyright © Murphy Publishing, Inc. 1996 (2 pages).
A reprint from the Oct. 9, 1995 edition of Oil & Gas Journal, "Rotating control head applications increasing," by Adam T. Bourgoyne, Jr., Copyright 1995 by PennWell Publishing Company (6 pages).
1966-1967 Composite Catalog-Grant Rotating Drilling Head for Air, Gas or Mud Drilling (1 page).
1976-1977 Composite Catalog Grant Oil Tool Company Rotating Drilling Head Models 7068, 7368, 8068 (Patented), Equally Effective with Air, Gas, or Mud Circulation Media (3 pages).
A Subsea Rotating Control Head for Riserless Drilling Applications; Daryl A. Bourgoyne, Adam T. Bourgoyne, and Don Hannegan—1998 (International Association of Drilling Contractors International Deep Water Well Control Conference held in Houston, Texas, Aug. 26-27, 1998) (14 pages).
Hannegan, "Applications Widening for Rotating Control Heads," Drilling Contractor, cover page, table of contents and pp. 17 and 19, Drilling Contractor Publications Inc., Houston, Texas, Jul. 1996.
Composite Catalog, Hughes Offshore 1986-87 Subsea Systems and Equipment, Hughes Drilling Equipment Composite Catalog (pp. 2986-3004).
Williams Tool Co., Inc. Technical Specifications Model for The Model 7100, (3 pages).
Williams Tool Co., Inc. Website, Underbalanced Drilling (UBD), The Attraction of UBD (2 pages).
Williams Tool Co., Inc. Website,. "Applications, Where Using a Williams Rotating Control Head While Drilling is a Plus" (2 pages).
Williams Tool Co., Inc. Website, "Model 7100," (3 pages).
Composite Catalog, Hughes Offshore 1982/1983, Regan Products, © Copyright 1982 (Two cover sheets and 4308-27 thru 4308-43, and end sheet). See p. 4308-36 Type KFD Diverter.
Coflexip Coflexip Brochure; 1-Coflexip Sales Offices, 2-the Flexible Steel Pipe for Drilling and Service Applications, 3-New 5" I.D. General Drilling Flexible, 4-Applications, and 5-Illustration (5 unnumbered pages).
Baker, Ron, "A Primer of Oilwell Drilling," Fourth Edition, Published Petroleum Extension Service, The University of Texas at Austin, Austin, Texas, in cooperation with International Association of Drilling Contractors Houston, Texas © 1979 (3 cover pages and pp. 42-49 re Circulation System).
Brochure, Lock down Lubricator System, Dutch Enterprises, Inc., "Safety with Savings" (cover sheet and 16 unnumbered pages); see above US Patent No. 4,836,289 referred to therein.
Hydril GL series Annual Blowout Preventers (Patented—see Roche patents above), (cover sheet and 2 pages).
Other Hydril Product Information (The GH Gas Handler Series Product is Listed), © 1996, Hydril Company (Cover sheet and 19 pages).
Brochure, Shaffer Type 79 Rotating Blowout Preventer, NL Rig Equipment/NL Industries, Inc., (6 unnumbered pages).
Shaffer, A Varco Company, (Cover page and pp. 1562-1568).
Avoiding Explosive Unloading of Gas in a Deep Water Riser When SOBM in Use; Colin P. Leach & Joseph R. Roche—1998 (The Paper Describes an Application for the Hydril Gas Handler, The Hydril GH 211-2000 Gas Handler is Depicted in Figure 1 of the Paper) (9 unnumbered pages).
Feasibility Study of Dual Density Mud System for Deepwater Drilling Operations; Clovis A. Lopes & A.T. Bourgoyne, Jr.—1997 (Offshore Technology Conference Paper No. 8465); (pp. 257-266).
Apr. 1998 Offshore Drilling with Light Weight Fluids Joint Industry Project Presentation (9 unnumbered pages).
Nakagawa, Edson Y., Santos, Helio and Cunha, J.C., "Application of Aerated-Fluid Drilling in Deepwater," SPE/IACDC 52787 Presented by Don Hannegan, P.E., SPE © 1999 SPE/IADC Drilling Conference, Amsterdam, Holland, Mar. 9-11, 1999 (5 unnumbered pages).
Brochure: "Inter-Tech Drilling Solutions, Ltd.'s RBOP™ Means Safety and Experience for Underbalanced Drilling," Inter-Tech Drilling Solutions Ltd./Big D Rentals & Sales (1981) Ltd. and Color Copy of "Rotating Bop" (2 unnumbered pages).
"Pressure Control While Drilling," Shaffer® A Varco Company, Rev. A (2 unnumbered pages).
Field Exposure (As of Aug. 1998), Shaffer® A Varco Company (1 unnumbered page).
Graphic: "Rotating Spherical BOP" (1 unnumbered page).
"JIP's Worl Brightens Outlook for UBD in Deep Waters" by Edson Yoshihito Nakagawa, Helio Santos and Jose Carlos Cunha, American Oil & Gas Reporter, Apr. 1999, pp. 53, 56, 58-60 and 63.
"Seal-Tech 1500 PSI Rotating Blowout Preventer," Undated, 3 pages.
"RPM System 3000® Rotating Blowout Preventer, Setting a new standard in Well Control," by Techcorp Industries, Undated, 4 pages.
"RiserCap™ Materials Presented at the 1999 LSU/MMS/IADC Well Control Workshop", by Williams Tool Company, Inc., Mar. 24-25, pp. 1-14.
"The 1999 LSU/MMS Well Control Workshop: An overview," by John Rogers Smith. World Oil, Jun. 1999. Cover page and pp. 4, 41-42, and 44-45.
Dag Oluf Nessa, "Offshore underbalanced drilling system could revive field developments," World Oil, vol. 218, No. 10, Oct. 1997, 1 unnumbered page and pp. 83-84, 86, and 88.
D.O. Nessa, "Offshore underbalanced drilling system could revive field developments," World Oil Exploration Drilling Production, vol. 218, No. 7, Color pages of Cover Page and pp. 3, 61-64, and 66, Jul. 1997.
PCT Search Report, International Application No. PCT/US99/06695, 4 pages (Date of Completion May 27, 1999).
PCT Search Report, International Application No. PCT/GB00/00731, 3 pages (Date of Completion Jun. 16, 2000).
National Academy of Sciences—National Research Council, "Design of a Deep Ocean Drilling Ship," Cover Page and pp. 114-121. Undated but cited in above US Patent No. 6,230,824B1.
"History and Development of a Rotating Preventer," by A. Cress, Rick Stone, and Mike Tangedahl, IADC/SPE 23931, 1992 IADC/SPE Drilling Conference, Feb. 1992, pp. 757-773.
Helio Santos, Email message to Don Hannegan, et al., 1 page (Aug. 20, 2001).
Rehm, Bill, "Practical Underbalanced Drilling and Workover," Petroleum Extension Service, The University of Texas At Austin Continuing & Extended Education, Cover page, title page, copyright page, and pp. 6-6, 11-2, 11-3, G-9, and G-10 (2002).
Williams Tool Company Inc., "RISERCAP™: Rotating Control Head System for Floating Drilling Rig Applications," 4 unnumbered pages, (© 1999 Williams Tool Company, Inc.).
Antonio C.V.M. Lage, Helio, Santos and Paulo R.C. Silva, Drilling With Aerated Drilling Fluid From a Floating Unit Part 2: Drilling the Well, SPE 71361, 11 pages (© 2001, Society of Petroleum Engineers, Inc.).

(56) References Cited

OTHER PUBLICATIONS

Helio Santos, Fabio Rosa, and Christian Leuchtenberg, Drilling and Aerated Fluid from a Floating Unit, Part 1: Planning, Equipment, Tests, and Rig Modifications, SPE/IADC 67748, 8 pages (© SPE/IADC Drilling Conference).
E.Y. Nakagawa, H. Santos, J.C. Cunha and S. Shayegi, Planning of Deepwater Drilling Operations with Aerated Fluids, SPE 54283, 7 pages, (© 1999, Society of Petroleum Engineers).
E.Y. Nakagawa, H.M.R. Santos and J.C. Cunha, Implementing the Light-Weight Fluids Drilling Technology in Deepwater Scenarios, 1999 LSU/MMS Well Control Workshop Mar. 24-25, 1999, 12 pages (1999).
Press Release, "Stewart & Stevenson Introduces First Dual Gradient Riser," Stewart & Stevenson, http:/www.ssss/com/ssss/20000831.asp, 2 pages (Aug. 31, 2000).
Press Release: "Stewart & Stevenson introduces First Dual Gradient Riser," Stewart & Stevenson, http:www/ssss/com/ssss/20000831.asp, 2 pages (Aug. 31, 2000).
Williams Tool Company Inc., "Williams Tool Company Introduces the . . . Virtual Riser™," 4 unnumbered pages, (© 1998 Williams Tool Company, Inc.).
"PETEX Publications," Petroleum Extension Service, University of Texas at Austin, 12 pages, (last modified Dec. 6, 2002).
"BG in the Caspian region," SPE Review, Issue 164, 3 unnumbered pages (May 2003).
"Field Cases as of Mar. 3, 2003," Impact Fluid Solutions, 6 pages (Mar. 3, 2003).
"Determine in the Safe Application of Underbalanced Drilling Technologies in Marine Environments—Technical Proposal," Maurer Technology, Inc., Cover Page and pp. 2-13 (Jun. 17, 2002).
Colbert, John W., "John W. Colbert, P.E. Vice President Engineering Biographical Data," Signa Engineering Corp., 2 unnumbered pages (undated).
"Technical Training Courses," Parker Drilling Co., http:/www.parkerdrilling.com/news/tech.html, 5, , pages (last visited, Sep. 5, 2003).
"Drilling equipment: Improvements from data recording to slim hole," Drilling Contractor, pp. 30-32, (Mar./Apr. 2000).
"Drilling conference promises to be informative," Drilling Contractor, p. 10 (Jan./Feb. 2002).
"Underbalanced and Air Drilling," OGCI, Inc., http:/www.ogci.com/course_info.asp?counselID=410, 2 pages, (2003).
"2003 SPE Calendar," Society of Petroleum Engineers, Google cache of http:/www.spe.org/spe/cda/views/events/eventMaster/0,1470,1648_2194_632303.00.html; for "mud cap drilling", 2 pages (2001).
"Oilfield Glossary: reverse-circulating valve," Schlumberger Limited, 1 page (2003).
Murphy, Ross D. and Thompson, Paul B., "A drilling contractor's view of underbalanced drilling," World Oil Magazine, vol. 223, No. 5, 9 pages (May 2002).
"Weatherford UnderBalanced Services: General Underbalance Presentation to the DTI," 71 unnumbered pages, © 2002.
Rach, Nina M., "Underbalanced near-balanced drilling are possible offshore," Oil & Gas Journal, Color Copies, pp. 39-44, (Dec. 1, 2003).
Forrest, Neil et al., Subsea Equipment for Deep Water Drilling Using Dual Gradient Mud System, SPE/IADC Drilling Conference held in Amsterdam, The Netherlands, Feb. 27, 2001 to Mar. 1, 2001, Paper SPE/IADC 67707, © 2001 SPE/IADC Drilling Conference (8 pages); particularly see pg. 3, col. 1, ¶ 4 and col. 2, ¶ 5 and FIGS. 4-6; cited in 7V below where indicated as "technical background".
Hannegan, D.M.; Bourgoyne, Jr., A.T.: "Deepwater Drilling with Lightweight Fluids—Essential Equipment Required," SPE/IADC 67708, pp. 1-6 ( © 2001, SPE/IADC Drilling Conference).
Hannegan, Don M., "Underbalanced Operations Continue Offshore Movement," SPE 68491, pp. 1-3, (© 2001, Society of Petroleum Engineers, Inc).
Hannegan, D. and Divine, R., "Underbalanced Drilling—Perceptions and Realities of Today's Technology in Offshore Applications," IADC/SPE 74448, p. 1-9, (© 2002, IADC/SPE Drilling Conference).
Hannegan, Don M. and Wanzer, Glen: "Well Control Considerations—Offshore Applications of Underbalanced Drilling Technology," SPE/IADC 79854, pp. 1-14, (© 2003, SPE/IADC Drilling Conference).
Bybee, Karen, "Offshore Applications of Underbalanced—Drilling Technology," Journal of Petroleum Technology, Cover Page and pp. 51-52, (Jan. 2004).
Bourgoyne, Darryl A.; Bourgoyne, Adam T.; Hannegan, Don; "A Subsea Rotating Control Head for Riserless Drilling Applications," IADC International Deep Water Well Control Conference, pp. 1-14, (Aug. 26-27, 1998) (see document T).
Lage, Antonio C.V.M.; Santos, Helio; Silva, Paulo R.C.; "Drilling With Aerated Drilling Fluid From a Floating Unit Part 2: Drilling the Well," Society of Petroleum Engineers, SPE 71361, pp. 1-11 Sep. 30-Oct. 3, 2001)(see document BBB).
Furlow, William; "Shell's seafloor pump, solids removal key to ultra-deep, dual-gradient drilling (Skid ready for commercialization), " Offshore World Trends and Technology for Offshore Oil and Gas Operations, Cover page, table of contents, pp. 54, 2 unnumbered pages, and 106 (Jun. 2001).
Rowden, Michael V.: "Advances in riserless drilling pushing the deepwater surface string envelope (Alternative to seawater, CaCl2 sweeps); " Offshore World Trends and Technology for Offshore Oil and Gas Operations, Cover page, table of contents, pp. 56, 58, and 106 (Jun. 2001).
Boye, John: "Multi Purpose Intervention Vessel Presentation," M.O.S.T. Multi Operational Service Tankers, Weatherford International, Jan. 2004, 43 pages (© 2003).
GB Search Report, International Application No. GB 0324939.8, 1 page (Jan. 21, 2004).
MicroPatent® list of patents citing U.S. Pat. No. 3,476,195, printed on Jan. 24, 2003.
PCT Search Report, International Application No. PCT/EP2004/052167, 4 pages (Date of Completion Nov. 25, 2004).
PCT Written Opinion of the International Searching Authority, International Application No. PCT/EP2004/052167, 6 pages.
Supplementary European Search Report No. EP 99908371, 3 pages (Date of Completion Oct. 22, 2004).
*General Catalog*, 1970-1971, Vetco Offshore, Inc., Subsea Systems; cover page, company page and numbered pp. 4800, 4816-4818; 6 pages total, in particular see numbered p. 4816 for "patented" Vetco H-4 connectors.
*General Catalog*, 1972-73, Vetco Offshore, Inc., Subsea Systems; cover page; company page and numbered pp. 4498, 4509-4510; 5 pages total.
*General Catalog*, 1974-75, Vetco Offshore, Inc.; cover page, company page and numbered pp. 5160, 5178-5179; 5 pages total.
*General Catalog*, 1976-1977, Vetco Offshore, Inc., Subsea Drilling and Completion Systems; cover page and numbered pp. 5862-5863; 4 pages total.
*General Catalog*, 1982-1983, Vetco; cover page and numbered pp. 8454-8455, 8479; 4 pages total.
*Shaffer, A Varco Company: Pressure Control While Drilling System*, http:/www.tulsaeguipm.com; printed Jun. 21, 2004; 2 pages.
*Performance Drilling by Precision Drilling. A Smart Equation*, Precision Drilling, © 2002 Precision Drilling Corporation; 12 pages, in particular see 9th page For "Northland's patented RBOP . . . ".
*RPM System, 3000™ Rotating Blowout Preventer: Setting a New Standard in Well Control*, Weatherford, Underbalanced Systems: © 2002-2005 Weatherford; Brochure #333.01, 4 pages.
*Managed Pressure Drilling in Marine Environments*, Don Hannegan, P.E.; Drilling Engineering Association Workshop, Moody Gardens, Galveston, Jun. 22-23, 2004; © 2004 Weatherford, 28 pages.
Hold™ 2500 RCD Rotating Control Device web page and brochure, http://www.smith.com/hold2500; printed Oct. 27, 2004, 5 pages.
Rehm, Bill, "Practical Underbalanced Drilling and Workover," Petroleum Extension Service, The University of Texas at Austin Continuing & Extended Education, cover page, title page, copyright page and pp. 6-1 to 6-9, 7-1 to 7-9 (2002).

(56) References Cited

OTHER PUBLICATIONS

"Pressured Mud Cap Drilling from A Semi-Submersible Drilling Rig," J.H. Terwogt, SPE, L.B. Makiaho and N. van Beelen, SPE, Shell Malaysia Exploration and Production; B.J. Gedge, SPE, and J. Jenkins, Weatherford Drilling and Well Services (6 pages total); © 2005 (This paper was prepared for presentation at the SPE/IADC Drilling Conference held in Amsterdam, The Netherlands, Feb. 23-25, 2005).
Tangedahl, M.J., et al., "Rotating Preventers: Technology for Better Well Control," World Oil, Gulf Publishing Company, Houston, TX, US, vol. 213, No. 10, Oct. 1992, numbered pp. 63-64 and 66 (3 pages).
European Search Report for EP 05 27 0083, Application No. 05270083.Aug. 2315, European Patent Office, Mar. 2, 2006, corresponding to U.S. Appl. No. 10/995,980, published as US2006/0108119 A1 (now U.S. Pat. No. 7,487,837 B2)(5 pages).
Netherlands Search Report for NL No. 1026044, dated Dec. 14, 2005 (3 pages).
Int'l. Search Report for PCT/GB 00/00731 corresponding to U.S. Pat. No. 6,470,975 (Jun. 16, 2000) (2 pages).
GB0324939.8 Examination Report corresponding to U.S. Pat. No. 6,470,975 (Mar. 21, 2006) (6 pages).
GB0324939.8 Examination Report corresponding to U.S. Pat. No. 6,470,975 Jan. 22, 2004) (3 pages).
2003/0106712 Family Lookup Report (Jun. 15, 2006) (5 pages).
U.S. Pat. No. 6,470,975 Family LookupReport (Jun. 15, 2006) (5 pages).
AU S/N 28183/00 Examination Report corresponding to U.S. Pat. No. 6,470,975 (1 page) (Sep. 9, 2002).
NO S/N 20013953 Examination Report corresponding to U.S. Pat. No. 6,470,975 w/one page of English translation (3 pages) (Apr. 29, 2003).
Nessa, D.O. & Tangedahl, M.L. & Saponia, J: Part 1: "Offshore underbalanced drilling system could revive field developments," World Oil, vol. 218, No. 7, Cover Page, 3, 61-64 and 66 (Jul. 1997); and Part 2: "Making this valuable reservoir drilling/completion technique work on a conventional offshore drilling platform." World Oil, vol. 218 No. 10, Cover Page, 3, 83, 84, 86 and 88 (Oct. 1997).
Int'l. Search Report for PCT/GB 00/00731 corresponding to U.S. Pat. No. 6, 470,975 (4 pages) (Jun. 27, 2000).
Int'l. Preliminary Examination Report for PCT/GB 00/00731 corresponding to U.S. Pat. No. 6,470,975 (7 pages) (Dec. 14, 2000).
NL Examination Report for WO 00/52299 corresponding to this U.S. Appl. No. 10/281,534 (3 pages) (Dec. 19, 2003).
AU S/N 28181/00 Examination Report corresponding to U.S. Pat. No. 6,263,982 (1 page) (Sep. 6, 2002).
EU Examination Report for WO 00/906522.8-2315 corresponding to U.S. Pat. No. 6,263,982 (4 pages) (Nov. 29, 2004).
NO S/N 20013952 Examination Report w/two pages of English translation corresponding to U.S. Pat. No. 6,263,982 (4 pages) (Jul. 2, 2005).
PCT/GB00/00726 Int'l. Preliminary Examination Report corresponding to U.S. Pat. No. 6,263,982 (10 pages) (Jun. 26, 2001).
PCT/GB00/00726 Written Opinion corresponding to U.S. Pat. No. 6,263,982 (7 pages) (Dec. 18, 2000).
PCT/GB00/00726 International Search Report corresponding to U.S. Pat. No. 6,263,982 (3 pages (Mar. 2, 1999).
AU S/N 27822/99 Examination Report corresponding to U.S. Pat. No. 6,138,774 (1 page) (Oct. 15, 2001).
Eu 99908371.0/1266-US99/03888 European Search Report corresponding to U.S. Pat. No. 6,138,774 (3 pages) (Nov. 2, 2004).
NO S/N 20003950 Examination Report w/one page of English translation corresponding to U.S. Pat. No. 6,138,774 (3 pages) (Nov. 1, 2004).
PCT/US990/03888 Notice of Transmittal of International Search Report corresponding to U.S. Pat. No. 6,138,774 (6 pages) (Aug. 4, 1999).
PCT/US99/03888 Written Opinion corresponding to U.S. Pat. No. 6,138,744 (5 pages) (Dec. 21, 1999).
PCT/US99/03888 Notice of Transmittal of International Preliminary Examination Report corresponding to U.S. Pat. No. 6,138,774 (15 pages) (Jun. 12, 2000).
EU Examination Report for 05270083.8-2315 corresponding to U.S. Appl. No. 10/995,980, published as US 2006/0108119 A1 (now U.S. Pat. No. 7,487,837 B2) (11 pages) (May 10, 2006).
Tangedahl, M.J., et al. "Rotating Preventers: Technology for Better Well Control," World Oil, Gulf Publishing Company, Houston, TX, US, vol. 213, No. 10, (Oct. 1, 1992) numbered pp. 63-64 and 66 (3 pages) XP 000288328 ISSN: 0043-8790.
UK Search Report for Application No. GB 0325423.2, searched Jan. 30, 2004 corresponding to above US Patent No. 7,040,394 (one page).
UK Examination Report for Application No. GB 0325423.2 (4 pages).
Dietle, Lannie L., et al., Kalsi Seals Handbook, Document. 2137 Revision 1, © 1992-2005 Kalsi Engineering, Inc. of Sugar Land, Texas USA; front and back covers and 164 total pages; in particular forward p. ii for "Patent Rights"; Appendix A-6 for Kalsi seal part No. 381-6- and A-10 for Kalsi seal part No. 432-32-. as discussed in U.S. Appl. No. 11/366,078 application (now U.S. Pat. No. 7,836,946 B2) at number paragraph 70 and 71.
FIG. 10 and discussion in U.S. Appl. No. 11/366,078 application, published as US2006/0144622 A1 (now U.S. Pat. No. 7,836,946 B2) of Background of Invention.
Partial European search report R.46 EPC dated Jun. 27, 2007 for European Patent Application EP07103416.9-2315 corresponding to U.S. Appl. No. 11/366,078, published as US 2006/0144622 A1, now U.S. Pat. No. 7,836,946 (5 pages).
Extended European search report R.44 EPC dated Oct. 9, 2007 for European Patent Application 07103416.9-2315 corresponding to U.S. Appl. No. 11/366,078, published as US-2006/0144622 A1, now U.S. Pat. No. 7,836,946 (8 pages).
U.S. Appl. No. 60/079,641, Mudlift System for Deep Water Drilling, filed Mar. 27, 1998, abandoned, but priority claimed in above U.S. Pat. No. 6,230,824 B1 and 6,102,673 and PCT WO-99/50524 (54 pages).
U.S. Appl. No. 60/122,530, Concepts for the Application of Rotating Control Head Technology to Deepwater Drilling Operations, filed Mar. 2, 1999, abandoned, but priority claimed in above U.S. Pat. No. 6,470,975 B1 (54 pages).
PCT/GB2008/050239 (corresponding to US2008/0210471 Al; now issued as U.S. Pat. No. 7,926,593) Annex to Form PCT/ISA/206 Communication Relating to the Results of the Partial International Search dated Aug. 26, 2008, (4 pages).
PCT/GB2008/050239 (corresponding to US2008/0210471 A1; now issued as U.S. Pat. No. 7,926,593) International Search Report and Written Opinion of the International Searching Authority (19 pages).
Vetco Gray Product Information CDE-PI-0007 dated Mar. 1999 for 59.0" Standard Bore CSO Diverter (2 pages) © 1999 By Vetco Gray Inc.
Vetco Gray Capital Drilling Equipment KFDJ and KFDJ Model "J" Diverters (1 page) (no date).
Hydril Blowout Preventers Catalog M-9402 D (44 pages) © 2004 Hydrill Company LP; see annular and ram BOP seals on p. 41.
Hydril Compact GK® 7 1/16-3000 & 5000 psi Annular Blowout Preventers, Catalog 9503B © 1999 Hydril Company (4 pages).
Weatherford Controlled Pressure Drilling *Williams*® Rotating Marine Diverter Insert (2 pages).
Weatherford Controlled Pressure Drilling Model 7800 Rotating Control Device © 2007 Weatherford(5 pages).
Weatherford Controlled Pressure Drilling® and Testing Services *Williams*® Model 8000/9000 Conventional Heads © 2002-2006 Weatherford(2 pages).
Weatherford "Real Results Rotating Control Device Resolves Mud Return Issues in Extended-Reach Well, Saves Equipment Costs and Rig Time" © 2007 Weatherford and "Rotating Control Device Ensures Safety of Crew Drilling Surface-Hole Section" © 2008 Weatherford (2 pages).
Washington Rotating Control Heads, Inc. Series 1400 Rotating Control Heads ("Shorty") printed Nov. 21, 2008 (2 pages).
Smith Services product details for Rotating Control Device—RDH 500® printed Nov. 24, 2008 (4 pages).

(56) References Cited

OTHER PUBLICATIONS

American Petroleum Institute Specification for Drill Through Equipment—Rotating Control Devices, API Specification 16RCD, First Edition, Feb. 2005 (84 pages).
Weatherford Drilling & Intervention Services Underbalanced Systems RPM System 3000™ Rotating Blowout Preventer, Setting a New Standard in Well Control, An Advanced Well Control System for Underbalanced Drilling Operations, Brochure #333.00, © 2002 Weatherford (4 pages).
Medley, George; Moore, Dennis; Nauduri, Sagar; Signa Engineering Corp.; SPE/IADC Managed Pressure Drilling & Underbalanced Operations (PowerPoint presentation; 22 pages).
Secure Drilling Well Controlled, Secure Drilling™ System using Micro-Flux Control Technology, © 2007 Secure Drilling (12 pages).
The LSU Petroleum Engineering Research & Technology Transfer Laboratory, 10-rate Step Pump Shut-down and Start-up Example Procedure for Constant Bottom Hole Pressure Manage Pressure Drilling Applications (8 pages).
United States Department of the Interior Minerals Management Service Gulf of Mexico OCS Region NTL No. 2008-G07; Notice to Lessees and Operators of Federal Oil, Gas, and Sulphur Leases in the Outer Continental Shelf, Gulf of Mexico OCS Region, Managed Pressure Drilling Projects; Issue Date: May 15, 2008; Effective Date: Jun. 15, 2008; Expiration Date: Jun. 15, 2013 (9 pages).
Gray, Kenneth; Dynamic Density Control Quantifies Well Bore Conditions in Real Time During Drilling; American Oil & Gas Reporter, Jan. 2009 (4 pages).
Kotow, Kenneth J.; Pritchard, David M.; Riserless Drilling with Casing: A New Paradigm for Deepwater Well Design, OTC-19914-PP, © 2009 Offshore Technology Conference, Houston, TX May 4-7, 2009 (13 pages).
Hannegan, Don M.; Managed Pressure Drilling—A New Way of Looking at Drilling Hydraulics—Overcoming Conventional Drilling Challenges; SPE 2006-2007 Distinguished Lecturer Series presentation (29 pages); see all but particularly see FIGS. 14-20.
Turck Works Industrial Automation; Factor 1 Sensing for Metal Detection, cover page, first page and numbered pp. 1.157 to 1.170 (16 pages) (printed in Jan. 2009).
Balluff Sensors Worldwide; Object Detection Catalog Aug. 2009—Industrial Proximity Sensors for Non-Contact Detection of Metallic Targets at Ranges Generally under 50mm (2 inches); Linear Position and Measurement; Linear Position Transducers; Inductive Distance Sensors; Photoelectric Distance Sensors; Magneto-Inductive Linear Position Sensors; Magnetic Linear/Rotary Encoder System; printed Dec. 23, 2008 (8 pages).
Inductive Sensors AC 2-Wire Tubular Sensors, Balluff product catalog pp. 1.109-1.120 (12 pages) (no date).
Inductive Sensors DC 2-Wire Tubular Sensors, Balluff product catalog pp. 1.125-1.136 (12 pages) (no date).
Inductive Sensors Analog Inductive Sensors, Balluff product catalog pp. 1.157-1.170 (14 pages) (no date).
Inductive Sensors Dc 3-/4-Wire Inductive Sensors, Balluff product catalog pp. 1.72-1.92 (21 pages).
Selecting Position Transducers: How to Choose Among Displacement Sensor Technologies; How to Choose Among Draw Wire, LVDT, RVDT, Potentiometer, Optical Encoder, Ultrasonic, Magnetostrictive, and Other Technologies; © 1996-2010, Space Age Control, Inc., printed Jan. 11, 2009 (7 pages) (www..spaceagecontrol.com/selpt.htm).
Liquid Flowmeters, Omega.com website; printed Jan. 26, 2009 (13 pages).
Super Autochoke—Automatic Pressure Regulation Under All Conditions © 2009 M-I, LLC; MI Swaco website; printed Apr. 2, 2009 (1 page).
Extended European Search Report R.61 EPC dated Sep. 16, 2010 for European Patent Application 08166660.4-1266/2050924 corresponding to U.S. Appl. No. 11/975,554, now US 2009/0101351 A1 (7 pages).
Office Action from the Canadian Intellectual Property Office dated Nov. 13, 2008 for Canadian Application No. 2,580,177 corresponding to U.S. Appl. No. 11/366,078, published as US-2006/0144622 A1, now U.S. Pat. No. 7,836,946 B2 (3 pages).
Response to European Patent Application No. 08719084.9 (corresponding to the application US2008/0210471 A1, now issued as U.S. Pat. No. 7,926,593) dated Nov. 16, 2010 (4 pages).
Office Action from the Canadian Intellectual Property Office dated Apr. 15, 2008 for Application No. 2,527,395 corresponding to U.S. Appl. No. 10/995,980, published as US-2006/0108119 A1, now U.S. Pat. No. 7,487,837 B2 (3 pages).
Office Action from the Canadian Intellectual Property Office dated Apr. 9, 2009 for Canadian Application No. 2,527,395 corresponding to U.S. Appl. No. 10/995,980, published as US-2006/0108119 A1, now U.S. Pat. No. 7,487,837 B2 (2 pages).
Office Action from the Canadian Intellectual Property Office dated Dec. 15, 2009 for Canadian Application No. 2,681,868 corresponding to U.S. Appl. No. 10/995,980, published as US-2006/0108119 A1, now U.S. Pat. No. 7,487,837 B2 (2 pages).
Examiner's First Report on Australian Patent Application No. 2005234651 from the Australian Patent Office dated Jul. 22, 2010 corresponding to U.S. Appl. No. 10/995,980, published as US-2006/0108119 A1, now U.S. Pat. No. 7,487,837 B2 (2 pages).
Office Action from the Canadian Intellectual Property Office dated Sep. 9, 2010 for Canadian Application No. 2,707,738 corresponding to U.S. Appl. No. 10/995,980, published as US-2006/0108119 A1, now U.S. Pat. No. 7,487,837 B2 (2 pages).
Web page of Ace Wire Spring & Form Company, Inc. printed Dec. 8, 2009 for "Garter Springs—Helical Extension & Compression" www..acewirespringi.com/garter-springs.html (1 page).
Extended European Search Report (R 61 EPC) dated Mar. 4, 2011 for European Application No. 08166658.8-1266/2053197 corresponding to U.S. Appl. No. 11/975,946, published as US 2009-0101411 A1 (13 pages).
Canadian Intellectual Property Office Action dated Dec. 7, 2010, Application No. 2,641,238 entitled "Fluid Drilling Equipment" for Canadian Application corresponding to U.S. Appl. No. 11/974,946, published as US 2009-0101411 A1 4 pages).
Grosso, J.A., "An Analysis of Well Kicks on Offshore Floating Drilling Vessels," SPE 4134, Oct. 1972, pp. 1-20, © 1972 Society of Petroleum Engineers (20 pages).
Bourgoyne, Jr., Adam T., et al., "Applied Drilling Engineering,"pp. 168-171, © 1991 Society of Petroleum Engineers (6 pages).
Wagner, R.R., et al., "Surge Field Tests Highlight Dynamic Fluid Response," SPE/IADC 25771, Feb. 1993, pp. 883-892, © 1993 SPE/IADC Drilling Conference (10 pages).
Solvang, S.A., et al., "Managed Pressure Drilling Resolves Pressure Depletion Related Problems in the Development of the HPHT Kristin Field," SPE/IADC 113672, Jan. 2008, pp. 1-9, © 2008 IADC/SPE Managed Pressure Drilling and Underbalanced Operations Conference and Exhibition (9 pages).
Rasmussen, Ovle Sunde, et al., "Evaluation of MPD Methods for Compensation of Surge-and-Swab Pressures in Floating Drilling Operations," IADC/SPE 108346, Mar. 2007, pp. 1-11, © 2007 IADC/SPE Managed Pressure Drilling and Underbalanced Operations Conference and Exhibition (11 pages).
Shaffer Drill String Compensator available from National Oilwell Varco of Houston, Texas, printed Mar. 23, 2010 from http://www.nov.com/ProductDisplay.aspx?ID=4954&taxID=121 &terms=drill+string+compensators (1 page).
Shaffer Crown Mounted Compensator available from National Oilwell Varco of Houston, Texas, printed Mar. 23, 2010 from http://www.nov.com/ProductDisplay.aspx?ID=4949&taxID=121 &terms=active+drill+string +compensator (3 pages).
Active heave compensator available from National Oilwell Varco of Houston, Texas, printed Mar. 23, 2010 from http://www.nov.com/ProductDisplay.aspx?ID=3677&taxID=740 &terms=active+heave+compensator (3 pages).
Durst, Doug, et al., "Subsea Downhole Motion Compensator (SDMC): Field History, Enhancements, and the Next Generation," IADC/SPE 59152, Feb. 2000, pp. 1-12, © 2000 Society of Petroleum Engineers, Inc. (12 pages).
Sensoy, Taner, et al., Weatherford Secure Drilling Well Controlled Report "Surge and Swab effects d ue to the Heave motion of floating rigs", Nov. 10, 2009 (7 pages).

(56) References Cited

OTHER PUBLICATIONS

Hargreaves, David, et al., "Early Kick Detection for Deepwater Drilling: New Probabilistic Methods Applied in the Field", SPE 71369 © 2001, Society of Petroleum Engineers, Inc. (11 pages).
HH Heavy-Duty Hydraulic Cylinders catalog, The Sheffer Corporation, printed Mar. 5, 2010 from http://www.sheffercorp.com/layout_contact.shtm (27 pages).
Unocal Baroness Surface Stack Upgrade Modifications (5 pages).
Thomson, William T., Professor of Engineering, University of California, "Vibration Theory and Appliacations", © 1848, 1953, 1965 by Prentice-Hall, Inc. title page, copyright page, contents page and numbered pp. 3-9 (10 pages).
Active Heave Compensator, Ocean Drilling Program, www.oceandrilling.org (3 pages).
3.3 Floating Offshore Drilling Rigs (Floaters); 3.3.1. Technologies Required by Floaters; 3.3.2. Drillships; 3.3.3. Semisubmersible Drilling Rig; 4.3.4. Subsea Control System; 4.4. Prospect of Offshore Production System (5 pages).
Weatherford® Real Results First Rig Systems Solutions for Thailand Provides Safer, More Efficient Operations with Stabmaster® and Automated Side Doors, © 2009 Weatherford document No. 6909.00 discussing Weatherford's Integrated Safety Interlock System (ISIS) (1 page).
U.S. Appl. No. 61/205,209, filed Jan. 15, 2009; Abandoned, but priority claimed in US2010/0175882A1 (24 pages).
Smalley® Steel Ring Company, Spirolox®; pages from website http://www.spirolox.com/what_happened.php printed Apr. 27, 2010 (5 pages).
SKF Industrial Seals Product Overview published Mar. 2008; © SKF Group; in particular, see numbered p. 49 (Wiper Seals) (60 pages).
Parker Seals, PPD 3600, Revised Jul. 1, 1989, Parker Rod Wiper/Scrapers (20 pages).
Integrated Publishing: Engine Mechanics—Dirt Exclusion Seals (Wiper and Scrapers) printed Jul. 2013; see http://enginemechanics.tpub.com/14105/css/14105_127.htm (2 pages).
Minnesota Rubber & Plastics Quadion LLC; Elastometers and Thermoplastics Engineering Design Guide, Rubber/Standard Products; Equi-Flex™ Rod Wiper/Scraper (2013 Minnesota Rubber and Plastics—Site Map) printed Jul. 2013 (3 pages).
Canadian Intellectual Property Office, Office Action dated Dec. 17, 2013, U.S. Pat. No. 2,803,957 entitled "Oilfield Equipment and Related Apparatus and Method" for Canadian Application corresponding to this U.S. Appl. No. 12/824,934 (our file 65) (2 pages).
Plain Bearing from Wikipedia, the free encyclopedia, http://en.wikipedia.org/wiki/Plain_bearing, 13 pages, printed on Jan. 30, 2015, last modified on Nov. 22, 2014: in particular, see illustrations and written description and related references on p. 8 for "A graphite-filled groove bushing" and p. 10 for "A pressure dam".
Communication pursuant to Rule 114(2) EPC issued by the European Patent Office dated Oct. 15, 2014 regarding a Third Party Observation submitted anonymously relating to European Application No. 11729665.7, which corresponds to U.S. Appl. No. 12/824,934 (our matter 65) (3 pages).
List of National Phase Applications corresponding to PCT Application PCT/GB2011/050737 published as WO 2011/128690 A1 on Oct. 20, 2011, printed on May 20, 2015 (1 page).
USPTO Final Office Action dated Apr. 28, 2015 for U.S. Appl. No. 13/640,933 entitled "Blowout Preventer Assembly" that was published as US-2013/0168578 A1 on Jul. 4, 2013, (11 pages).

* cited by examiner

FIG. 5
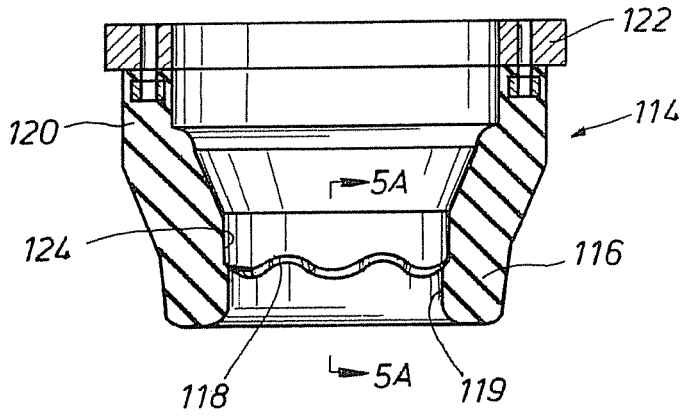
FIG. 5A
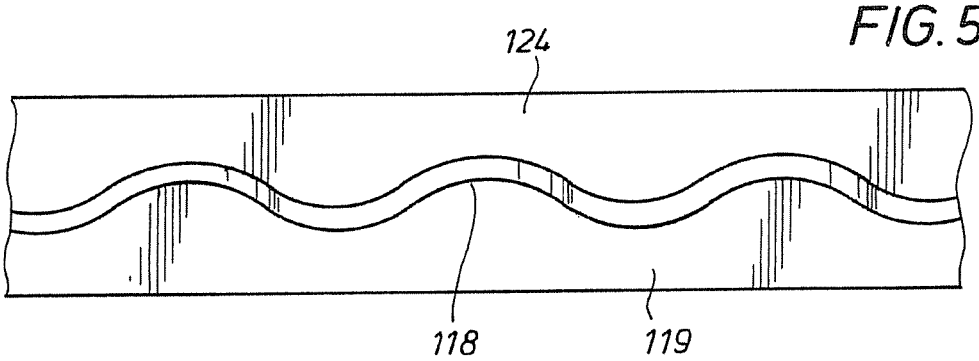
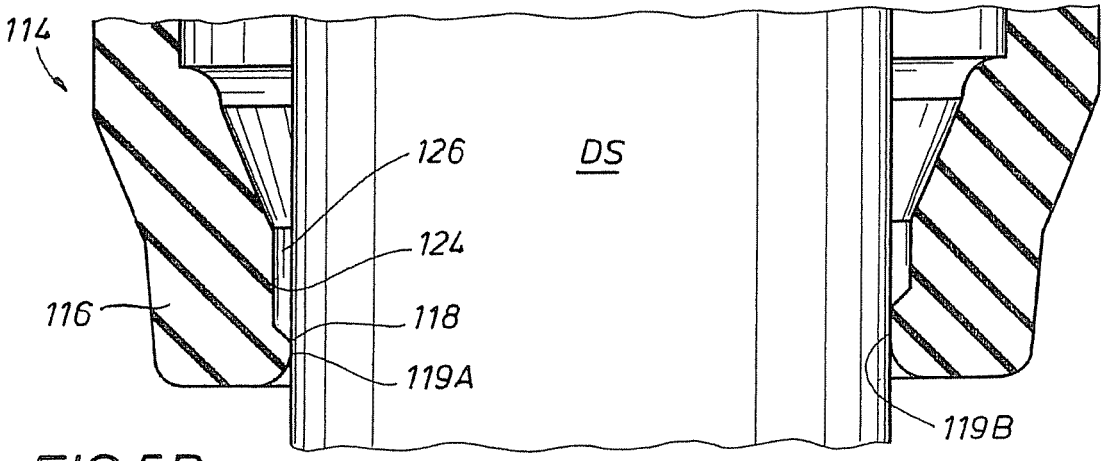
FIG. 5B

FIG. 5C
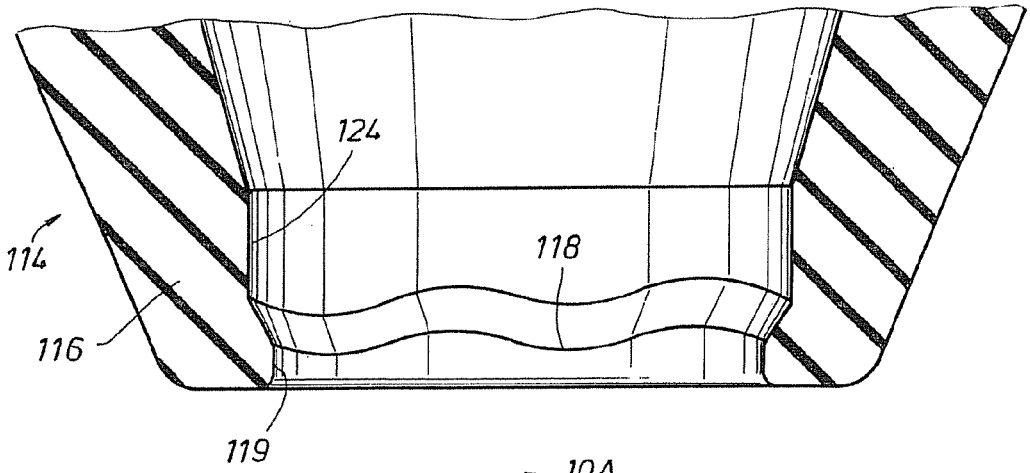
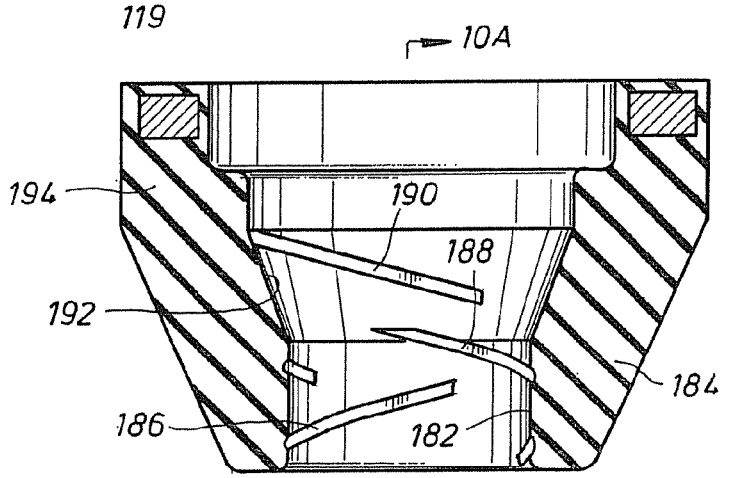
FIG. 10
FIG. 10A
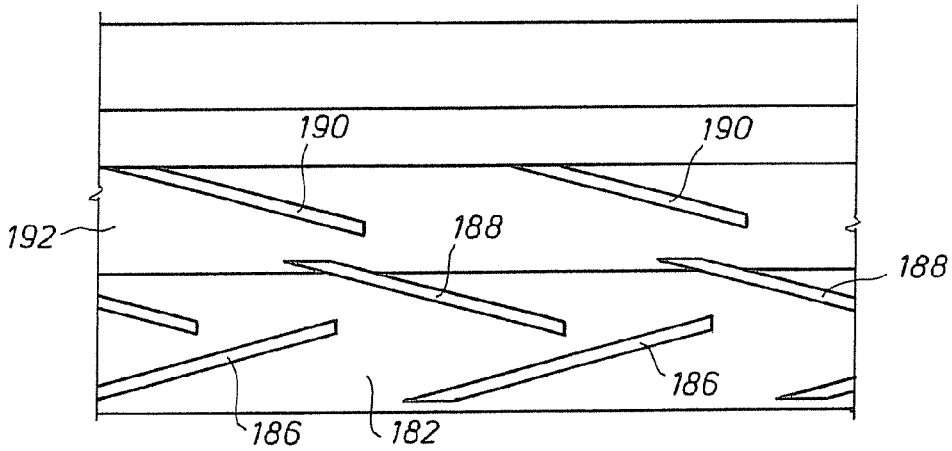

FIG. 6
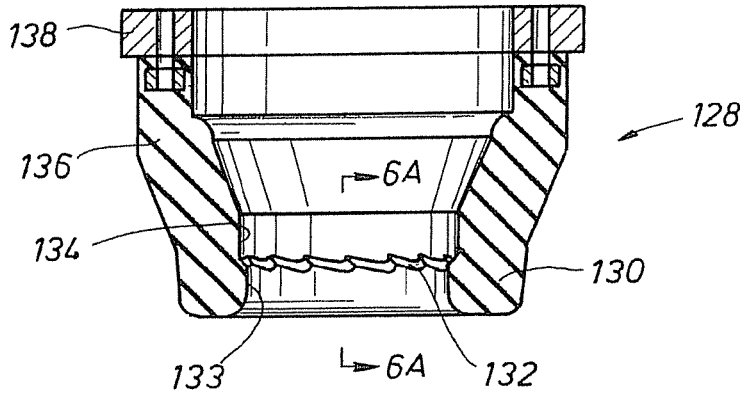
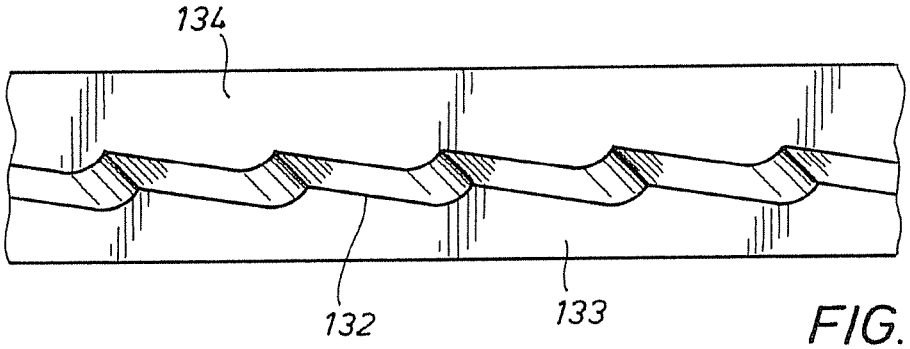
FIG. 6A
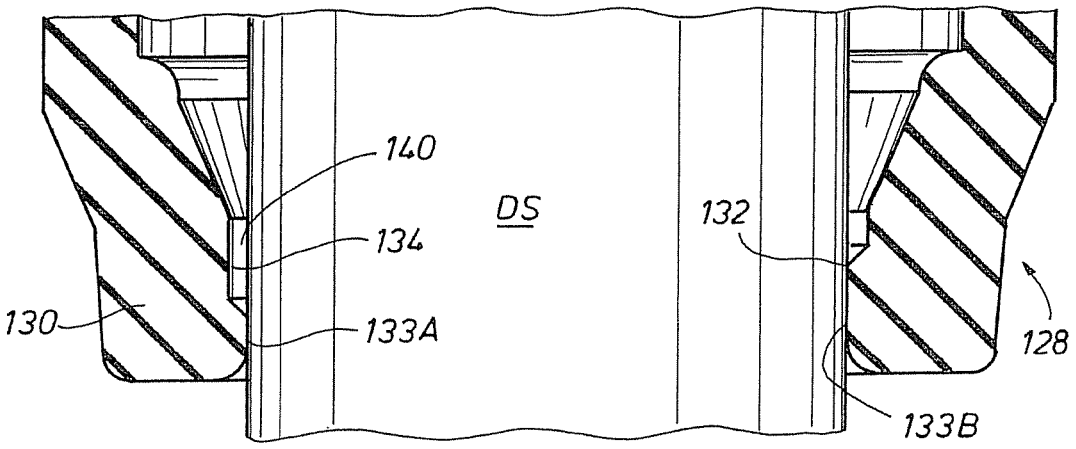
FIG. 6B

FIG. 11A
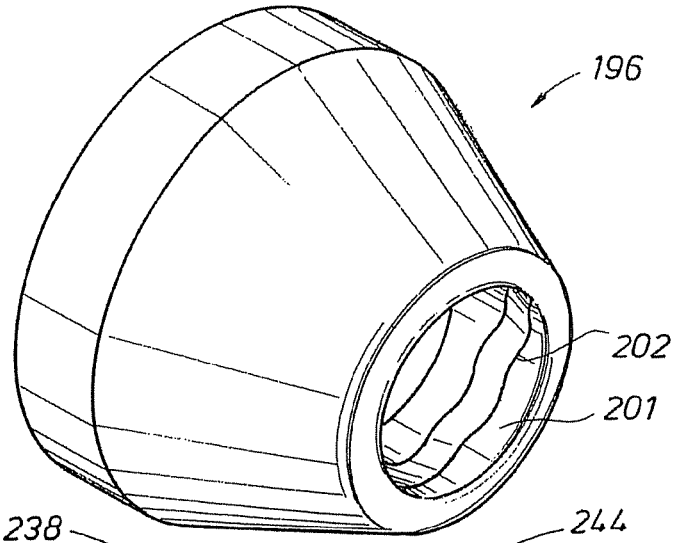
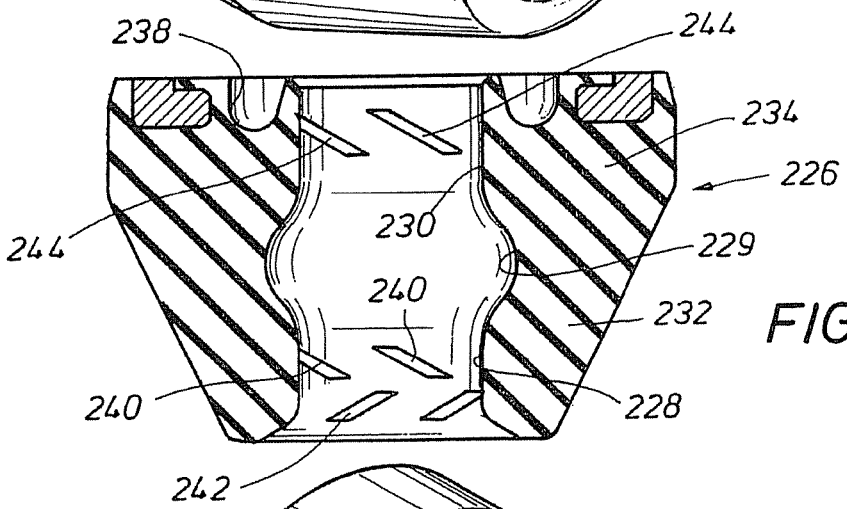
FIG. 12
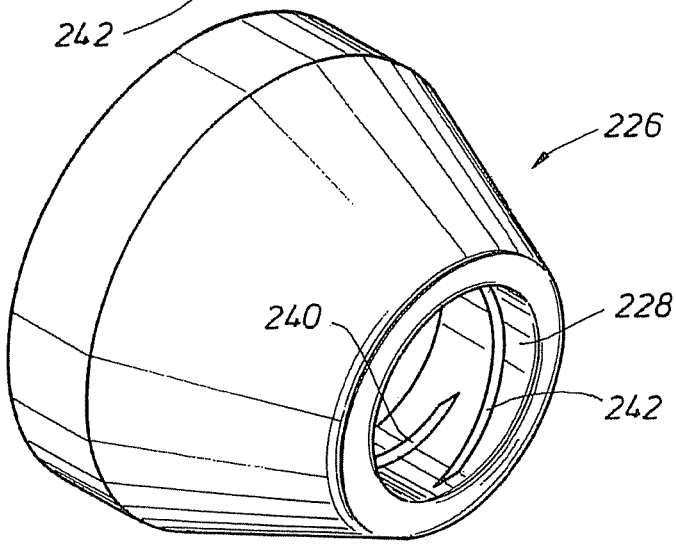
FIG. 12A

FIG.13A
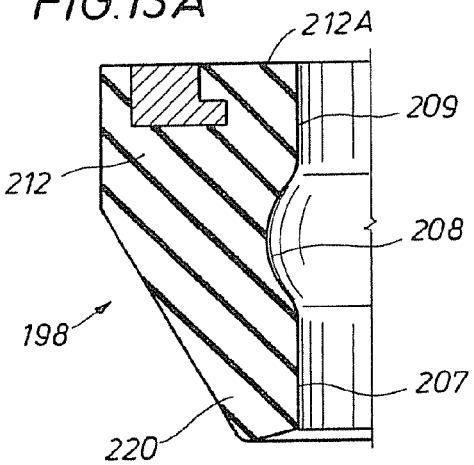
FIG.13B
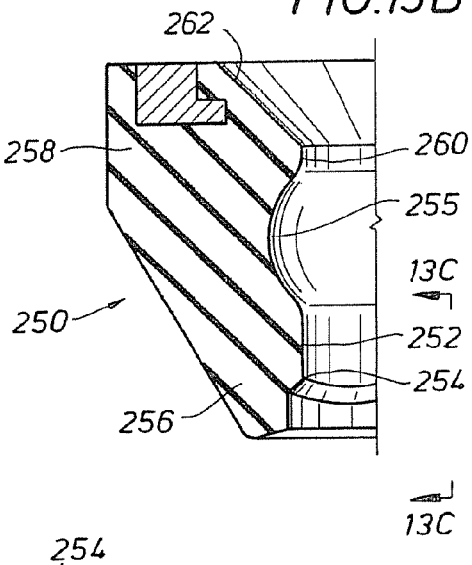
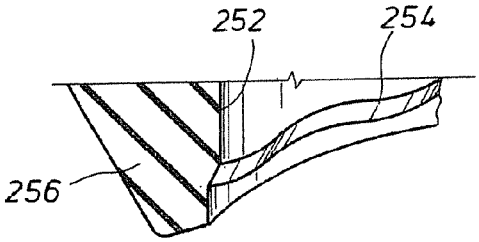
FIG.13C
FIG.13D
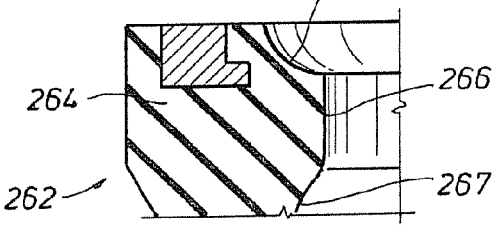
FIG.13E
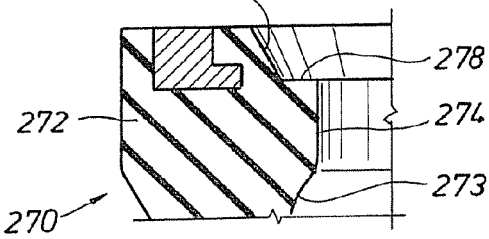
FIG.13F
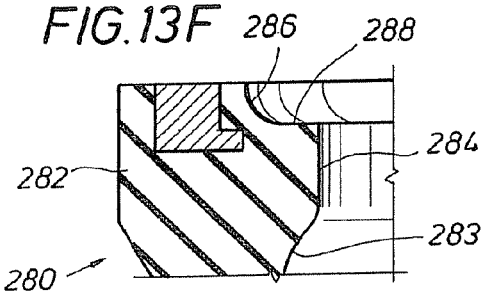
FIG.13G
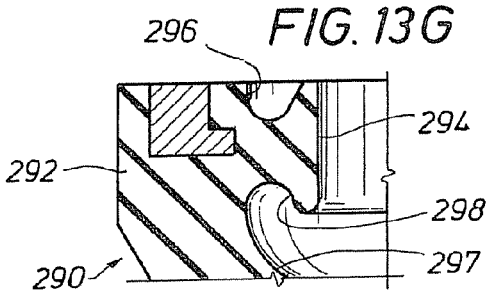

LUBRICATING SEAL FOR USE WITH A TUBULAR

CROSS-REFERENCE TO RELATED APPLICATIONS

N/A.

STATEMENT REGARDING FEDERALLY SPONSORED RESEARCH OR DEVELOPMENT

N/A

REFERENCE TO MICROFICHE APPENDIX

N/A

BACKGROUND OF THE INVENTION

1. Field of the Invention

This invention relates to sealing elements used in drilling wells.

2. Description of Related Art

Sealing elements have been used in rotating control devices (RCDs) for many years in the drilling industry. Passive sealing elements, such as stripper rubber sealing elements, can be fabricated with a desired stretch-fit. An example of a proposed stripper rubber sealing element is shown in U.S. Pat. No. 5,901,964. A stripper rubber sealing element may be attached with a rotatable internal bearing member of an RCD to seal around the outside diameter of an inserted tubular to rotate with the tubular during drilling. The tubular may be slidingly run through the RCD as the tubular rotates or when the tubular, such as a drill string, casing, coil tubing, or any connected oilfield component, is not rotating. Examples of some proposed RCDs are shown in U.S. Pat. Nos. 5,213,158; 5,647,444 and 5,662,181.

RCDs have been proposed with a single stripper rubber seal element, as in U.S. Pat. Nos. 4,500,094 and 6,547,002; and Pub. No. US 2007/0163784, and with dual stripper rubber sealing elements, as in the '158 patent, '444 patent and the '181 patent, and U.S. Pat. No. 7,448,454. The wellbore pressure in the annulus acts on the cone shaped stripper rubber sealing element with vector forces that augment a closing force of the stripper rubber sealing element around the tubular. U.S. Pat. No. 6,230,824 proposes two opposed stripper rubber sealing elements, the lower sealing element positioned axially downward, and the upper sealing element positioned axially upward (see FIGS. 4B and 4C of '824 patent).

Unlike a stripper rubber sealing element, an active sealing element typically requires a remote-to-the-tool source of hydraulic or other energy to open or close the sealing element around the outside diameter of the tubular. An active sealing element can be deactivated to reduce or eliminate the sealing forces of the sealing element with the tubular. RCDs have been proposed with a single active sealing element, as in the '784 publication, and with a stripper rubber sealing element in combination with an active sealing element, as in U.S. Pat. Nos. 6,016,880 and 7,258,171 (both with a lower stripper rubber sealing element and an upper active sealing element), and Pub. No. US 2005/0241833 (with a lower active sealing element and an upper stripper rubber sealing element).

A tubular typically comprises sections with varying outer surface diameters. The RCD sealing element must seal around all of the rough and irregular surfaces of the components of the tubular, such as a hardening surface (as proposed in U.S. Pat. No. 6,375,895), drill pipe, tool joints, drill collars, and other oilfield components. The continuous movement of the tubular through the sealing element while the sealing element is under pressure causes wear of the inwardly facing sealing surface of the sealing element.

When drilling with a RCD having dual independent annular sealing elements, the lower of the two sealing elements is typically exposed to the majority of the pressurized fluid and cuttings returning from the wellbore, which communicate with the lower surface of the lower sealing element body. The upper sealing element is exposed to the fluid that is not blocked by the lower sealing element. When the lower sealing element blocks all of the pressurized fluid, the lower sealing element is exposed to a significant pressure differential across its body since its upper surface is essentially at atmospheric pressure when used on land or atop a riser. The highest demand and wear on the RCD sealing elements occurs when tripping the tubular out of the wellbore under high pressure.

American Petroleum Institute Specification 16RCD (API-16RCD) entitled "Specification for Drill Through Equipment—Rotating Control Devices," First Edition,® February 2005 American Petroleum Institute, proposes standards for safe and functionally interchangeable RCDs. The requirements for API-16RCD must be complied with when moving the drill string through an RCD in a pressurized wellbore. The sealing element is inherently limited in the number of times it can be fatigued with larger diameter tool joints that pass under high differential pressure conditions. Of course, the deeper the wellbores are drilled, the more tool joints that will be stripped through a sealing element, some under high pressure.

RCDs have been proposed in the past to be positioned with marine risers. An example of a marine riser and some of the associated drilling components is proposed in U.S. Pat. Nos. 4,626,135 and 7,258,171. U.S. Pat. No. 6,913,092 proposes a seal housing with a RCD positioned above sea level on the upper section of a marine riser to facilitate a mechanically controlled pressurized system. U.S. Pat. No. 7,237,623 proposes a method for drilling from a floating structure using an RCD positioned on a marine riser. U.S. Pat. Nos. 6,470,975; 7,159,669; and 7,258,171 propose positioning an RCD assembly in a housing disposed in a marine riser. Also, an RCD has also been proposed in U.S. Pat. No. 6,138,774 to be positioned subsea without a marine riser.

Latching assemblies have been proposed in the past for positioning an RCD. U.S. Pat. No. 7,487,837 proposes a latch assembly for use with a riser for positioning an RCD. Pub. No. US 2006/0144622 proposes a latching system to latch an RCD to a housing. Pub. No. US 2008/0210471 proposes a docking station housing positioned above the surface of the water for latching with an RCD. Pub. No. US 2009/0139724 proposes a latch position indicator system for remotely determining whether a latch assembly is latched or unlatched.

In the past, when drilling in deepwater with a marine riser, the riser has not been pressurized by mechanical devices during normal operations. The only pressure induced by the rig operator and contained by the riser is that generated by the density of the drilling mud held in the riser (hydrostatic pressure). During some operations, gas can unintentionally enter the riser from the wellbore. If this happens, the gas will move up the riser and expand. As the gas expands, it will displace mud, and the riser will "unload." This unloading process can be quite violent and can pose a significant fire risk when gas reaches the surface of the floating structure via the bell-nipple at the rig floor.

U.S. Pat. No. 4,626,135 proposes a gas handler annular blowout preventer (BOP) to be installed in the riser. The gas handler annular BOP is activated only when needed, but instead of simply providing a safe flow path for mud and gas away from the rig floor, the gas handler annular BOP can be used to hold limited pressure on the riser to control the riser unloading process. However, drilling must cease because movement of the drill string through the annular BOP when the annular seal is engaged against the drill string will damage or destroy the non-rotatable annular seal. During drilling, the annular BOP's seal is open, and drilling mud and cuttings return to the rig through the annulus or annular space. Ram type blowout preventers have also been proposed in the past for drilling operations, such as proposed in U.S. Pat. Nos. 5,735,502; 4,488,703; 4,508,313; and 4,519,577. As with annular BOPs, drilling must cease when the ram BOP seal is engaged against the drill string tubular or damage to the seal will occur.

Prior to the development of RCDs, packing heads, such as proposed in U.S. Pat. Nos. 2,038,140; 2,124,015; 2,148,844; 2,163,813; and 2,287,205, were used for sealing around the drill string during drilling operations. Unlike an RCD, a packing head has no bearing assembly and its sealing element does not rotate with the drill string or other inserted tubular or oilfield component. U.S. Pat. No. 2,170,915 proposes a stationary stripper rubber seal positioned in a housing over a well casing through which the drill string may be rotated for drilling. A problem with such prior art packing head and stationary stripper rubber devices is that the sealing element can be damaged or destroyed by the heat generated from the friction resisting the movement of the inserted tubular or oilfield component.

Drilling with casing is gaining some acceptance worldwide for addressing certain onshore and offshore problems such as formation instability, lost circulation, fluids control, and troublesome zones. Drilling with casing eliminates the need to continually replace strings of drill pipe during drilling, saving time since the rig is also drilling while casing is being run into the hole. Although drilling with casing currently constitutes only a small part of worldwide drilling activity, drilling with casing is expected to increase in the future.

Drilling with casing is being attempted with increasingly larger casing sizes. While drilling with casing has been used in the past with 9⅝ inch (24.4 cm) diameter casing, it is now being attempted with casing diameters up to 20 inches (50.8 cm). However, the amount of annular space within a riser or housing for positioning an RCD becomes increasing more limited as the casing size gets larger. The RCD has to be sized to accommodate the large casing, and it is often impractical to use a larger riser or housing, particularly in shallow wells or other applications where the larger casing is only needed for relatively short drilling distances, like 100 feet (30.5 m). Drilling with casing may be attempted in the future in certain subsea applications without a marine riser, particularly for drilling relatively short drilling distances.

Testing performed by the inventors reveals that when a 10¾ inch (27.3 cm) diameter casing section is rotated in a prior art stationary stripper rubber sealing element under low pressures of 5 to 10 psi, the prior art sealing element deteriorates and is damaged in about 2 to 10 hours due to heat generated by the frictional resistive forces. When water is applied to the prior art sealing element surfaces not contacting the casing section, the sealing element damage does not occur until about 30 hours. However, when drilling with casing is used in real drilling applications, much longer drilling times are needed.

Circular seal members positioned within grooves, chambers, pockets or receptacles have been used in the past in applications involving rotating shafts. Kalsi Engineering, Inc. of Houston, Tex. and Parker Hannifin, Inc. of Cleveland, Ohio are two manufacturers of such sealing members. U.S. Pat. No. 4,610,319 proposes a circular sealing member for a drill bit application having a wave pattern on the sealing side of the sealing member and positioned within a circular pocket. The sealing member receives lubrication in the pocket from an external lubricant supply system source. U.S. Pat. Nos. 5,230,520; 5,678,829; 5,738,358; 5,873,576; 6,007,105; 6,036,192; 6,109,618; 6,120,036; 6,227,547; 6,315,302; 6,334,619; 6,382,634; 6,494,462; 6,561,520; and 6,685,194 propose circular seals having sealing interfaces with various geometries and disposed within receptacles, grooves, chambers, or pockets. The seal receptacle, groove, chamber or pocket supports and stabilizes the circular seal and may be used to receive lubricant for the seal from an external lubricant supply source.

International Pub. No. WO2008/133523 proposes a packer seal element with at least one channel within the seal for moving a lubricant through the seal. The packer element is positioned around the drill string, and the lubricant, proposed to be oil or grease, is injected from an external source into a port in the side of the packer seal for travel through the channel in the seal. U.S. Pat. No. 3,472,518 proposes a stationary metal housing positioned close to the surface of a drill pipe with the housing inner surface having a series of rings or grooves forming a tortuous path between the outer surface of the drill pipe and the inner surface of the housing. The tortuous path is proposed to provide for a fluid flow that absorbs the pressure drop from the pressure in the annulus around the drill pipe below the housing to atmospheric pressure on the exterior of the housing.

The above discussed U.S. Pat. Nos. 2,038,140; 2,124,015; 2,148,844; 2,163,813; 2,170,915; 2,287,205; 3,472,518; 4,488,703; 4,500,094; 4,508,313; 4,519,577; 4,610,319; 4,626,135; 5,213,158; 5,230,520; 5,647,444; 5,662,181; 5,678,829; 5,735,502; 5,738,358; 5,873,576; 5,901,964; 6,007,105; 6,016,880; 6,036,192; 6,109,618; 6,120,036; 6,138,774; 6,227,547; 6,230,824; 6,315,302; 6,334,619; 6,375,895; 6,382,634; 6,470,975; 6,494,462; 6,547,002; 6,561,520; 6,685,194; 6,913,092; 7,159,669; 7,237,623; 7,258,171; 7,448,454; and 7,487,837; and Pub. Nos. US 2005/0241833; 2006/0144622; 2007/0163784; 2008/0210471; and 2009/0139724; and International Pub. No. WO2008/133523 are all hereby incorporated by reference for all purposes in their entirety.

It would be desirable to drill with a sealed and pressurized mud system without using an RCD. Particularly, it would be desirable to drill using casing with a sealed and pressurized mud system without using an RCD. It would be desirable to drill for relatively short distances using larger casing sizes without an RCD since the annular space surrounding such casing may be limited. It would be desirable to drill with a non-rotating BOP device that would allow drilling to continue with the sealing element sealed without the sealing element becoming damaged or destroyed from the heat and other effects of friction in a relatively short time period. It would also be desirable to drill with a non-rotating BOP device in relatively shallow subsea wells without a marine riser. It would be desirable to use sealing elements in an RCD that would not become damaged or destroyed from the heat and other effects of friction in a relatively short time period when the RCD bearings or other RCD components malfunction in providing sufficient seal element rotation. It would also be desirable to have a sealing element with bi-directional or redundant sealing. It would be desirable to decrease the differential pressure across the lower seal element in a dual seal configuration.

BRIEF SUMMARY OF THE INVENTION

A system and method are provided for drilling using a sealing element having a lubricating seal profile on the inwardly facing bore surface of its sealing section. The lubricating seal profile allows for sealing a drill string tubular or other oilfield component and communicating a fluid between the sealing section of the sealing element and the sealed drill string tubular or other oilfield component while the drill string tubular or other oilfield component rotates and/or slides vertically relative to the sealing element. The sealing element may seal with the drill string tubular or other oilfield component and either remain stationary and non-rotating, or it may rotate. The same fluid used for drilling may also be used for lubrication, such as water, drilling fluid, mud, well bore fluid or other gas or liquid.

In one embodiment, the sealing element may be positioned with a seal housing above or with a marine riser. In another embodiment, the seal element may be positioned with a seal housing in a marine riser. In yet another embodiment, the sealing element may be positioned with a seal housing subsea without a marine riser. A seal adapter housing may keep the sealing element stationary and non-rotating while the sealed drill string tubular or other oilfield component rotates relative to the sealing element. In another embodiment, the seal housing may be a RCD that allows the sealing element to rotate with the sealed drill string tubular or other oilfield component.

The lubricating seal profile allows for communicating a fluid between the sealing section of the sealing element and the sealed drill string tubular or other oilfield component when the RCD sealing element either slows or stops rotating and the sealed drill string tubular or other oilfield component continues to rotate relative to the sealing element, such as when the RCD bearings malfunction or require bearing lubrication. In still other embodiments, the sealing element having a lubricating seal profile may be positioned with a BOP, such as an annular BOP or a ram-type BOP, allowing the sealed drill string tubular or other oilfield component to continue rotating relative to the BOP sealing element.

More than one sealing element having a lubricating seal profile may be positioned with a seal housing. In one embodiment, sealing elements may be positioned axially downwardly. In another embodiment, sealing elements may be opposed both axially downwardly and axially upwardly. A dual sealing element or dual seal may have two annular sealing surfaces that are spaced apart by a non-sealing surface. In one embodiment, a dual seal may be a unitary bi-directional sealing element having lubricating seal profiles on the inwardly facing surfaces of each of its two nose sections. In another embodiment, a dual seal may have a lubricating seal profile on the inwardly facing surface of its nose section and a lubricating seal profile on the backup or bi-directional sealing surface adjacent the throat section. The dual seal embodiments also may not have any lubricating seal profiles on their spaced apart annular sealing surfaces. In another embodiment, differential pressures across two seal elements may be managed by filling the cavity between the two seal elements with cuttings-free drilling fluid, mud, water, coolant, lubricant or inert gas at desired amounts of pressure.

All embodiments of the dual seal may have a hydraulic force surface to move, deform or compress one or both of the sealing surfaces with a drill string tubular or other oilfield component. The hydraulic force surface may take many different forms of embodiments, including a closed curved or radius surface, an open inclined surface, an open curved surface, a combination open inclined surface with a horizontal or flat surface, a combination open curved surface with horizontal or flat surface, and a combination closed upper and lower curved surfaces with a sealing surface therebetween.

The lubricating seal profile may have many different embodiments, including, but not limited to, a wave pattern or wavy edge, a saw-tooth high film pattern, a downwardly inclined passageway pattern, an upwardly inclined passageway pattern, and a combination upwardly and downwardly inclined passageway pattern. The lubricating seal profile may be positioned and oriented on the inwardly facing sealing surface of the sealing element based upon the intended direction of flow of the lubricating fluid. A lubricating seal profile may be positioned and oriented on either or both of the spaced apart sealing surfaces of a dual seal based upon the intended direction of flow of the lubricating fluid.

In one embodiment, a stripper rubber sealing element may have an annular lubricating seal profile on the inwardly facing bore surfaces of both its nose section and its throat section. The nose section may seal with a drill string tubular or other oilfield component having a first diameter, and the throat section and nose section may deform to seal with an oilfield component of the drill string tubular having a second and larger diameter, such as a tool joint.

The system and method allow drilling without an RCD using larger casing sizes with a sealing element sealed with the casing. The system and method also allow drilling with a non-rotating BOP device, such as an annular BOP or a ram-type BOP, that allow drilling to continue with the sealing element engaged and without the sealing element becoming damaged or destroyed from the heat and other effects of friction in a relatively short time period. The system and method also allow drilling with casing using a non-rotating BOP device in relatively shallow subsea wells without a riser. The system and method further allow the use of sealing elements with an RCD that will not become damaged or destroyed from the heat and other effects of friction in a relatively short time period when the RCD bearings or other RCD components malfunction and do not allow adequate or desired rotation. The system and method further allow for dual seals with sealing surfaces for redundant, back up or bi-directional sealing with or without lubricating profiles and for use with or without a rotating tubular or other oilfield component.

BRIEF DESCRIPTION OF THE DRAWINGS

A better understanding of the embodiments may be obtained with the following detailed descriptions of the various disclosed embodiments in the drawings, which are given by way of illustration only, and thus are not limiting the invention, and wherein:

FIG. 5 is a cross-sectional elevational view of a sealing element with a wave pattern lubricating seal profile on the inwardly facing surface of the nose section.

FIG. 5A is a linear isometric representation of the view along line 5A-5A of FIG. 5 showing the wave pattern lubricating seal profile.

FIG. 5B is an enlarged detail view of the sealing element nose section of FIG. 5 with the wave pattern seal profile with an inserted tubular.

FIG. 5C is an enlarged detail view of the sealing element nose section of FIG. 5 with a wave pattern lubricating seal profile on the inwardly facing surface of the nose section.

FIG. 6 is a cross-sectional elevational view of a sealing element with a saw-tooth pattern high film lubricating seal profile on the inwardly facing surface of the nose section.

FIG. 6A is a linear isometric representation of the view along line 6A-6A of FIG. 6 showing the high film saw-tooth pattern lubricating seal profile.

FIG. 6B is an enlarged detail view of the seal element nose section of FIG. 6 with the seal profile with an inserted tubular.

FIG. 10 is a cross-sectional elevational view of a sealing element with a combination upwardly and downwardly inclined passageway pattern lubricating seal profile on the inwardly facing surface of the nose section, and a downwardly inclined passageway pattern lubricating seal profile extending on the inwardly facing sloped or inclined surface of the nose section and throat section.

FIG. 10A is a linear representation of the view along line 10A-10A of FIG. 10 showing the lubricating seal profiles.

FIG. 11A is an isometric view of the nose section of the lower sealing element of FIG. 11 showing a wave pattern lubricating seal profile.

FIG. 12 is a cross-sectional elevational view of a dual seal having a first sealing surface with a combination upwardly and downwardly inclined passageway pattern lubricating seal profile and a second or upper sealing surface with a downwardly inclined passageway pattern lubricating seal profile adjacent to a closed curved hydraulic force surface formed on the top of the dual seal.

FIG. 12A is an isometric view of the first sealing surface of the dual seal of FIG. 12 showing the combination upwardly and downwardly inclined passageway pattern lubricating seal profiles.

FIG. 13A is a partial cross-sectional elevational view of the dual seal shown in FIG. 11.

FIG. 13B is a partial cross-sectional elevational view of a dual seal with a wave pattern lubricating seal profile on the first sealing surface and an inclined hydraulic force surface adjacent the second or upper sealing surface.

FIG. 13C is a partial section isometric view along line 13C-13C of FIG. 13B.

FIG. 13D is a partial cross-sectional elevational view of the top portion of a dual seal with an open curved or radius hydraulic force surface adjacent the second or upper sealing surface.

FIG. 13E is a partial cross-sectional elevational view of the top portion of a dual seal with a combination open inclined hydraulic force surface with a horizontal or flat hydraulic force surface adjacent the second or upper sealing surface.

FIG. 13F is a partial cross-sectional elevational view of the top portion of a dual seal with a combination open curved or radius hydraulic force surface with horizontal or flat hydraulic force surface adjacent the second or upper sealing surface.

FIG. 13G is a partial cross-sectional elevational view of the top portion of a dual seal with a combination closed first or upper curved hydraulic force surface with a second or lower closed curved hydraulic force surface with the second or upper sealing surface therebetween.

DETAILED DESCRIPTION OF THE INVENTION

Figure 1:
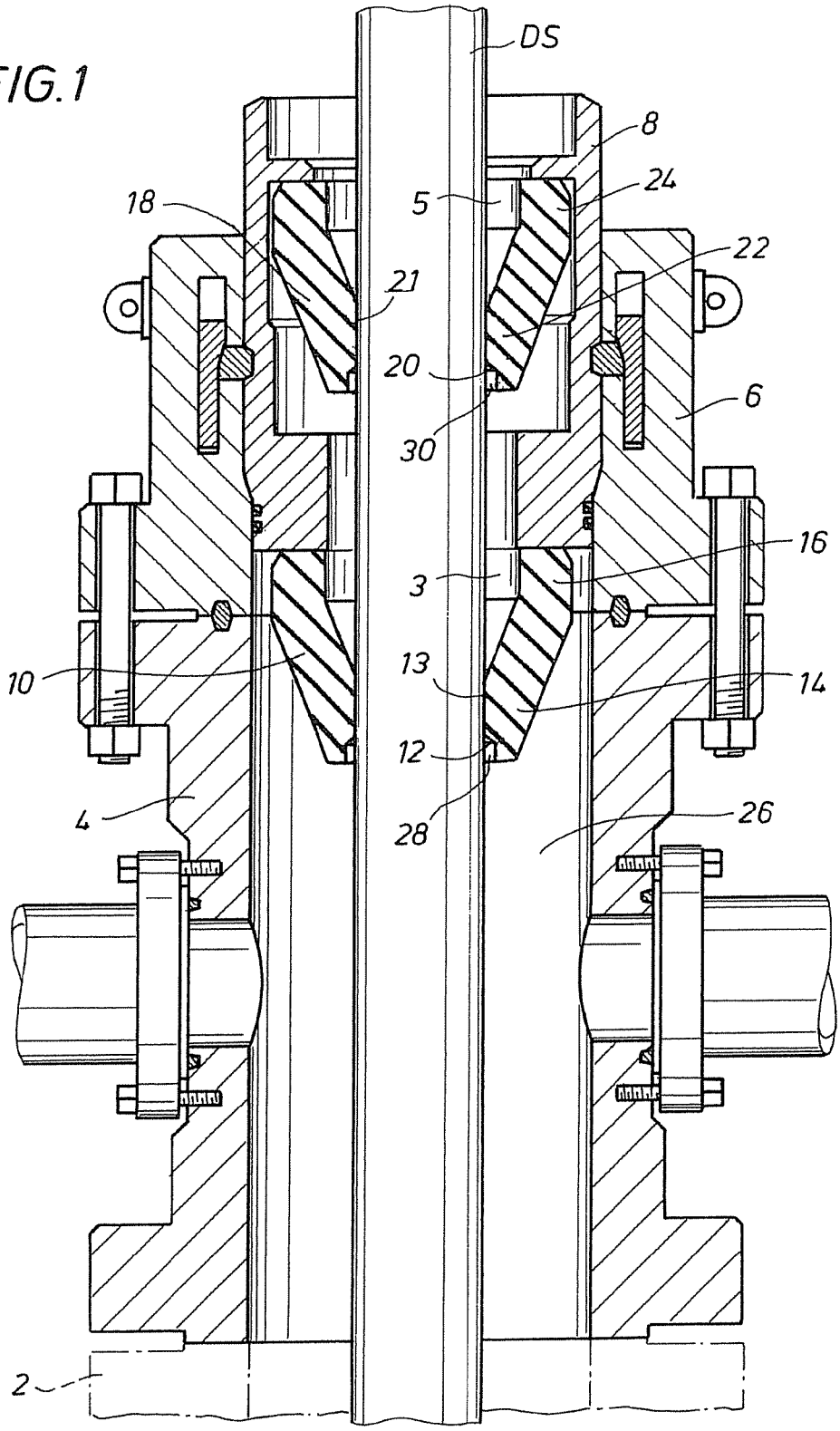
FIG. 1 is a cross-sectional elevational view of a stationary seal adapter housing with two sealing elements each having lubricating seal profiles on the inwardly facing surfaces of their nose sections with the adapter housing latched with a latch housing disposed over a diverter housing.

In FIG. 1, diverter housing 4 is disposed over marine riser 2 and below latch housing 6. Latch housing 6 may be a latch housing such as proposed in FIG. 2 of U.S. Pat. No. 7,487,837, although other housings are contemplated. Seal housing 8 is latched with latch housing 6. First seal or first sealing element 10 is disposed with seal housing 8 with its first seal supporting or throat section 16. First sealing element 10 has a first seal lubricating seal profile 12 on the inwardly facing sealing surface 13 of its nose section or sealing section 14, sealing with drill string tubular DS. As used herein, drill string tubular DS may be a drill string, casing, liner, coil tubing, drill pipe, tubular, tool joint, collar, bottom hole assembly or any other oilfield component.

Second seal or second sealing element 18 is disposed with seal housing 8 with its second seal supporting or throat section 24. Second sealing element 18 has a second seal lubricating seal profile 20 on the inwardly facing sealing surface 21 of it nose section or sealing section 22 for sealing with drill string tubular DS. Although two seal elements (10, 18) are shown, any number of sealing elements are contemplated, including only one sealing element. Seal housing 8 is an adapter or seal adapter housing that keeps sealing elements (10, 18) stationary and does not allow the sealing elements (10, 18) to rotate as drill string tubular DS rotates or moves vertically, such as during drilling.

First and second seal lubricating profiles (12, 20) may be the same or they may be different. First and second seal lubricating profiles (12, 20) shown in FIG. 1 are consistent with either a wave pattern or wavy edge lubricating seal profile, such as shown in FIGS. 13B-13C for the nose sealing section, and similar to that shown in FIGS. 5-5C and 11A, or a saw-tooth pattern high film lubricating seal profile, similar to that shown in FIGS. 6-6B. However, any of the lubricating seal profiles shown in any of the Figures may be used with the sealing elements (10, 18) in FIG. 1, or with any of the sealing elements shown in any of the other Figures, to achieve the desired lubrication for the sealing element application.

The location and orientation of profiles (12, 20) in FIG. 1 were selected since the seal housing 8 is disposed over marine riser 2, and it is intended that fluid may flow up the annular space 26 between the drill string tubular DS and the marine riser 2 and then the diverter housing 4. Like for the nose sealing section in FIGS. 13B-13C, first and second seal lubricating profiles (12, 20) are positioned on the respective inwardly facing bore sealing surfaces (13, 21) of first seal nose section 14 and second seal nose section 22 so that the fluid moving up the annulus or annular space 26 may communicate fluid to lubricate between the respective sealing sections (14, 22) and the drill string tubular DS. Conversely, as will be discussed below in detail, the lubricating seal profiles shown in FIGS. 5-5C, 6-6B, and 11A are located and oriented for fluid flowing downward, not upward as in FIG. 1.

When the pressurized fluid flows up the annular space 26 in FIG. 1 while drill string tubular DS is rotating and/or moving vertically, the fluid first encounters first sealing element profile passageway 28. As the drill string tubular DS moves and/or rotates relative to the first seal 10, the pressurized fluid in annulus 26 communicates between first sealing surface 13 via passageway 28 and drill string tubular DS, lubricating first seal 10. The fluid may then move upwards, encountering second seal profile passageway 30. Again, as the drill string tubular DS moves and/or rotates relative to the second sealing element 18, the pressurized fluid communicates between second seal sealing surface 21 via passageway 30 and drill string tubular DS, lubricating second seal 18. The fluid may be the same fluid used for drilling, such as water, drilling fluid or mud, well bore fluid or other gas or liquids. An external source of fluid is not required for any of the embodiments shown in any of the Figures.

Figure 4:
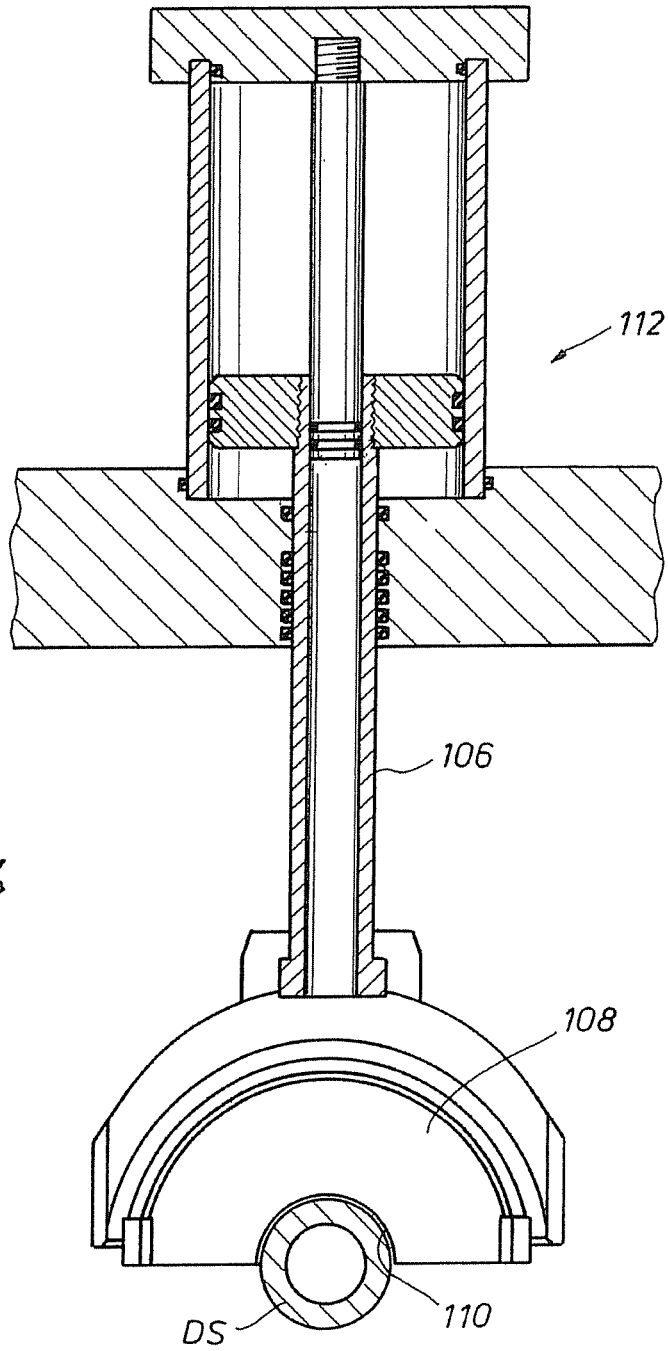
FIG. 4 is a cross-sectional plan view of a ram type BOP sealing arm in the closed or sealed position with the sealing arm sealing element having a lubricating seal profile disposed with a tubular.

Passive sealing elements, such as first sealing element 10 and second sealing element 18 in FIG. 1, may each have a respective mounting ring (3, 5), throat (16, 24) and nose (14, 22). As shown in FIG. 4 of U.S. Pat. No. 5,901,964, the throat is the transition portion of the stripper rubber between the nose and the metal mounting ring. The nose is where the stripper rubber stretches to seal against the drill string tubular, and further stretches to pass a larger diameter, such as on tool joints. Returning to FIG. 1, the mounting ring (3, 5) is for attaching the sealing element (10, 18) to the seal housing 8. At high differential pressures, the throat, which unlike the nose, does not have support of the tubular, may extrude up towards the inside diameter of the mounting ring. This more likely occurs when tripping out under high pressure. A portion of the throat inside diameter may be abraded off, usually near the mounting ring, leading to excessive wear of the sealing element. For all embodiments it is contemplated that the throat profile may be different for each tubular size to minimize extrusion of the throat towards the mounting ring, and/or to limit the amount of deformation and fatigue before the tubular backs up or supports the throat. For all embodiments it is contemplated that the mounting ring may have an inside diameter sized for pressure containment for each diameter of tubular and any larger outside diameter. The '964 patent proposes a stripper rubber sealing element having enhanced properties for resistance to wear. It is also contemplated that reinforcement and urging members (not shown), fabricated from metal or plastic, could be formed in the sealing element as is known by those skilled in the art.

For each of the sealing elements (10, 18), each of their respective seal support or throat sections (16, 24) and sealing or nose sections (14, 22) may have a different wear resistance. Their sealing sections (14, 22) and profiles (12, 20) may also each have a different wear resistance. Since the sealing sections are not compressed against a groove, each of the sealing sections (14, 22) has a stretch fit or other urging member(s) to seal the profiles (12, 20) with the drill string tubular DS or other inserted oilfield component. It is contemplated that first sealing element 10 and second sealing element 18, as well as all sealing elements in any other embodiment shown in any of the Figures, may be made in whole or in part from SULFRON® material, which is available from Teijin Aramid BV of the Netherlands. SULFRON® materials are a modified aramid derived from TWARON® material. SULFRON material limits degradation of rubber properties at high temperatures, and enhances wear resistance with enough lubricity, particularly to the nose, to reduce frictional heat. SULFRON material also is stated to reduce hysteresis, heat build-up and abrasion, while improving flexibility, tear and fatigue properties. It is contemplated that the stripper rubber sealing element may have para aramid fibers and dust. It is contemplated that longer fibers may be used in the throat of the stripper rubber sealing element to add tensile strength, and that SULFRON material may be used in whole or in part in the nose of the stripper rubber sealing element to add lubricity.

The '964 patent proposes a stripper rubber with fibers of TWARON® material of 1 to 3 millimeters in length and about 2% by weight to provide wear enhancement in the nose. It is contemplated that the stripper rubber may include 5% by weight of TWARON to provide stabilization of elongation, increase tensile strength properties and resist deformation at elevated temperatures. Para amid filaments may be in a preform, with orientation in the throat for tensile strength, and orientation in the nose for wear resistance. TWARON and SULFRON are both registered trademarks of Teijin Aramid BV of the Netherlands.

It is further contemplated that material properties may be selected to enhance the grip of the sealing element. A softer elastomer of increased modulus of elasticity may be used, typically of a lower durometer value. An elastomer with an additive may be used, such as aluminum oxide or pre-vulcanized particulate dispersed in the nose during manufacture. An elastomer with a tackifier additive may be used. This enhanced grip of the sealing element would be beneficial when one of multiple sealing elements is dedicated for rotating with the tubular.

It is also contemplated that the sealing elements of all embodiments may be made from an elastomeric material made from polyurethane, HNBR (Nitrile), Butyl, or natural materials. Hydrogenated nitrile butadiene rubber (HNBR) provides physical strength and retention of properties after long-term exposure to heat, oil and chemicals. It is contemplated that polyurethane and HNBR (Nitrile) may preferably be used in oil-based drilling fluid environments 160° F. (71° C.) and 250° F. (121° C.), and Butyl may preferably be used in geothermal environments to 250° F. (121° C.). Natural materials may preferably be used in water-based drilling fluid environments to 225° F. (107° C.).

It is contemplated that one of the stripper rubber sealing elements may be designed such that its primary purpose is not for sealability, but for assuring that the inner member of the RCD rotates with the tubular, such as a drill string. This sealing element may have rollers, convexes, or replacement inserts that are highly wear resistant and that press tightly against the tubular, transferring rotational torque to the inner member. It is contemplated that all sealing elements for all embodiments in all the Figures may comply with the API-16RCD specification requirements.

It is contemplated that the pressure between sealing elements (10, 18) may be controllable. The concept of controlling pressure between sealing elements as disclosed in this application is proposed in U.S. Pat. No. 8,347,983. U.S. Pat. No. 8,347,983 is owned by the assignee of the present invention and is hereby incorporated by reference for all purposes in its entirety. The cavity between the sealing elements (10, 18) may be pressurized with cuttings-free drilling fluid, water, mud, coolant, lubricant or inert gas for the purpose of decreasing the differential pressure across the lower sealing element 10 and/or flushing its sealing surface 13 for the purpose of reducing wear and extending seal element life. The cuttings-free fluid may be supplied at a pressure higher than the pressure below the lower sealing element 10, such as 120 psi higher, so as to allow the cuttings free fluid to lubricate between the drill string DS and the sealing surface 13. Similarly, it is contemplated that the pressure between all sealing elements shown for all embodiments in all of the Figures may be controllable. All cavities between the sealing elements for all embodiments shown in all of the Figures may be pressurized with cuttings-free drilling fluid, mud, water, coolant, lubricant or inert gas for the purpose of decreasing the differential pressure across the lower sealing element and/or flushing its sealing surface for the purpose of reducing wear. The cavity fluid may also include lubricant from the bearings, coolant from a cooling system, or hydraulic fluid used to active an active sealing element.

Sensors can be positioned to detect the wellbore annulus fluid pressure and temperature and the cavity fluid pressure and temperature and at other desired locations. The pressures and temperatures may be compared, and the cavity fluid pressure and temperature applied in the cavity may be adjusted. The pressure differential to which one or more of the sealing elements is exposed may be reduced. The cavity fluid may be circulated, which may be beneficial for lubricating and cooling or may be bullheaded. The stationary seal adapter housing and/or RCD may have more than two sealing elements. Pressurized cavity fluids may be communicated to each of the internal cavities located between the sealing elements. Sensors can be positioned to detect the wellbore annulus fluid pressure and temperature and the cavity fluid pressures and temperatures. Again, the pressures and temperatures may be compared, and the cavity fluid pressures and temperatures in all of the internal cavities may be adjusted.

Figure 2:
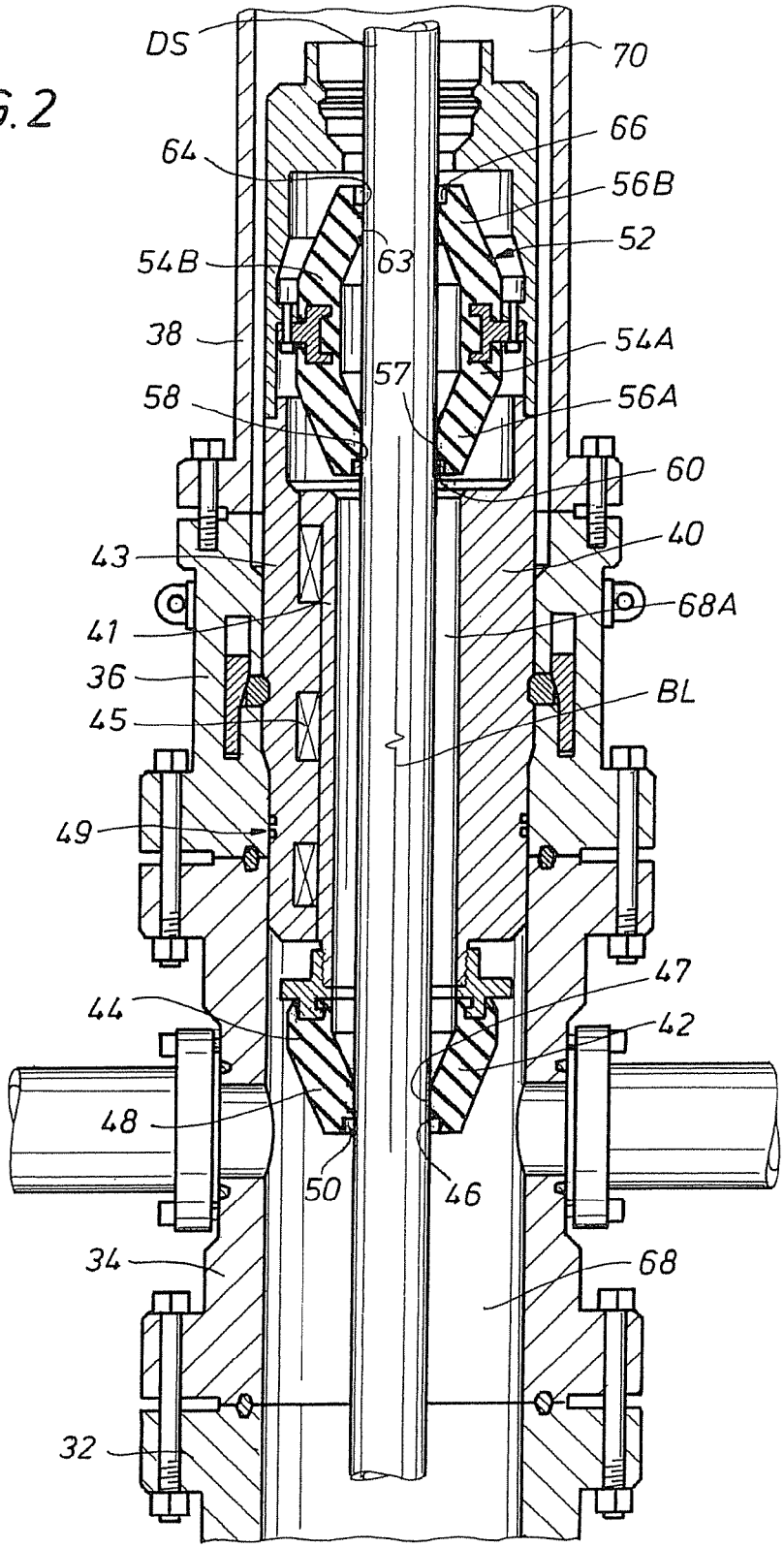
FIG. 2 is a cross-sectional elevational view of an RCD on the left side of the break line, and a stationary seal adapter housing on the right side of the break line, with an upper dual seal having lubricating seal profiles on the inwardly facing surfaces of each of its two nose sections, and a lower sealing element having a lubricating seal profile on the inwardly facing surface of its nose section, where the RCD and adapter housing is latched with a latch housing disposed in a marine riser over a diverter housing.

Turning to FIG. 2, latch housing 36 and diverter housing 34 are disposed between marine riser lower tubular section 32 and marine riser upper tubular section 38. Latch housing 36 may be a latch housing such as proposed in FIG. 2 of U.S. Pat. No. 7,487,837, although other housings are contemplated. On the right side of the vertical break line BL, seal housing 40 is latched with latch housing 36 within the marine riser. Seal housing 40 is an adapter or seal adapter housing that is stationary and does not allow rotation of the sealing elements (42, 52). On the left side of the vertical break line BL, seal housing or RCD 49 has a stationary outer member 43 and a rotatable inner member 41 with bearings 45 therebetween. Seal housing or RCD 49 allows rotation of the sealing elements (42, 52). Outer member 43 of seal housing or RCD 49 is latched with latch housing 36. As can now be understood, a seal housing that is an RCD or a stationary seal adapter housing may be used with FIG. 2.

Continuing with FIG. 2, first seal or first sealing element 42 is disposed with seal housing (40, 49) with its first seal supporting or throat section 44. First sealing element 42 has a first seal lubricating seal profile 46 on the inwardly facing sealing surface 47 of its nose section or sealing section 48, which is sealed with drill string tubular DS. Second seal or second sealing element, generally indicated as 52, is a dual seal with two spaced apart annular sealing surfaces (57, 63). Dual seal 52 is a unitary bi-directional sealing element and is disposed with seal housing (40, 49) with its second seal supporting or throat sections (54A, 54B). Dual seal 52 may be formed or molded as a monolithic seal. Second seal 52 has a first nose section 56A and a second nose section 56B. Second seal 52 has a second seal first lubricating seal profile 58 on the inwardly facing first sealing surface 57 of its first nose sealing section 56A, which is sealed with drill string tubular DS. Second seal 52 has a second seal second lubricating seal profile 64 on the inwardly facing second sealing surface 63 of its second nose sealing section 56B, which is also sealed with drill string tubular DS. As can now be understood, second seal 52 has two annular sealing sections (56A, 56B) and sealing surfaces (57, 63) that are spaced apart with a nonsealing surface therebetween. It is also contemplated that second seal 52 may be formed without any lubricating seal profiles (58, 64), or that only one of its nose sections (56A, 56B) may have a lubricating seal profile. Although two sealing elements (42, 52) are shown in FIG. 2, any number of sealing elements are contemplated, including only one sealing element. It is contemplated that the pressure between seals (42, 52) may be controllable.

First seal lubricating profile 46 and second seal first and second lubricating profiles (58, 64) may be the same or they may be different. The application of the lubricating seal profiles (46, 58, 64) shown in FIG. 2 are consistent with either a wave pattern or wavy edge lubricating seal profile, as shown in FIGS. 13B-13C for the nose section, or a saw-tooth pattern high film lubricating seal profile, similar to that shown in FIGS. 6-6B. However, any of the lubricating seal profiles shown in any of the Figures may be used with the sealing elements (42, 52) in FIG. 2, or with any of the sealing elements shown in any of the other Figures, to achieve the desired lubrication for the sealing element application. The location and orientation of the first seal lubricating seal profile 46 and the second seal first lubricating seal profile 58 in FIG. 2 are selected for intended fluid flow up the annular space 68 between the drill string tubular DS and the marine riser lower tubular section 32, or the diverter housing 34. Like the FIGS. 13B-13C nose sections, first seal lubricating profile 46 and second seal first lubricating profile 58 are positioned on the respective inwardly facing bore sealing surfaces (47, 57) of respective first seal nose section 48 and second seal first nose section 56A. Fluid flowing up the annulus 68 may communicate and lubricate between the respective sealing sections (48, 56A) or surfaces (47, 57) and the drill string tubular DS during rotation and/or to a lesser degree vertical sliding movement of drill string tubular DS. As will be discussed below in detail, the lubricating seal profiles shown in FIGS. 5-5C, 6-6B, and 11A are located and oriented for applications for fluid flowing downward.

Under normal operations of seal housing or RCD 49, sealing elements (42, 52) rotate with the sealed drill string tubular DS. Therefore, fluid would not communicate between the seal elements (42, 52) and the drill string tubular DS because of lack of relative rotation between the seal elements (42, 52) and the tubular DS. However, any of the profiles on the seal elements disclosed herein may be configured such that fluid may communicate between the seal elements and tubular DS from any vertical movement of tubular DS relative to the seal elements. If the RCD 49 does not allow adequate rotation of the sealing elements (42, 52), such as when the RCD bearings 45 become damaged or require lubrication, there may be relative rotational movement between the sealed drill string tubular DS and the sealing elements (42, 52). In such situations, when the pressurized fluid bypasses or flows up the annular space 68 in FIG. 2 while drill string tubular DS is rotating and/or moving vertically or longitudinally, the fluid first encounters first seal profile passageway 50. As the drill string tubular DS moves and/or rotates relative to the seal elements (42, 52), the pressurized fluid in annulus 68 communicates between first seal sealing surface 47 and drill string tubular DS, lubricating first seal 42.

The fluid may then bypasses upwards through annulus 68A, encountering second seal first profile passageway 60. Again, as the drill string tubular DS moves and/or rotates relative to the sealing elements (42, 52), the pressurized fluid communicates between second seal first sealing surface 57 and drill string tubular DS, lubricating second seal 52. The same fluid communication between the sealing elements (42, 52) and the drill string tubular DS occurs when seal housing 40 is not an RCD and does not allow rotation of the seal elements (42, 52) with the tubular DS. Also, like an RCD, vertical movement provides limited lubrication. The fluid may be the same fluid used for drilling, such as water, drilling fluid or mud, well bore fluid or other gas or liquids.

Second seal second profile 64 is positioned and orientated for intended fluid flow downward from the annular space 70 between drill string tubular DS and marine riser upper tubular section 38. In such situations, when the fluid moves down the annular space 70 while drill string tubular DS is rotating and/or moving vertically relative to second seal 52, the fluid first encounters second seal second profile passageway 66. As the drill string tubular DS moves and/or rotates relative to the seal elements (42, 52), the pressurized fluid in annulus 70 communicates between second seal second sealing surface 63 and drill string tubular DS, lubricating second seal 52. It is contemplated that second seal second profile 64 may be alternatively positioned for intended fluid flow from below, like first seal profile 46 and second seal first profile 58. For such alternative lubricating profile position, the second seal second profile would be similar to that shown in FIGS. 5-5C, 6-6B, and 11A, except with the seals positioned axially upwardly rather than axially downwardly as they are shown in FIGS. 5-5C, 6-6B, and 11A.

Each of the sealing elements (42, 52) respective seal support or throat sections (44, 54A, 54B) and sealing or nose sections (48, 56A, 56B) may have different wear resistances. Their sealing sections (48, 56A, 56B) and profiles (46, 58, 64) may each have different wear resistances. Each of the sealing elements (42, 52) sealing sections (48, 56A, 56B) may provide a stretch fit to seal the profiles (46, 58, 64) with the drill string tubular DS or other oilfield component. The lubricating seal profiles may be used in different orientations and/or locations with any of the sealing elements (42, 52) in FIG. 2 or any other Figure. It is also contemplated that no lubricating seal profiles may be used with any of the sealing elements shown in any of the Figures, including with dual sealing element or dual seal 52 in FIG. 2 and the dual seals shown in FIGS. 11 to 13G.

Figure 3:
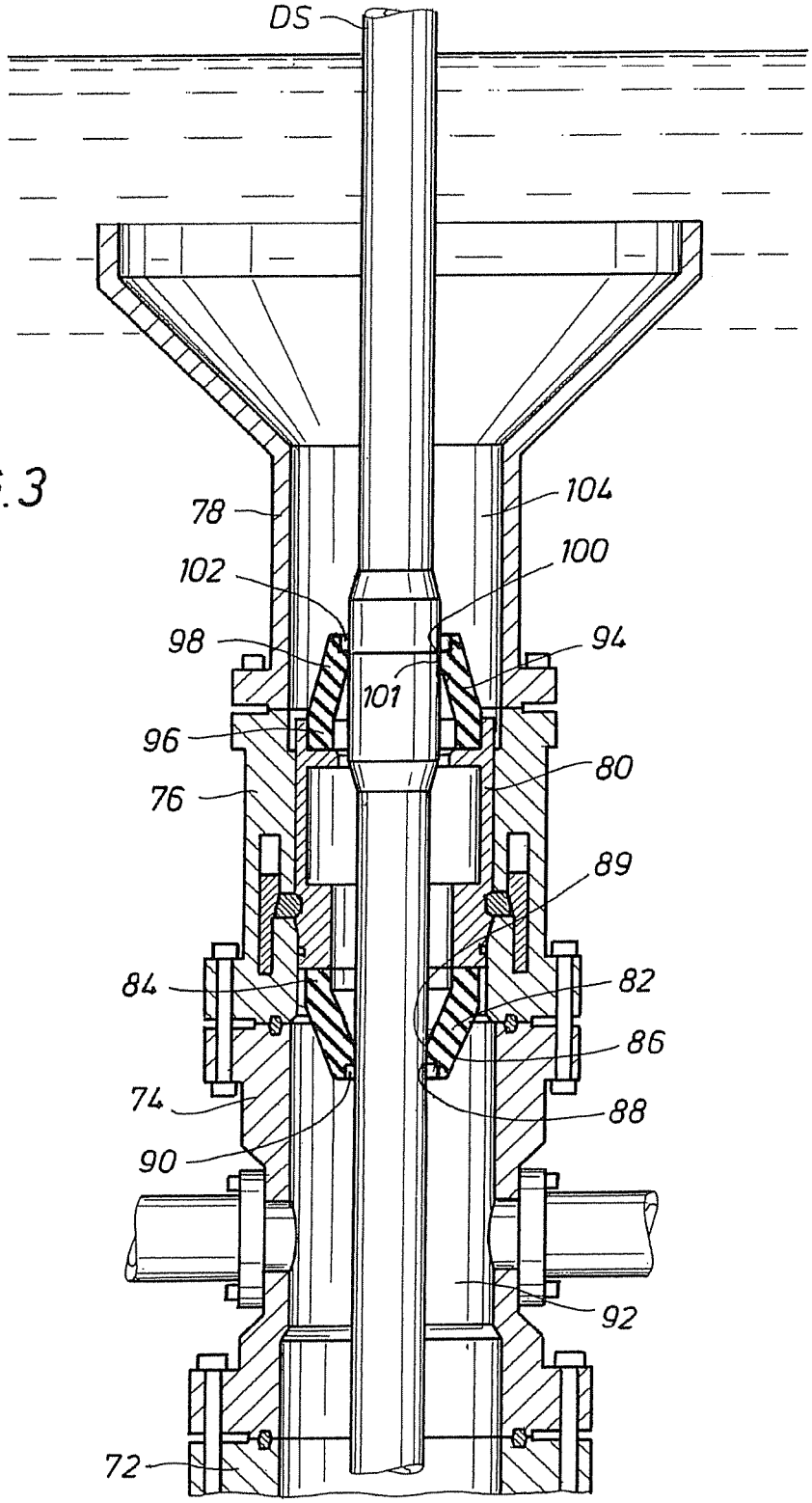
FIG. 3 is a cross-sectional elevational view of a stationary seal adapter housing with two independent or separate opposed sealing elements each having a lubricating seal profile on the inwardly facing surface of its nose section and the adapter housing latched with a latch housing disposed over a subsea diverter housing.

In FIG. 3, latch housing 76 is disposed with a subsea diverter housing 74, which is disposed with subsea lower tubular section 72. Lower tubular section 72 may be a wellhead section, although other tubular sections are contemplated. Subsea upper tubular section 78 is positioned with latch housing 76. Latch housing 76 may be a latch housing such as proposed in FIG. 2 of U.S. Pat. No. 7,487,837, although other housings are contemplated. Seal housing 80 is latched with latch housing 76. As can now be understood, there is no marine riser used in the embodiment of FIG. 3. First seal or first sealing element 82 is disposed with seal housing 80 with its first seal supporting or throat section 84. First sealing element 82 has a first seal lubricating seal profile 88 on the inwardly facing sealing surface 89 of its nose section or sealing section 86, which is sealed with drill string tubular DS.

Second seal or second sealing element 94 is disposed with seal housing 80 with its second seal supporting or throat section 96. Second seal 94 has a second seal lubricating seal profile 100 on the inwardly facing sealing surface 101 of its nose section or sealing section 98, which is sealed with drill string tubular DS. Although two sealing elements (82, 94) are shown, any number of sealing elements are contemplated, including only one sealing element. Seal housing 80 is an adapter or seal adapter housing that keeps sealing elements (82, 94) stationary so as not to allow rotation as drill string tubular DS rotates and moves vertically, such as during drilling. However, it is also contemplated that seal housing 80 may be an RCD, such as seal housing 49 shown on the left side of the break line BL in FIG. 2, that allows sealing elements (82, 94) to rotate with the sealed drill string tubular DS.

First seal lubricating profile 88 and second seal lubricating profile 100 may be the same or they may be different. The lubricating seal profiles (88, 100) shown in FIG. 3 are consistent with either a wave pattern or wavy edge lubricating seal profile, such as shown in FIGS. 13B-13C for the nose section, and similar to that shown in FIGS. 5-5C and 11A, or a saw-tooth pattern high film lubricating seal profile, similar to that shown in FIGS. 6-6B. However, any of the lubricating seal profiles shown in any of the Figures may be used with the sealing elements (82, 94) in FIG. 3, or with any of the sealing elements shown in any of the other Figures.

First seal profile 88 is positioned and oriented with the intention of fluid flowing up the annular space 92 between the drill string tubular DS and the lower tubular section 72 or the diverter housing 74. Like in FIGS. 13B-13C, first seal lubricating profile 88 is positioned on the inwardly facing bore sealing surface 89 of first seal nose section 86 so that the fluid flowing up the annular space 92 may communicate and lubricate between the first seal sealing section 86 or surface 89 and the drill string tubular DS during rotation and/or vertical movement of the drill string tubular DS.

When the pressurized fluid flows up the annular space 92 in FIG. 3 while drill string tubular DS is rotating and/or moving vertically, the fluid encounters first seal profile passageway 90. As the drill string tubular DS moves and/or rotates relative to the sealing elements (82, 94), the pressurized fluid in annulus 92 communicates between first sealing surface 89 and drill string tubular DS, lubricating first seal 82. Second seal profile 100 is positioned and oriented for intended fluid flow downward from the annular space 104 between drill string tubular DS and upper tubular section 78. Fluid moving downward in annular space 104 will encounter second seal passageway 102. As the drill string tubular DS moves and/or rotates relative to the sealing elements (82, 94), the pressurized fluid in annulus 104 communicates between second sealing surface 101 and drill string tubular DS, lubricating second seal 94.

It is contemplated that second seal profile 100 may be alternatively positioned for intended fluid flow from below, like first seal profile 88. For such alternative lubricating profile position, the second seal profile would be similar to that shown in FIGS. 5-5C, 6-6B, and 11A except with the sealing elements positioned axially upwardly in FIG. 3 rather than axially downwardly as shown in FIGS. 5-5C, 6-6B and 11A. It is contemplated that first seal 82 may be alternatively positioned for intended downward fluid flow, in which case it would appear similar to FIGS. 5-5C, 6-6B and 11A.

If seal housing 80 is an RCD, during normal operations the sealing elements (82, 94) rotate with the sealed drill string tubular DS. Therefore, fluid would not communicate between the seal elements (82, 94) and the drill string tubular DS because of lack of relative rotation between the seal elements (82, 94) and the tubular DS; however, to a lesser degree, fluid would communicate between the seal elements (82, 94) and tubular DS from any vertical movement of tubular DS relative to the vertically fixed seal elements (82, 94). If the RCD slows or stops rotating, such as from bearing failure or lack of bearing lubrication or some other problem, the drill string tubular DS may rotate relative to the sealing elements (82, 94). In such a situation, the sealing elements (82, 94) may allow lubrication from the fluid as described above for a stationary seal housing 80, thereby advantageously minimizing or reducing damage to the seal elements (82, 94).

For each sealing element (82, 94), their respective seal support or throat sections (84, 96) and sealing or nose sections (86, 98) may have different wear resistances. Their sealing sections (86, 98) and profiles (88, 100) may have different wear resistances. The respective sealing sections (86, 98) of the sealing elements (82, 94) may provide a stretch fit to seal the profiles (88, 100) with the drill string tubular DS or other oilfield component.

Turning to FIG. 4, arm 106 of ram-type BOP, generally indicated as 112, is extended with its sealing element 108 in sealing contact with drill string tubular DS. Sealing element 108 has a lubricating seal profile on its sealing surface 110. The lubricating seal profile may be any of the lubricating seal profiles shown in any of the Figures. As the drill string tubular DS moves vertically and/or rotates relative to the seal element 108, the fluid in the passageway surrounding drill string tubular DS communicates between sealing surface 110 and drill string tubular DS, lubricating seal element 108. Although not shown, it is also contemplated that any of the lubricating seal profiles shown in any of the Figures may be similarly positioned with a non-rotating annular BOP seal, such as proposed in U.S. Pat. No. 4,626,135, for fluid communication between the sealing element and the drill string tubular when the sealing element is sealed upon the drill string tubular and the drill string tubular moves vertically and/or rotates relative to the sealing element.

In FIGS. 5-5A, sealing element 114 has a wave pattern or wavy edge lubricating seal profile 118 on the sealing surface 119 of its nose or sealing section 116. Mounting ring 122 is disposed with seal supporting or throat section 120. During manufacture, an attachment member or metal ring having a plurality of threaded openings is inserted in the supporting or throat section 120 to receive threaded studs or bolts having threaded studs circumferentially spaced about the circumference of the seal element 114 or stripper rubber for mounting of the seal element 114 or stripper rubber with the mounting ring 122 of the rotating control device (RCD) seal housing. The change in bore diameter between seal bore surface 124 and sealing surface 119 creates profile passageway 126, as best shown in FIG. 5B, when drill string tubular DS is inserted in the seal bore. FIG. 5C shows a similar view as FIG. 5B with the drill string tubular DS removed.

As best shown in FIG. 5B, the lubricating seal profile 118 is positioned and oriented on the inwardly facing surface 119 of nose section 116 for intended fluid flow downwardly in profile passageway 126 surrounding drill string tubular DS. As the drill string tubular DS moves vertically and/or rotates relative to the sealing element 114, such as during drilling, the fluid may flow relative to profile passageway 126 and communicate between sealing surface 119 and drill string tubular DS, thereby lubricating sealing element 114. If fluid movement in the upward direction is intended, then sealing element 114 may be positioned axially upward rather than in the axially downward position shown in FIGS. 5 and 5B-5C. Alternatively, if upward fluid movement is intended, then the sealing element 114 may remain oriented axially downwardly as shown in FIGS. 5-5C, and the positions of sealing surface 119 and bore surface 124 may be reversed, such as shown for the seal elements (10, 18) in FIG. 1 and in FIGS. 13B-13C for the nose section, for a wave pattern. In FIG. 5B, the difference in length between sealing surface 119A shown on the left side of the drill string tubular DS as compared with the length of the sealing surface 119B shown on the right side of the drill string tubular DS is a result of the changing wave pattern best shown in FIG. 5A.

Seal support or throat section 120 and sealing or nose section 116 may have a different wear resistance. Sealing section 116 and profile 118 may have a different wear resistance. Sealing section 116 may provide a stretch fit to seal the profile 118 with the drill string tubular DS or other oilfield component.

Turning to FIGS. 6-6A, seal element, generally indicated at 128, has a saw tooth pattern high film lubricating seal profile 132 on the sealing surface 133 of its nose or sealing section 130. The profile 132 has, among other geometries, a plurality of inclined grooves. Mounting ring 138 is disposed with seal supporting or throat section 136. During manufacture, an attachment member or metal ring having a plurality of threaded openings is inserted in the supporting or throat section 136 to receive threaded studs or bolts having threaded studs circumferentially spaced about the circumference of the seal element 128 or stripper rubber for mounting of the seal element 128 or stripper rubber with the mounting ring 138 of the rotating control device (RCD) seal housing. The change in bore diameter between seal bore surface 134 and sealing surface 133 will create profile passageway 140 as best shown in FIG. 6B when drill string tubular DS in inserted in the seal bore. In FIG. 6B, the difference in length between sealing surface 133A shown on the left side of the drill string tubular DS as compared with the length of sealing surface 133B shown on the right side of the drill string tubular DS is a result of the changing saw-tooth pattern best shown in FIG. 6A.

As best shown in FIG. 6B, the lubricating seal profile 132 is positioned and oriented on the inwardly facing sealing surface 133 of nose section 130 for intended fluid flow downwardly in the profile passageway 140 surrounding drill string tubular DS. As the drill string tubular DS moves vertically and/or rotates relative to sealing element 128, such as during drilling, the fluid may move through profile passageway 140 and communicate between sealing surface 133 and drill string tubular DS, thereby lubricating sealing element 128. If fluid movement in the upward direction is intended in the profile passageway 140 surrounding drill string tubular DS, then seal element 128 may be positioned axially upward rather than in the axially downward position shown in FIGS. 6 and 6B. Alternatively, if upward fluid movement is intended, then the sealing element 128 may remain oriented axially downwardly as shown in FIGS. 6 and 6B, and the positions of sealing surface 133 and bore surface 134 may be reversed, such as for the seal elements (10, 18) in FIG. 1 and in FIGS. 13B-13C for the nose section, for a saw-tooth type pattern.

The saw-tooth pattern profile 132 provides for high fluid leakage for increased film thickness. Seal support or throat section 136 and sealing or nose section 130 may have a different wear resistance. Sealing section 130 and profile 132 may have a different wear resistance. Sealing section 130 may provide a stretch fit to seal the profile 132 with the drill string tubular DS or other oilfield component.

Figure 7:
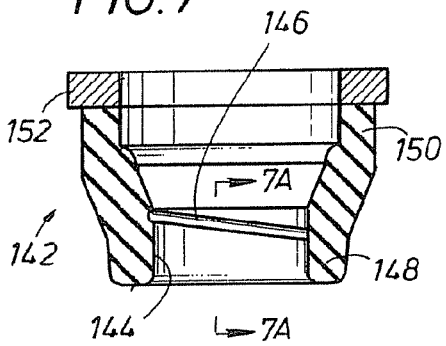
FIG. 7 is a cross-sectional elevational view of a sealing element with a downwardly inclined passageway pattern lubricating seal profile on the inwardly facing surface of the nose section.
Figure 7A:
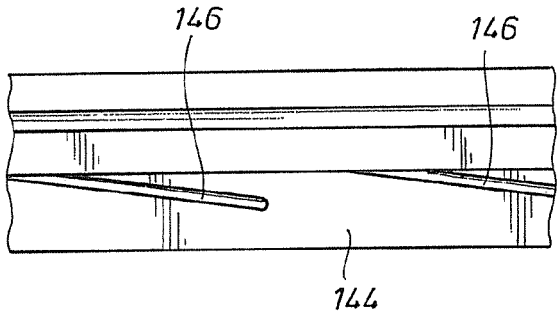
FIG. 7A is a linear representation of the view along line 7A-7A of FIG. 7 showing the downwardly inclined passageway pattern lubricating seal profile.

Turning to FIGS. 7-7A, sealing element, generally indicated 142, has a downwardly inclined passageway pattern lubricating sealing profile in the sealing surface 144 of its nose or sealing section 148. Mounting ring 152 is disposed with seal supporting or throat section 150. Downwardly inclined passageways 146 are formed in the sealing surface 144 of the sealing section 148. The downwardly inclined passageways 146 are positioned in the inwardly facing surface 144 of nose section 148 for intended fluid flow downwardly in the passageway 146 surrounding an inserted drill string tubular DS (not shown). As the drill string tubular DS moves vertically and/or rotates relative to the sealing element 142, such as during drilling, the fluid may move through passageways 146 and communicate fluid between sealing surface 144 and a drill string tubular DS, thereby lubricating sealing element 142. If fluid movement in the upward direction is intended for passageway 146 surrounding drill string tubular DS, then sealing element 142 may be positioned axially upward rather than in the axially downward position shown in FIG. 7.

Figure 8:
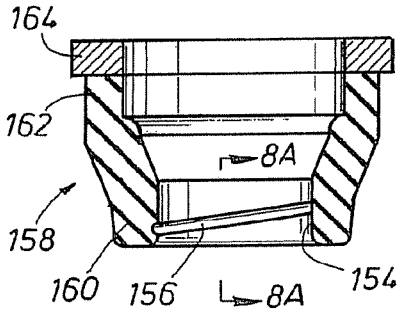
FIG. 8 is a cross-sectional elevational view of a sealing element with an upwardly inclined passageway pattern lubricating seal profile on the inwardly facing surface of the nose section.
Figure 8A:
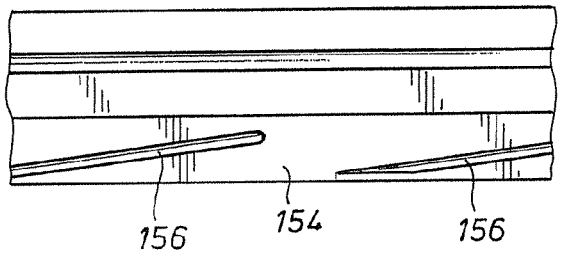
FIG. 8A is a linear representation of the view along line 8A-8A of FIG. 8 showing the upwardly inclined passageway pattern lubricating seal profile.

Turning to FIGS. 8-8A, sealing element, generally indicated as 158, has a upwardly inclined passageway pattern lubricating seal profile in the sealing surface 154 of its nose or sealing section 160. Mounting ring 164 is disposed with seal supporting or throat section 162. Upwardly inclined passageways 156 are formed in the sealing surface 154 of the sealing section 160. The upwardly inclined passageways 156 are positioned in the inwardly facing surface 154 of nose section 160 for intended fluid flow upwardly in the passageway 156 surrounding an inserted drill string tubular DS (not shown). As the drill string tubular DS moves vertically and/or rotates relative to sealing element 158, such as during drilling, the fluid may move through passageways 156 and communicate fluid between sealing surface 154 and drill string tubular DS, thereby lubricating sealing element 158. If fluid movement in the downward direction is intended in the passageways surrounding drill string tubular DS, then sealing element 158 may be positioned axially upward rather than in the axially downward position shown in FIG. 8.

Figure 9:
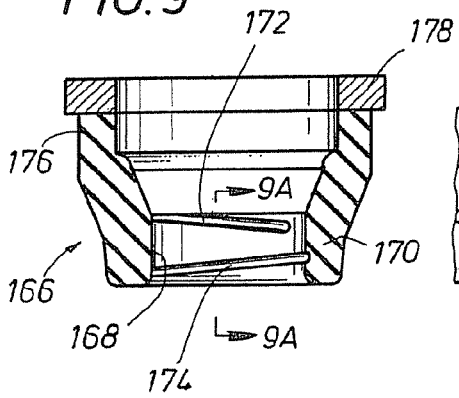
FIG. 9 is a cross-sectional elevational view of a sealing element with a combination upwardly and downwardly inclined passageway pattern lubricating seal profile on the inwardly facing surface of the nose section.
Figure 9A:
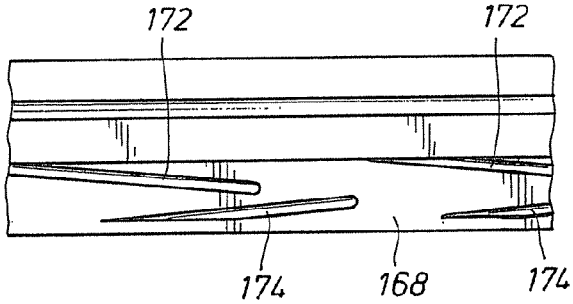
FIG. 9A is a linear representation of the view along line 9A-9A of FIG. 9 showing the combination upwardly and downwardly inclined passageway pattern lubricating seal profile.

Turning to FIGS. 9-9A, sealing element, generally indicated as 166, has a combination upwardly and downwardly inclined passageway pattern lubricating seal profile in the sealing surface 168 of its nose or sealing section 170. Mounting ring 178 is disposed with seal supporting or throat section 176. Upwardly inclined passageways 174 are formed in the sealing surface 168 of the sealing section 170. The upwardly inclined passageways 174 are positioned in the inwardly facing surface 168 of nose section 170 for intended fluid flow upwardly in the passageways 174 surrounding an inserted drill string tubular DS (not shown). As the drill string tubular DS moves vertically and/or rotates relative to seal element 166, such as during drilling, the fluid may move through upward inclined passageways 174 and communicate fluid between sealing surface 168 and drill string tubular DS, thereby lubricating seal element 166.

Downwardly inclined passageways 172 are also formed in the sealing surface 168 of the sealing section 170. The downwardly inclined passageways 172 are positioned in the inwardly facing surface 168 of nose section 170 for intended fluid flow downwardly in the passageways 172 surrounding an inserted drill string tubular DS (not shown). As the drill string tubular DS moves vertically and/or rotates relative to seal element 166, such as during drilling, the fluid may move through downward inclined passageways 172 and communicate fluid between sealing surface 168 and drill string tubular DS, thereby lubricating seal element 166. As can now be understood, the lubricating seal profile shown in FIG. 9 may be used whether fluid flow is intended in the upward or downward direction. It is also contemplated that the seal element 166 may be positioned axially upward position rather than in the axially downward position shown in FIG. 9.

For each of the sealing elements (142, 158, 166) shown in FIGS. 7-9A, their respective seal support or throat sections (150, 162, 176) and sealing or nose sections (148, 160, 170) may have different wear resistances. Each sealing section (148, 160, 170) and lubricating seal profile (144, 154, 168) may have a different wear resistance. Each sealing section (148, 160, 170) may provide a stretch fit to seal the respective lubricating seal profile (144, 154, 168) with the drill string tubular DS or other oilfield component.

Figure 10B:
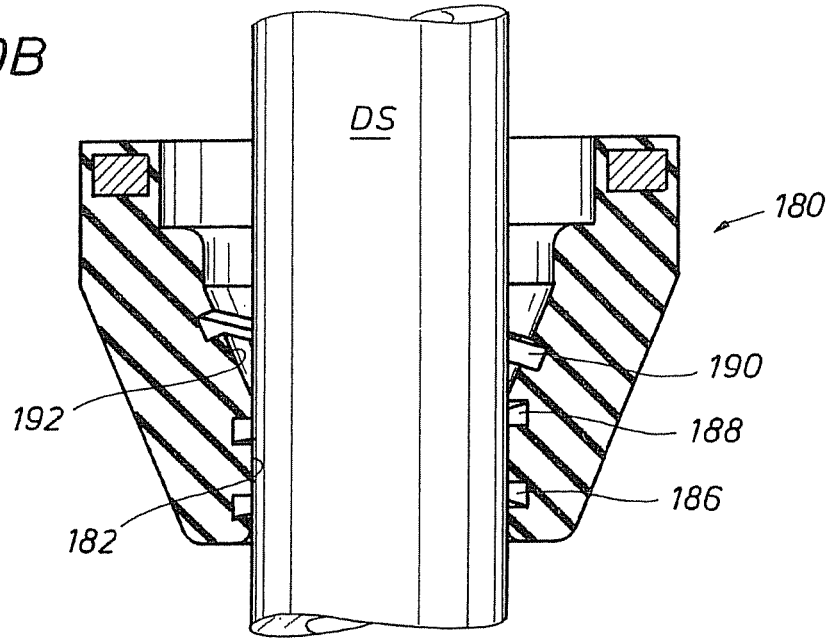
FIG. 10B is a cross-sectional elevational view of the sealing element of FIG. 10 sealed with a tubular, such as a drill string.
Figure 10C:
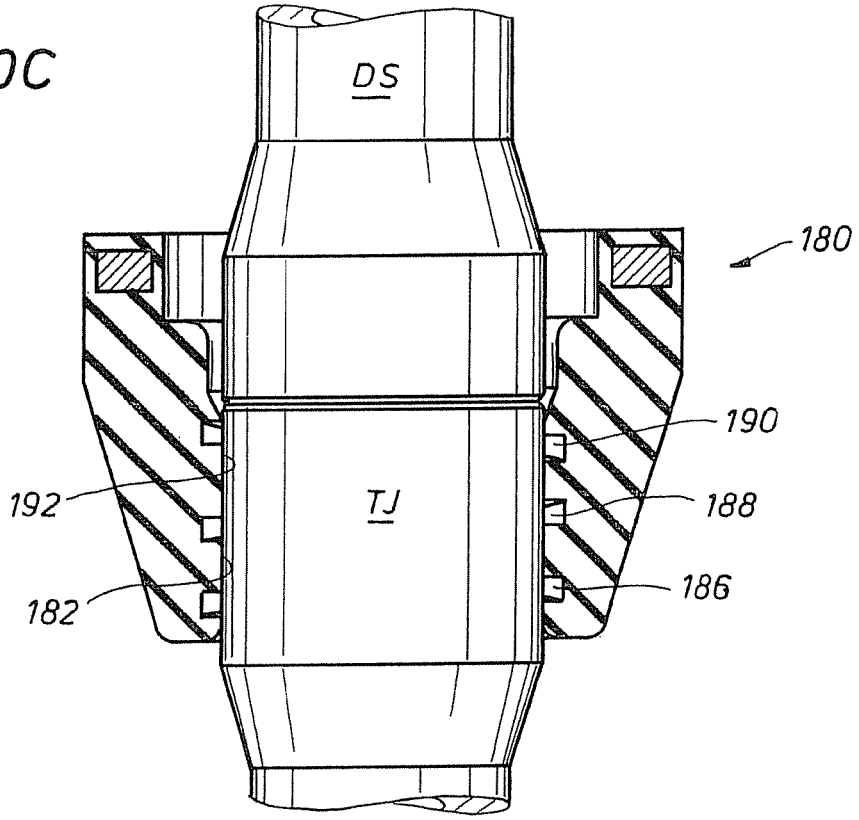
FIG. 10C is a cross-sectional elevational view of the sealing element of FIG. 10 deformed to receive and seal with a tool joint having a larger diameter than the drill string.

Turning to FIGS. 10-10A, sealing element, generally indicated as 180, has a combination upwardly and downwardly inclined passageway pattern lubricating seal profile or first profile in the first sealing surface 182 of its nose or first sealing section 184. Upwardly inclined passageways 186 are formed in the first sealing surface 182 of the nose section 184. The upwardly inclined passageways 186 are positioned in the inwardly facing first sealing surface 182 of nose section 184 for intended fluid flow upwardly in the passageways 186 surrounding an inserted drill string tubular DS (shown in FIGS. 10B-10C). As the drill string tubular DS moves vertically and/or rotates relative to seal element 180, such as during drilling, the fluid may move through upward inclined passageways 186 and communicate fluid between first sealing surface 182 and drill string tubular DS, thereby lubricating seal element 180.

Downwardly inclined passageways 188 are also formed in the first sealing surface 182 of the first sealing section 184. The downwardly inclined passageways 188 are positioned in the inwardly facing first sealing surface 182 of nose section 184 for intended fluid flow downwardly in the passageways 188 surrounding drill string tubular DS (shown in FIGS. 10B-10C). As the drill string tubular DS moves vertically and/or rotates relative to sealing element 180, such as during drilling, the fluid may move through downward inclined passageways 188 and communicate fluid between the first sealing surface 182 and drill string tubular DS, thereby lubricating seal element 184. As can now be understood, the lubricating seal profile shown in first sealing surface 182 in FIG. 10 may be used whether fluid flow is intended for upward or downward direction. It is also contemplated that the sealing element 180 may be positioned axially upward rather than in the axially downward position shown in FIG. 10.

Sealing element 180 also has a downwardly inclined passageway pattern lubricating seal profile or second profile formed in the inclined inwardly facing second sealing surface 192 that spans both nose section 184 and throat section 194 to create a second sealing section. Downwardly inclined passageways 190 are formed in the second sealing surface 192 for intended fluid flow downwardly in the passageways 190 surrounding drill string tubular DS with a larger diameter component, such as tool joint TJ best shown in FIG. 10C. In other words, the inwardly facing second sealing surface 192 has a greater bore diameter than the inwardly facing first sealing surface 182.

As shown in FIG. 10B, when a drill string tubular DS with a first diameter rotates and/or moves vertically relative to sealing element 180, first sealing surface 182 may seal with drill string tubular DS. Fluid may communicate via passageways (186, 188) between first sealing surface 182 and the outer surface of drill string tubular DS during movement of drill string tubular DS. However, as shown in FIG. 10C, when a connected following oilfield component has a second diameter greater than the first diameter of tubular DS, such as tool joint TJ in drill string tubular DS, the component or tool joint TJ may be sealed with the inwardly facing second sealing surface 192 and the first sealing surface 182. Fluid may then additionally communicate via passageways (186, 188) between the first sealing surface 182 and the outer surface of drill string tubular component TJ, and the second sealing surface 192 and the outer surface of drill string tubular component TJ via passageway 190 during movement of drill string tubular DS.

As can now be understood, stripper rubber 180 has a first annular sealing surface 182 having a first sealing diameter and a first profile, and a second annular sealing surface 192 having a second sealing diameter greater than the first sealing diameter and a second profile. Drill string tubular DS having a first tubular diameter may be in contact with the first profile 182 (FIG. 10B), and drill string tubular DS having a second and larger tubular diameter, such as tool joint TJ, may be in contact with both first sealing section 182 and second sealing section 192 (FIG. 10C). Stripper rubber 180 is deformable so that the first annular sealing surface 182 and the second annular sealing surface 192 may deform to an aligned position such as shown in FIG. 10C. FIG. 10B shows first sealing surface 182 and second sealing surface 192 in non-aligned positions.

Figure 11:
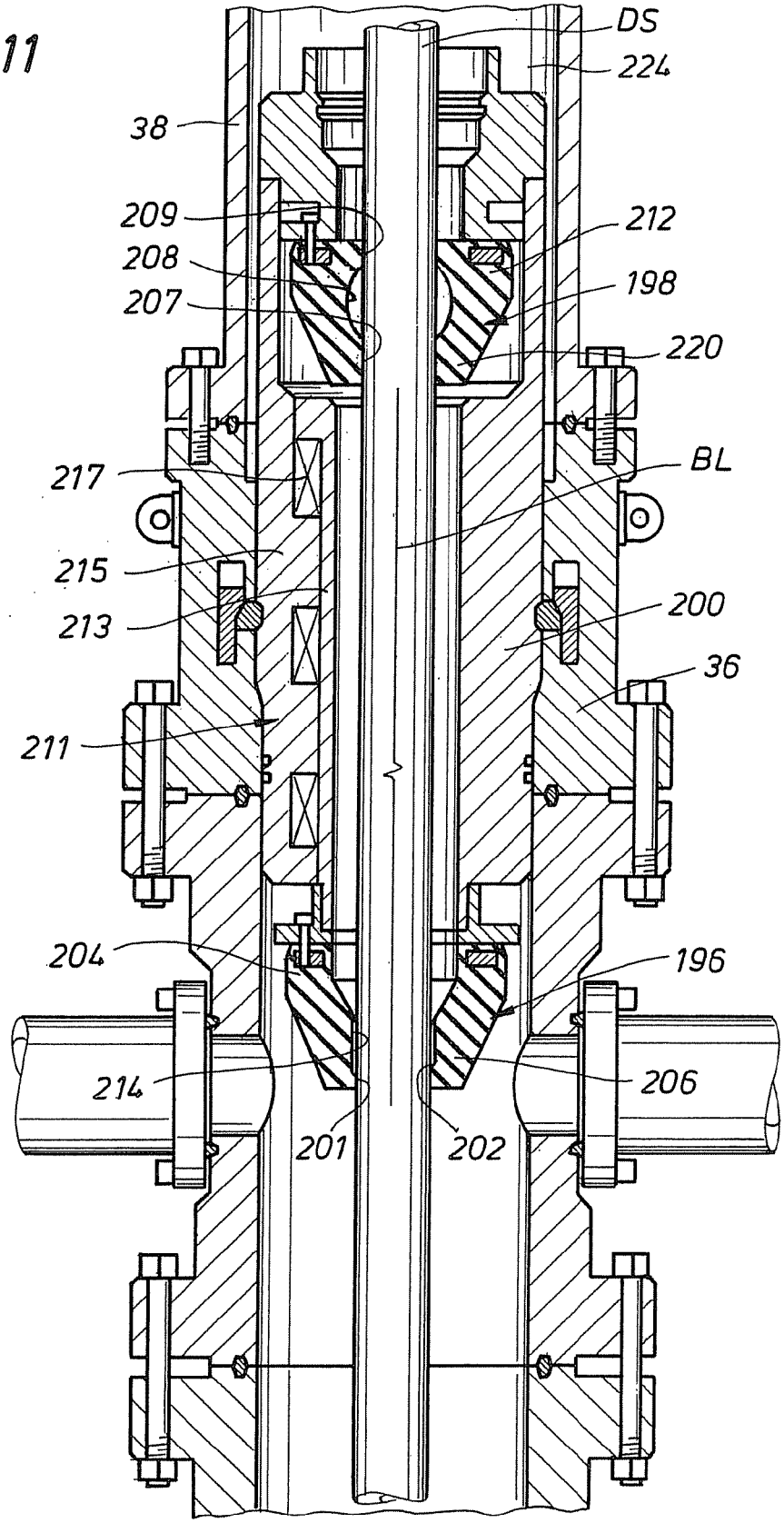
FIG. 11 is a cross-sectional elevational view of an RCD on the left side of the break line, and a stationary seal adapter housing on the right side of the break line, with an upper dual seal, and a lower sealing element having a lubricating seal profile on the inwardly facing surface of its nose section, where the RCD and adapter housing is latched with a latch housing disposed in a marine riser over a diverter housing.

FIG. 11 is similar to FIG. 2, except for the sealing elements (196, 198). On the right side of the vertical break line BL, seal housing 200 is latched with latch housing 36 within the marine riser. Seal housing 200 is an adapter or seal adapter housing that is stationary and does not allow rotation of the sealing elements (196, 198). On the left side of the vertical break line BL, seal housing or RCD 211 has a stationary outer member 215 and a rotatable inner member 213 with bearings 217 therebetween. Seal housing or RCD 211 allows rotation of the sealing elements (196, 198). Outer member 215 of seal housing or RCD 211 is latched with latch housing 36. As can now be understood, a seal housing that is an RCD or a stationary seal adapter housing may be used with FIG. 11.

First seal or first sealing element 196 is disposed with seal housing (200, 211) with its first seal supporting or throat section 204. During manufacture, an attachment member or metal ring having a plurality of threaded openings is inserted in the supporting or throat section 204 to receive threaded studs or bolts having threaded studs circumferentially spaced about the circumference of the seal element 196 or stripper rubber for mounting of the seal element 196 or stripper rubber with the mounting ring (as shown) of the rotating control device (RCD) seal housing (200, 211). First sealing element 196 has a seal lubricating seal profile 202 on the inwardly facing sealing surface 201 of its first seal nose section or sealing section 206, which is sealed with drill string tubular DS. Seal lubricating seal profile 202 is a wave pattern best shown in FIG. 5B. The seal lubricating seal profile 202 is located on the inwardly facing sealing surface 201 of first seal 196 for intended downward fluid flow.

Second seal or second sealing element 198 is a dual seal best shown in FIG. 13A, with two spaced apart annular sealing surfaces (207, 209) spaced apart by a nonsealing surface 208 that is an alternative embodiment to the dual seal 52 shown in FIG. 2. Sealing element 198 is disposed with seal housing (200, 211) with its second seal supporting section or throat 212. During manufacture, an attachment member or metal ring having a plurality of threaded openings is inserted in the supporting or throat section 212 to receive threaded studs or bolts having threaded studs circumferentially spaced about the circumference of the seal element 198 or stripper rubber for mounting of the seal element 198 or stripper rubber with the mounting ring (as shown) of the rotating control device (RCD) seal housing (200, 211). Second sealing element 198 does not have a lubricating seal profile shown on the inwardly facing first sealing surface 207 of its second seal nose section or first sealing section 220, which is sealed with drill string tubular DS, nor is a lubricating seal profile shown on the inwardly facing second sealing surface 209 of the throat section 212, which is also sealed with drill string tubular DS. It is contemplated that second seal 198 may or may not form lubricating seal profiles on one or both of its sealing surfaces (207, 209).

As can now be understood, second sealing element 198 is a dual seal with two annular sealing sections (220, 212) and sealing surfaces (207, 209) that are spaced apart by a nonsealing surface 208. It is contemplated that second sealing element 198 may be a single unit. It may be formed or molded as a unitary or monolithic unit. Although two sealing elements (196, 198) are shown in FIG. 11, any number of sealing elements are contemplated, including only one sealing element. It is contemplated that the pressure between sealing elements (196, 198) may be controllable as disclosed above.

First seal lubricating profile 202 is consistent with either a wave pattern or wavy edge lubricating seal profile, such as shown in FIGS. 5-5C and FIG. 11A, or a saw-tooth pattern high film lubricating seal profile, such as shown in FIGS. 6-6B. However, any of the lubricating seal profiles shown in any of the Figures may be used with the sealing elements (196, 198) in FIG. 11, or with any of the seals shown in any of the other Figures.

The orientation and location of the first seal lubricating seal profile 202 is for fluid flow down the annular space 224 between the drill string tubular DS and the marine riser upper tubular section 38. Like in FIGS. 5-5C and 6-6B, first seal lubricating profile 202 is positioned on the inwardly facing bore sealing surface 201 of first seal nose section 206 so that the fluid moving down the annulus or annular space 224 may communicate fluid to lubricate between the sealing surface 201 and the drill string tubular DS.

Under normal operations of seal housing or RCD 211, sealing elements (196, 198) may rotate with the sealed drill string tubular DS. Therefore, fluid would not communicate between the seal elements (196, 198) and the drill string tubular DS because of lack of relative rotation between the seal elements (196, 198) and the tubular DS. However, as discussed above, a profile on one and/or the other of the seal elements (196, 198) may be configured such that fluid may communicate between the seal elements (196, 198) and tubular DS from any vertical movement of tubular DS relative to the seal elements (196, 198). If the RCD does not allow adequate rotation of the sealing elements (196, 198), such as when the RCD bearings become damaged or require bearing lubrication, there may be relative movement between the sealed drill string tubular DS and the sealing elements (196, 198). In such situations, when the pressurized fluid flows down the annular space 224 while drill string tubular DS is rotating or moving vertically, and dual seal 198 has lubricating seal profiles (not shown) on its sealing surfaces (207, 209), the fluid may communicates between the second seal second sealing surfaces (207, 209) and chill string tubular DS, lubricating dual seal 198.

The fluid may then move downwards, encountering first seal profile passageways 214. As the drill string tubular DS moves and/or rotates relative to the first sealing element 196, the pressurized fluid communicates fluid between first seal first sealing surface 201 and drill string tubular DS, lubricating first sealing element 196.

The same fluid communication between the sealing elements (196, 198) and the drill string tubular DS occurs when dual seal 198 has lubricating seal profiles (not shown) and seal stationary adapter housing 200 does not allow rotation of the sealing elements (196, 198). The fluid may be the same fluid used for drilling, such as water, drilling fluid or mud, well bore fluid or gas or other liquids. Although the first seal lubricating seal profile 202 is intended for downward fluid flow, it is also contemplated that that any of the lubricating seal profiles disclosed may be selected for upward fluid flow.

FIGS. 12-12A show a dual seal, generally indicated as 226, with two annular sealing surfaces (228, 230) spaced apart by a nonsealing surface 229 that may be used with any seal housing, including an RCD, shown in or discussed with any of the Figures. It is contemplated that any lubricating seal profile shown in any of the Figures may be used with either or both of the sealing surfaces (228, 230) of dual seal 226. The two spaced apart annular sealing surfaces (228, 230) may seal with a drill string tubular DS or other oilfield component (not shown). Seal first profile is a combination upwardly and downwardly inclined passageway pattern, with downwardly inclining passageways 240 and upwardly inclining passageways 242 disposed in the inwardly facing first sealing surface 228 of the nose section or first sealing section 232.

Seal second profile is a downwardly inclined passageway pattern, with downwardly inclining passageways 244 formed in the inwardly facing second sealing surface 230 of throat or support section 234. An annular closed curved or radius hydraulic force surface 238 is formed in the top of the throat section 234. The annular hydraulic force surface 238 allows fluid flowing downward to apply a force and either move, deform or compress second sealing surface 230 against the sealed drill string tubular DS (not shown). The hydraulic force surface 238 also allows fluid flowing downward to move, deform or compress seal 226 downward, adding to the sealing force of second sealing surface 230 against the sealed drill string tubular DS. It is contemplated that the hydraulic force surfaces may be a continuing annular surface, although spaced apart or equidistant segmented hydraulic force surfaces could also be used for any of the embodiments disclosed herein. The fluid to apply a force may be the fluid used for drilling, such as water, drilling fluid or mud, well bore fluid or gas or other liquids.

For the sealing elements (180, 196, 198, 226) in FIGS. 10-12A, each of their respective seal support or throat sections (194, 204, 212, 234) and sealing or nose sections (184, 206, 220, 232) may have a different wear resistance. Their sealing sections (184, 206, 220, 232) and lubricating seal profiles may have a different wear resistance. Each sealing element (180, 196, 198, 226) may have a sealing section (184, 206, 220, 232) that may provide a stretch fit to seal the lubricating seal profile with the drill string tubular DS or other oilfield component.

Turning to FIG. 13A, dual seal, generally indicated at 198, with two annular sealing surfaces (207, 209) spaced apart by a nonsealing surface 208 may be used with any seal housing, including an RCD, shown in or discussed with any of the Figures. Dual seal 198 is shown positioned with seal housings (200, 211) in FIG. 11. Returning to FIG. 13A, although no lubricating seal profiles are shown, it is contemplated that any lubricating seal profile shown in any of the Figures may be used with either or both of the sealing surfaces (207, 209) of seal element 198. The two spaced apart annular sealing surfaces (207, 209) may seal with drill string tubular DS or other oilfield component (not shown). When a fluid force is applied to upwardly facing annular flat hydraulic force surface 212A formed in dual seal 198, inwardly facing annular sealing surface 209 moves, deforms or compresses to provide an inwardly sealing force to surface 209 against tubular DS or other oilfield component. Although not shown, it is also contemplated that other hydraulic force surfaces may be disposed with the top of the throat section 212, such as shown in FIGS. 12, 13B, and 13D-13G. Any of the hydraulic force surfaces shown in any of the Figures may be used with any sealing element shown in any of the Figures.

In FIG. 13B, dual seal, generally indicated at 250, has two annular sealing surfaces (252, 260) spaced apart by nonsealing surface 255. First inwardly facing sealing surface 252 of nose sealing section 256 has a lubricating seal profile 254. As best shown in FIG. 13C, lubricating seal profile 254 is a wave pattern or wavy edge pattern. The profile 254 is positioned and oriented with nose sealing section 256 intended for upward fluid flow. Seals (10, 18) in FIG. 1 have similar nose sections as the nose section 256 of seal 250 in FIG. 13B. Seal supporting or throat section 258 has a second inwardly facing sealing surface 260.

An annular open inclined or angled hydraulic force surface 262 is formed in the top of the throat section 258. The annular hydraulic force surface 262 allows fluid flowing downward to apply a force to either move, deform or compress second sealing surface 260 against the sealed drill string tubular DS (not shown). The annular hydraulic force surface 262 also allows fluid flowing downward to move, deform or compress seal 250 downward, adding to the sealing capacity of second sealing surface 260 against the sealed drill string tubular DS. It is contemplated that spaced apart or segmented hydraulic forces surfaces may be used with any of the dual seals shown in any of the FIGS. 11 to 13G. It is contemplated that nose sealing section 256 may not be formed with a lubricating seal profile 254. It is also contemplated that nose sealing section 256 may have a different lubricating seal profile. It is also contemplated that second sealing surface 260 may have a lubricating seal profile.

In FIG. 13D, dual seal, generally indicated at 262, has two annular sealing surfaces spaced apart by a non-sealing surface 267, although only the second sealing surface 266 is shown for clarity. Dual seal 262 may have a nose section like any other seal shown in any of the other Figures. Seal supporting or throat section 264 has a second inwardly facing sealing surface 266. An annular open curved or radius hydraulic force surface 268 is formed in the top of the throat section 264. The annular hydraulic force surface 268 allows fluid flowing downward to apply a force and either move, deform or compress second sealing surface 266 against the sealed drill string tubular DS (not shown). The annular hydraulic force surface 268 also allows fluid flowing downward to move, deform or compress seal 262 downward, adding to the sealing capacity of second sealing surface 266 against the sealed drill string tubular DS. It is contemplated that a similar hydraulic force surface may be used with any of the dual seals shown in any of the FIGS. 11 to 13G. It is also contemplated that second sealing surface 266 may have a lubricating seal profile.

Turning to FIG. 13E, dual seal, generally indicated at 270, has two annular sealing surfaces spaced apart by a non-sealing surface 273, although only the second sealing surface 274 is shown for clarity. Dual seal 270 may have a nose section like any other seal shown in any of the other Figures. Seal supporting or throat section 272 has a second inwardly facing sealing surface 274. A combination annular open inclined hydraulic force surface 276 with a substantially horizontal or flat hydraulic force surface 278 is formed in the top of the throat section 272. The annular hydraulic force surface (276, 278) allows fluid moving downward to apply a force to either move, deform or compress second sealing surface 274 against the sealed drill string tubular DS (not shown). The annular hydraulic force surface (276, 278) also allows fluid flowing downward to move, deform or compress seal 270 downward, adding to the sealing capacity of second sealing surface 274 against the sealed drill string tubular DS. It is contemplated that a similar hydraulic force surface may be used with any of the dual seals shown in any of the FIGS. 11 to 13G. It is also contemplated that second sealing surface 274 may have a lubricating seal profile.

In FIG. 13F, dual seal, generally indicated at 280, has two annular sealing surfaces spaced apart by a non-sealing surface 283, although only the second sealing surface 284 is shown for clarity. Dual seal 280 may have a nose section like any other seal shown in any of the other Figures. Seal supporting or throat section 282 has a second inwardly facing sealing surface 284. A combination annular open curved or radius hydraulic force surface 286 with a substantially horizontal or flat hydraulic force surface 288 is formed in the top of the throat section 282. The annular hydraulic force surface (286, 288) allows fluid flowing downward to apply a force to either move, deform or compress second sealing surface 284 against the sealed drill string tubular DS (not shown). The annular hydraulic force surface (286, 288) also allows fluid flowing downward to move, deform or compress seal 280 downward, adding to the sealing capacity of second sealing surface 284 against the sealed drill string tubular DS. It is contemplated that a similar hydraulic force surface may be used with any of the dual seals shown in any of the FIGS. 11 to 13G. It is also contemplated that second sealing surface 284 may have a lubricating seal profile.

In FIG. 13G, dual seal, generally indicated at 290, has two annular sealing surfaces spaced apart by a non-sealing surface 297, although only the second sealing surface 294 is shown for clarity. Dual seal 290 may have a nose section like any other seal shown in any of the other Figures. Seal supporting or throat section 292 has a second inwardly facing sealing surface 294. A combination annular first or upper closed curved hydraulic force surface 296 with an annular second or lower closed curved hydraulic force surface 298 are formed with the second sealing surface 294 therebetween. The annular hydraulic force surfaces (296, 298) allows fluid flow downward to apply a force to either move, deform or compress second sealing surface 294 against the sealed drill string tubular DS (not shown). The annular hydraulic force surfaces (296, 298) also allows fluid to move, deform or compress seal 290 by squeezing downward and upward, adding to the sealing capacity of second sealing surface 294 against the sealed drill string tubular DS. It is contemplated that similar hydraulic force surfaces may be used with any of the dual seals shown in any of the FIGS. 11 to 13. It is also contemplated that second sealing surface 294 may have a lubricating seal profile. Other configurations of hydraulic sealing surfaces are contemplated for all seal elements.

The foregoing disclosure and description of the invention are illustrative and explanatory thereof, and various changes in the details of the illustrated apparatus and system, and the construction and the method of operation may be made without departing from the spirit of the invention.

We claim:

1. A cone-shaped sealing element configured for use with a seal housing and having a stretch fit or other urging member for sealing with an oilfield component, the sealing element having a bore for receiving the oilfield component, the cone-shaped sealing element comprising:

a seal supporting section disposed on the cone-shaped sealing element;

an attachment member having a plurality of threaded openings disposed with said seal supporting section and said attachment member threaded openings configured for fixed interengaged attachment with the seal housing;

a sealing section disposed on the cone-shaped sealing element having an inwardly facing bore surface without said sealing section being disposed in a groove; and a profile formed on said sealing section inwardly facing bore surface configured to seal the oilfield component while configured to communicate a fluid between said sealing section and the oilfield component.

2. The sealing element of claim 1, wherein the fluid is water.

3. The sealing element of claim 2, wherein the water is communicated by said profile disposed with said sealing section.

4. The sealing element of claim 1, wherein the fluid is drilling mud.

5. The sealing element of claim 1, wherein the fluid is well bore fluid.

6. The sealing element of claim 1, further comprising a threaded stud configured to be threadly received in one of said attachment member threaded openings.

7. The sealing element of claim 1, wherein said seal support section and said sealing section having a different wear resistance.

8. The sealing element of claim 1, wherein said sealing section and said profile having a different wear resistance.

9. The sealing element of claim 1, wherein said sealing section providing a stretch fit to seal said profile with the oilfield component.

10. The sealing element of claim 1, further comprising a second sealing section having an inwardly facing bore surface, said sealing surface and said second sealing surface disposed on the cone-shaped sealing element separated by a non-sealing surface of the cone-shaped sealing element.

11. The sealing element of claim 1, wherein said profile includes a wave pattern.

12. The sealing element of claim 1, wherein said profile includes a saw tooth pattern.

13. The sealing element of claim 1, wherein said profile having a pattern of a plurality of spaced apart inclined grooves formed in said inwardly facing bore surface configured to communicate the fluid between said sealing section and the oilfield component as said sealing section rotates with the oilfield component.

14. The sealing element of claim 1, further comprising:

a hydraulic force surface configured to urge said sealing section toward said oilfield tubular.

15. The sealing element of claim 1, wherein said seal housing further comprising:

a stationary outer member;

a rotatable inner member; and a bearing assembly disposed between said outer member and said inner member;

wherein said sealing element is fixed in said seal housing with said rotatable inner member.

16. A sealing element configured for use with a seal housing and having an urging member for sealing with an oilfield component, the sealing element having a bore for receiving the oilfield component, the sealing element comprising:

a seal supporting section;

an attachment member having a plurality of threaded openings disposed with said seal supporting section and said attachment member threaded openings configured for fixed interengaged attachment with the seal housing;

a sealing section having an inwardly facing bore surface without said sealing section being disposed in a groove; and a profile formed on said sealing section inwardly facing bore surface configured to seal the oilfield component while configured to communicate a fluid between said sealing section and the oilfield component, wherein said sealing element is disposed on a blowout preventer to seal the oilfield component.

17. The sealing element of claim 16, further comprising a threaded stud configured to be threadedly received in one of said attachment member threaded openings.

18. The sealing element of claim 16, wherein said profile having a pattern of a plurality of spaced apart inclined grooves formed in said inwardly facing bore surface configured to communicate the fluid between said sealing section and the oilfield component as said sealing element rotates with the oilfield component.

19. A cone-shaped stripper rubber configured for use with a seal housing and having a stretch fit or other urging member for sealing with an oilfield component, the stripper rubber having a bore for receiving the oilfield component, the stripper rubber comprising:

a throat section disposed on the cone-shaped stripper rubber;

an attachment member having a plurality of threaded openings disposed with said seal supporting section and said attachment member threaded openings configured for fixed interengaged attachment with the seal housing;

a nose section disposed on the cone-shaped stripper rubber without said nose section being disposed in a groove;

wherein one of said sections having an inwardly facing bore surface; and a profile formed on said section inwardly facing bore surface and configured to seal the oilfield component while configured to communicate a fluid between said stripper rubber and the oilfield component.

20. The stripper rubber of claim 19, further comprising a threaded stud configured to be threadedly received in one of said attachment member threaded openings.

21. The stripper rubber of claim 19, further comprising the oilfield component having a first diameter and a second diameter greater than said first diameter, wherein the stripper rubber comprising:

a first annular sealing surface having a first diameter and a first profile;

a second annular sealing surface having a second diameter greater than said first surface diameter and a second profile;

wherein the oilfield component first diameter being in contact with said first annular sealing surface profile and spaced apart from said second annular sealing surface profile, and wherein the oilfield component second diameter being in contact with said first annular sealing surface profile and said second annular sealing surface.

22. The stripper rubber of claim 19, comprising:

a first annular sealing surface having a first diameter and a first profile; and a second annular sealing surface having a second diameter greater than said first surface diameter and a second profile;

wherein said stripper rubber configured to be deformable so that said second annular sealing surface deforming to a substantially aligned position with said first annular sealing surface.

23. The stripper rubber of claim 22, wherein the oilfield component movable relative to said stripper rubber and configured to deform said stripper rubber to said aligned position wherein said first profile and said second profile configured to communicate the fluid between said stripper rubber and the oilfield component.

24. The stripper rubber of claim 19, wherein said profile includes a wave pattern.

25. The stripper rubber of claim 19, wherein said profile includes a saw tooth pattern.

26. The stripper rubber of claim 19, wherein said profile having a pattern of a plurality of spaced apart inclined grooves formed in said inwardly facing bore surface configured to communicate the fluid between said stripper rubber and the oilfield component as said stripper rubber rotates with the oilfield component.

27. The stripper rubber of claim 19, wherein said stripper rubber having two spaced apart annular sealing surfaces.

28. The stripper rubber of claim 27, further comprising a plurality of nose sections and throat sections on a unitary stripper rubber, wherein the unitary stripper rubber comprises opposed stripper rubber nose sections to provide a bi-directional seal.

29. The stripper rubber of claim 27, further comprising a hydraulic force surface formed on said stripper rubber, wherein said hydraulic force surface formed on the stripper rubber for urging the stripper rubber inwardly to provide an annular sealing surface.

30. The stripper rubber of claim 29, wherein said hydraulic force surface being in said throat section.

31. The stripper rubber of claim 19, further comprising a second stripper rubber configured to seal the oilfield component, the second stripper rubber having a bore for receiving the oilfield component, wherein the pressure between said stripper rubbers is controllable.

32. The stripper rubber of claim 19, further comprising:

a hydraulic force surface configured to urge said section inwardly facing bore surface toward said oilfield tubular.

33. The stripper rubber of claim 19, wherein said seal housing further comprising:

a stationary outer member;

a rotatable inner member; and a bearing assembly disposed between said outer member and said inner member;

wherein said stripper rubber is fixed in said seal housing with said rotatable inner member.

34. A method for lubricating between a cone-shaped sealing element having a stretch fit or other urging member and an oilfield tubular for communicating a pressurized mud while drilling with the pressurized mud, comprising the steps of:

fixedly interengaging an attachment member having a plurality of threaded openings disposed with said sealing element with a seal housing using a threaded stud;

positioning said cone-shaped sealing element having a profile in communication with a fluid without a nose section of the sealing element being disposed in a groove;

sealing the oilfield component with said sealing element profile when the pressurized mud acts on the cone-shaped sealing element;

moving the oilfield tubular relative to said sealing element; and communicating the fluid between said sealing element and the oilfield tubular during the step of moving said sealing element relative to the oilfield tubular.

35. The method of claim 34, wherein the fluid is below said sealing element.

36. The method of claim 35, wherein the fluid is above said sealing element and further comprising the step of:

sealing the oilfield tubular with a first sealing surface and a second spaced apart sealing surface.

37. The method of claim 34, wherein the step of moving comprises vertically sliding said oilfield tubular relative to said sealing element.

38. The method of claim 34, wherein the sealing element comprises a stripper rubber having a bore for receiving the oilfield tubular, the stripper rubber comprising:

a throat section disposed on the cone-shaped stripper rubber;

said nose section disposed on the cone-shaped stripper rubber;

wherein one of said sections having an inwardly facing bore surface; and a profile on said section inwardly facing bore surface to seal the oilfield tubular while communicating the fluid between said stripper rubber and the oilfield tubular.

39. The method of claim 34, further comprising the step of:

urging said sealing element profile toward the oilfield tubular when the pressurized mud acts on a hydraulic force surface.

40. The method of claim 34, wherein said seal housing further comprising:

a stationary outer member;

a rotatable inner member; and a bearing assembly disposed between said outer member and said inner member;

wherein said sealing element is fixed in said seal housing with said rotatable inner member.

41. The method of claim 34, wherein said step of communicating comprises said profile having a pattern of a plurality of spaced apart inclined grooves formed in said sealing element to communicate the fluid between said sealing element and the oilfield component as said sealing element rotates with the oilfield component.

42. A stripper rubber configured for use with a seal housing and having a stretch fit or other urging member for sealing with an oilfield component, the stripper rubber having a bore for receiving the oilfield component, the stripper rubber comprising:

a first annular sealing surface on said stripper rubber bore surface without the stripper rubber first sealing surface being disposed in a groove;

a second annular sealing surface on said stripper rubber bore surface;

an attachment member having a plurality of threaded openings disposed with one of said annular sealing surfaces and said attachment member threaded openings configured for fixed interengaged attachment with the seal housing; and a profile formed on one of said annular sealing surfaces configured to seal the oilfield component while configured to communicate a fluid between said stripper rubber and said oilfield component;

wherein said first annular sealing surface and said second annular sealing surface being spaced apart by a non-sealing surface.

43. The stripper rubber of claim 42, wherein said stripper rubber is unitary.

44. The stripper rubber of claim 42, further comprising:

a first nose section having a first nose inwardly facing bore surface; and a second nose section having a second nose inwardly facing bore surface;

wherein said first annular sealing surface is on said first nose inwardly facing bore surface; and wherein said second annular sealing surface is on said second nose inwardly facing bore surface.

45. The stripper rubber of claim 42, further comprising:

a profile formed on said first annular sealing surface configured to seal the oilfield component while configured to communicate a fluid between said stripper rubber and said oilfield component.

46. The stripper rubber of claim 42, further comprising:

a hydraulic force surface configured to urge the first annular sealing surface inwardly against said oilfield component.

47. The stripper rubber of claim 42, further comprising:

a nose section having a nose inwardly facing bore surface; and a throat section having a throat inwardly facing bore surface;

wherein said first annular sealing surface is on said nose inwardly facing bore surface; and wherein said second annular sealing surface is on said throat inwardly facing bore surface.

48. The stripper rubber of claim 42, further comprising a threaded stud configured to be threadedly received in one of said attachment member threaded openings.

49. The stripper rubber of claim 42, wherein said seal housing further comprising:

a stationary outer member;

a rotatable inner member; and a bearing assembly disposed between said outer member and said inner member;

wherein said stripper rubber is fixed in said seal housing with said rotatable inner member.

50. The stripper rubber of claim 42, wherein said profile having a pattern of a plurality of spaced apart inclined grooves formed in one of said annular sealing surfaces configured to communicate the fluid between said stripper rubber and said oilfield component as said stripper rubber rotates with the oilfield component.

51. A seal system having a stretch fit or other urging member for sealing with an oilfield tubular for communicating a pressurized mud while drilling with the pressurized mud, comprising:

a seal housing having a seal housing bore;

a cone-shaped dual seal having a seal bore; and an attachment member having a plurality of threaded openings disposed with said seal and said attachment member threaded openings configured for fixed interengaged attachment with the seal housing;

wherein said cone-shaped dual seal fixed in said seal housing bore;

wherein said dual seal having a first annular sealing surface and a second annular sealing surface, one of said sealing surfaces having a profile thereon configured to communicate a fluid between said sealing surface and the oilfield tubular without said one of said sealing surfaces being disposed in a groove; and wherein said first annular sealing surface and said second annular sealing surface being spaced apart by a non-sealing surface.

52. The seal system of claim 51, wherein said seal housing is stationary to resist said dual seal from rotating.

53. The seal system of claim 51, wherein said seal housing further comprising:

a stationary outer member;

a rotatable inner member; and a bearing assembly disposed between said outer member and said inner member;

wherein said dual seal is fixed in said seal housing with said rotatable inner member.

54. The seal system of claim 51, further comprising:

a hydraulic force surface configured to urge one of said first annular sealing surfaces toward said oilfield tubular.

55. The seal system of claim 51, further comprising a threaded stud configured to be threadedly received in one of said attachment member threaded openings.

56. The seal system of claim 51, wherein said profile having a pattern of a plurality of spaced apart inclined grooves formed in one of said sealing surfaces configured to communicate the fluid between said sealing surface and the oilfield tubular as said dual seal rotates with the oilfield component.

* * * * *